US010287825B2

(12) United States Patent
Chen et al.

(10) Patent No.: US 10,287,825 B2
(45) Date of Patent: May 14, 2019

(54) CUTTING ELEMENTS HAVING NON-PLANAR SURFACES AND DOWNHOLE CUTTING TOOLS USING SUCH CUTTING ELEMENTS

(71) Applicant: Smith International, Inc., Houston, TX (US)

(72) Inventors: Chen Chen, New Haven, CT (US); Huimin Song, Spring, TX (US); Liang Zhao, Katy, TX (US); Youhe Zhang, Spring, TX (US); Michael G. Azar, The Woodlands, TX (US); Xiaoge Gan, Houston, TX (US); Madapusi K. Keshavan, The Woodlands, TX (US); Zhijun Lin, The Woodlands, TX (US); Bala Durairajan, Sugar Land, TX (US); Michael L. Stewart, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 167 days.

(21) Appl. No.: 14/613,144

(22) Filed: Feb. 3, 2015

(65) Prior Publication Data

US 2015/0259988 A1 Sep. 17, 2015

Related U.S. Application Data

(60) Provisional application No. 61/951,155, filed on Mar. 11, 2014.

(51) Int. Cl.

| | |
|---|---|
| ***E21B 10/56*** | (2006.01) |
| ***E21B 10/567*** | (2006.01) |
| ***E21B 10/573*** | (2006.01) |

(52) U.S. Cl.
CPC ..... *E21B 10/5673* (2013.01); *E21B 10/5735* (2013.01); *E21B 10/56* (2013.01); *E21B 2010/565* (2013.01)

(58) Field of Classification Search
CPC .. E21B 10/5673; E21B 10/5735; E21B 10/56; E21B 2010/565; E21B 2010/567; E21B 10/573; E21B 10/567
See application file for complete search history.

(56) References Cited

U.S. PATENT DOCUMENTS

| | | | |
|---|---|---|---|
| 4,104,344 | A | 8/1978 | Pope et al. |
| 4,288,248 | A | 9/1981 | Bovenkerk et al. |

(Continued)

FOREIGN PATENT DOCUMENTS

| | | | |
|---|---|---|---|
| CN | 2297177 | Y | 11/1998 |
| CN | 2732975 | Y | 10/2005 |

(Continued)

OTHER PUBLICATIONS

International Search Report and Written Opinion issued in related PCT application PCT/US2015/014561 dated May 29, 2015, 20 pages.

(Continued)

*Primary Examiner* — Robert E Fuller
*Assistant Examiner* — Christopher J Sebesta

(57) ABSTRACT

A cutting element may include a substrate, an upper surface of the substrate including a crest, the crest transitioning into a depressed region, and an ultrahard layer on the upper surface, thereby forming a non-planar interface between the ultrahard layer and the substrate. A top surface of the ultrahard layer includes a cutting crest extending along at least a portion of a diameter of the cutting element, the top (Continued)

surface having a portion extending laterally away from the cutting crest having a lesser height than a peak of the cutting crest.

22 Claims, 37 Drawing Sheets

(56) References Cited

U.S. PATENT DOCUMENTS

| | | | | |
|---|---|---|---|---|
| 4,602,691 | A | 7/1986 | Weaver | |
| 4,872,520 | A | 10/1989 | Nelson | |
| 5,127,923 | A | 7/1992 | Bunting et al. | |
| 5,549,171 | A | 8/1996 | Mensa-Wilmont et al. | |
| 5,752,573 | A | 5/1998 | Scott et al. | |
| 5,871,060 | A | 2/1999 | Jensen et al. | |
| 5,881,830 | A | 3/1999 | Cooley | |
| 6,003,623 | A * | 12/1999 | Miess | E21B 10/55 175/426 |
| 6,021,859 | A | 2/2000 | Tibbitts et al. | |
| 6,148,937 | A * | 11/2000 | Mensa-Wilmot | E21B 10/5735 175/428 |
| 6,176,333 | B1 | 1/2001 | Doster | |
| 6,241,035 | B1 | 6/2001 | Portwood | |
| 6,330,924 | B1 | 12/2001 | Hall | |
| 6,332,503 | B1 | 12/2001 | Pessier et al. | |
| 6,427,792 | B1 | 8/2002 | Roberts et al. | |
| 6,499,547 | B2 | 12/2002 | Scott et al. | |
| 6,510,910 | B2 | 1/2003 | Eyre et al. | |
| 7,234,550 | B2 | 6/2007 | Azar et al. | |
| 7,360,608 | B2 | 4/2008 | Brackin et al. | |
| 7,455,125 | B2 | 11/2008 | Sinor et al. | |
| 7,533,738 | B1 | 5/2009 | Hall et al. | |
| 7,690,442 | B2 | 4/2010 | Portwood et al. | |
| 7,690,971 | B2 | 4/2010 | Sung | |
| 7,726,420 | B2 | 6/2010 | Shen et al. | |
| 7,757,785 | B2 | 7/2010 | Zhang et al. | |
| 8,087,478 | B2 | 1/2012 | Patel | |
| 8,109,346 | B2 | 2/2012 | Mensa-Wilmont | |
| 8,127,863 | B2 | 3/2012 | Durairajan et al. | |
| 8,172,008 | B2 | 5/2012 | Dykstra et al. | |
| 8,567,532 | B2 | 10/2013 | Hall et al. | |
| 2005/0269139 | A1 * | 12/2005 | Shen | E21B 10/5735 175/430 |
| 2006/0180356 | A1 | 8/2006 | Durairajan et al. | |
| 2007/0062736 | A1 | 3/2007 | Cariveau et al. | |
| 2007/0079995 | A1 | 4/2007 | McClain et al. | |
| 2007/0215389 | A1 | 9/2007 | Da Silva et al. | |
| 2007/0278017 | A1 | 12/2007 | Shen et al. | |
| 2008/0035380 | A1 | 2/2008 | Hall et al. | |
| 2008/0035387 | A1 | 2/2008 | Hall et al. | |
| 2008/0142275 | A1 | 8/2008 | Griffin et al. | |
| 2008/0264696 | A1 | 10/2008 | Dourfaye et al. | |
| 2010/0059287 | A1 | 3/2010 | Durairajan et al. | |
| 2010/0059289 | A1 | 3/2010 | Hall et al. | |
| 2010/0065332 | A1 | 3/2010 | Hall et al. | |
| 2010/0155149 | A1 | 6/2010 | Keshavan et al. | |
| 2010/0219001 | A1 | 9/2010 | Shen | |
| 2010/0263939 | A1 | 10/2010 | Hall et al. | |
| 2011/0000714 | A1 | 1/2011 | Durairajan et al. | |
| 2011/0100724 | A1 | 5/2011 | Azar | |
| 2011/0155472 | A1 | 6/2011 | Lyons et al. | |
| 2011/0192651 | A1 | 8/2011 | Lyons et al. | |
| 2011/0266070 | A1 | 11/2011 | Scott et al. | |
| 2012/0031674 | A1 | 2/2012 | Lyons | |
| 2012/0205163 | A1 | 8/2012 | Azar et al. | |
| 2012/0234610 | A1 | 9/2012 | Azar et al. | |
| 2012/0247834 | A1 | 10/2012 | Buxbaum et al. | |
| 2013/0075166 | A1 | 3/2013 | Cox | |
| 2013/0112485 | A1 | 5/2013 | Richert et al. | |
| 2013/0292185 | A1 | 11/2013 | Knull et al. | |

FOREIGN PATENT DOCUMENTS

| | | | |
|---|---|---|---|
| CN | 1734054 | A | 2/2006 |
| CN | 2777175 | Y | 5/2006 |
| CN | 2828298 | Y | 10/2006 |
| CN | 200964797 | Y | 10/2007 |
| CN | 201024900 | Y | 2/2008 |
| CN | 201334873 | Y | 10/2009 |
| CN | 201396071 | Y | 2/2010 |
| CN | 201513124 | U | 6/2010 |
| CN | 201526273 | U | 7/2010 |
| CN | 201588550 | Y | 9/2010 |
| CN | 201771431 | U | 3/2011 |
| CN | 201943584 | U | 8/2011 |
| CN | 201276265 | U | 3/2012 |
| GB | 2328233 | A | 2/1999 |
| GB | 2428840 | | 2/2007 |
| RU | 2315850 | C1 | 1/2008 |
| WO | 2012109517 | A1 | 8/2012 |

OTHER PUBLICATIONS

Fan, et al., "Mechanism of the effect of interface structure on the abrasion performance of polycrystalline diamond compact", 2011, Advanced Materials Research, vol. 230-232, pp. 669-673.

Third Office Action issued in Chinese Patent Application No. 201480014746.6 dated May 27, 2017, 21 pages.

First Office Action issued in Chinese Patent Application No. 201480014746.6 dated May 30, 2016, 18 pages.

First Office Action issued in Chinese Patent Application No. 201480014751.7 dated Jun. 1, 2016, 19 pages.

Office Action issued in Russian Patent Application No. 2015143435 dated Sep. 9, 2016. 5 pages.

Office Action issued in Russian Patent Application No. 2015143598 dated Jun. 27, 2016, 13 pages.

Office Action issued in Russian Patent Application No. 2015143598 dated Oct. 20, 2016, 4 pages.

International Search Report and Written Opinion issued in International Patent Application No. PCT/US2014/025279 dated Jul. 21, 2014, 23 pages.

International Search Report and Written Opinion issued in International Patent Application No. PCT/US2014/025294 dated Aug. 14, 2014, 22 pages.

International Preliminary Report on Patentability issued in International Patent Application No. PCT/US2014/025279 dated Sep. 24, 2015, 15 pages.

International Preliminary Report on Patentability issued in International Patent Application No. PCT/US2014/025294 dated Sep. 24, 2015, 14 pages.

International Preliminary Report on Patentability issued in International Patent Application No. PCT/US2015/014561 dated Sep. 22, 2016, 13 pages.

"PDC inserts", Hunan Feiray Composite Material Co., Ltd., retrieved from http://perfect-pdc.en.made-in-china.com/product/woRQOXnJHIVr/China-PDC-Inserts.html, accessed Jun. 2, 2014, 3 pages.

Crowe, et al., "A new effective method of maintaining 'hole gauge' using synthetic diamond enhanced inserts on downhole drilling tools", Society of Petroleum Engineers, SPE/IADC Middle East Drilling Technology Conference, Abu Dhabi, United Arab Emirates, Nov. 8-10, 1999, 11 pages.

Keshavan, et al., "Diamond-Enhanced Insert: New Compositions and Shapes for Drilling Soft-to-Hard Formations", SPE 25737—SPE/IADC Drilling Conference, Amsterdam, Netherlands, Feb. 22-25, 1993, 15 pages.

Mensa-Wilmot, et al., "Innovative cutting structure, with staged rop and durability characteristics, extends PDC bit efficiency into chert/pyrite/conglomerate applications", SPE 105320-MS—SPE Middle East Oil and Gas Show and Conference, Kingdom of Bahrain, Mar. 11-14, 2007, 9 pages.

Wise, et al., "Geometry and material choices govern hard-rock drilling performance of PDC drag cutters", Alaska Rocks, The 40th U S. Symposium on Rock Mechanics (USRMS), Anchorage, AK, Jun. 25-29, 2005.

(56) References Cited

OTHER PUBLICATIONS

Second Office Action issued in Chinese Application No. 201480014746.6 dated Jan. 16, 2017, 19 pages.
"PDC cutter/Sharp-edge PDC cutters/Synthetic polycrystalline diamond", retrieved from http://3bdiamond.en.alibaba.com/product/694306890-215141609/PDC_cutter_Sharp_edge_PDC_cutters_Synthetic_polycrystalline_diamond.html, accessed Jun. 26, 2014, 4 pages.
Decision on Grant issued in Russian Patent Application No. 2015143435 dated Apr. 21, 2017.
Decision on Grant issued in Russian Patent Application No. 2015143598 dated Apr. 21, 2017.
Office Action issued in U.S. Appl. No. 14/206,280 dated Mar. 7, 2017.
Office Action issued in U.S. Appl. No. 14/206,228 dated Mar. 7, 2017.
Office Action issued in U.S. Appl. No. 14/206,280 dated Aug. 3, 2017, 17 pages.
Office Action issued in U.S. Appl. No. 14/206,228 dated Aug. 4, 2017, 20 pages.
Decision of Rejection issued in Chinese Patent Application No. 201480014751.7 dated Aug. 31, 2017, 17 pages.
First Office Action and Search Report issued in Chinese Patent Application No. 201580024812.2 dated Feb. 1, 2018, 15 pages.
Second Office Action and Search Report issued in Chinese Patent Application 201580024812.2 dated Aug. 22, 2018, 16 pages.
Third Office Action issued in Chines Patent Application 201580024812.2 dated Mar. 5, 2019, 16 pages.

* cited by examiner

CUTTING ELEMENTS HAVING NON-PLANAR SURFACES AND DOWNHOLE CUTTING TOOLS USING SUCH CUTTING ELEMENTS

CROSS-REFERENCE TO RELATED APPLICATION(S)

This application claims priority to U.S. Patent Application No. 61/951,155, filed on Mar. 11, 2014, which is herein incorporated by reference.

BACKGROUND

There are several types of downhole cutting tools, such as drill bits, including roller cone bits, hammer bits, and drag bits, reamers and milling tools. Roller cone rock bits include a bit body adapted to be coupled to a rotatable drill string and include at least one "cone" that is rotatably mounted to a cantilevered shaft or journal. Each roller cone supports a plurality of cutting elements that cut and/or crush the wall or floor of the borehole and thus advance the bit. The cutting elements, either inserts or milled teeth, contact with the formation during drilling. Hammer bits generally include a one piece body having a crown. The crown includes inserts pressed therein for being cyclically "hammered" and rotated against the earth formation being drilled.

Drag bits, often referred to as fixed cutter drill bits, include bits that have cutting elements attached to the bit body, which may be a steel bit body or a matrix bit body formed from a matrix material such as tungsten carbide surrounded by a binder material. Drag bits may generally be defined as bits that have no moving parts. Drag bits having abrasive material, such as diamond, impregnated into the surface of the material which forms the bit body are commonly referred to as "impreg" bits. Drag bits having cutting elements made of an ultra hard cutting surface layer or "table" (generally made of polycrystalline diamond material or polycrystalline boron nitride material) deposited onto or otherwise bonded to a substrate are known in the art as polycrystalline diamond compact ("PDC") bits.

An example of a drag bit having a plurality of cutting elements with ultra hard working surfaces is shown in FIG. 1. The drill bit 100 includes a bit body 110 having a threaded upper pin end 111 and a cutting end 115. The cutting end 115 generally includes a plurality of ribs or blades 120 arranged about the rotational axis (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

FIG. 2 shows an example of a cutting element 150, where the cutting element 150 has a cylindrical cemented carbide substrate 152 having an end face or upper surface ("substrate interface surface") 154. An ultrahard material layer 156, also referred to as a cutting layer, has a top surface 157, also referred to as a working surface, a cutting edge 158 formed around the top surface, and a bottom surface, referred to as an ultrahard material layer interface surface 159. The ultrahard material layer 156 may be a polycrystalline diamond or polycrystalline cubic boron nitride layer. The ultrahard material layer interface surface 159 is bonded to the substrate interface surface 154 to form a planar interface between the substrate 152 and ultrahard material layer 156.

SUMMARY

Embodiments of the present disclosure are directed to a cutting element that includes a substrate, an upper surface of the substrate including a crest, the crest transitioning into a depressed region, and an ultrahard layer on the upper surface, thereby forming a non-planar interface between the ultrahard layer and the substrate. A top surface of the ultrahard layer includes a cutting crest extending along at least a portion of a diameter of the cutting element, the top surface having a portion extending laterally away from the cutting crest having a lesser height than a peak of the cutting crest.

In another aspect, embodiments of the present disclosure relate to a cutting element including a substrate having a non-planar upper surface, the non-planar upper surface having a first convex curvature extending along a first direction and a second convex curvature having a smaller radius of curvature than the first convex curvature extending in a second direction perpendicular to the first direction. The cutting element also includes an ultrahard layer with a non-planar top surface on the non-planar upper surface of the substrate.

In yet another aspect, embodiments of the present disclosure relate to a cutting tool that includes a tool body, at least one blade extending from the tool body, a first row of cutting elements attached to the at least one blade, the first row of cutting elements having at least one first cutting element. The first cutting element includes a substrate, an upper surface of the substrate including a crest, the crest transitioning into a depressed region, and an ultrahard layer on the upper surface, thereby forming a non-planar interface between the ultrahard layer and the substrate. A top surface of the ultrahard layer includes a cutting crest extending along at least a portion of a diameter of the cutting element, the top surface having a portion extending laterally away from the cutting crest having a lesser height than a peak of the cutting crest.

In another aspect, embodiments of the present disclosure relate to a cutting tool that includes a tool body, at least one blade extending from the tool body, and at least one cutting element attached to the at least one blade. The at least one cutting element includes a substrate having a non-planar upper surface, the non-planar upper surface having a first convex curvature extending along a first direction and a second convex curvature having a smaller radius of curvature than the first convex curvature extending in a second direction perpendicular to the first direction. The cutting element also includes an ultrahard layer with a non-planar top surface on the non-planar upper surface of the substrate.

In yet another aspect, embodiments of the present disclosure relate to a cutting tool that includes a tool body, at least one blade extending from the tool body, and at least one cutting element attached to the at least one blade. The at least one cutting element has a non-planar top surface that includes a cutting crest extending along at least a portion of a diameter of the cutting element, the non-planar top surface having a portion extending laterally away from the cutting crest having a lesser height than a peak of the cutting crest. A central axis of the at least one cutting element is oriented at an angle ranging from 0 to 25 degrees relative to a line parallel to a central axis of the cutting tool.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

In one aspect, embodiments disclosed herein relate to cutting elements for a downhole tool having an ultrahard layer on a substrate at a non-planar interface. The cutting element may include a non-planar top surface, also referred to as a working surface, formed on the ultrahard layer and a non-planar interface surface.

Cutting elements of the present disclosure may include rotatable cutting elements, i.e., cutting elements that are rotatable around their longitudinal axis, or fixed cutting elements, i.e., cutting elements that are not rotatable, but instead are attached or otherwise fixed into a position on a cutting tool. Cutting elements of the present disclosure may be mounted to various types of downhole cutting tools, including but not limited to, drill bits, such as drag bits, reamers, and other downhole milling tools.

According to some embodiments of the present disclosure, a cutting element may have a non-planar interface formed between a substrate and an ultrahard layer, where the top surface of the ultrahard layer is non-planar. Cutting elements having a non-planar top or working surface may include, for example, a substantially hyperbolic paraboloid (saddle) shape or a parabolic cylinder shape, where the crest or apex of the cutting element extends across substantially the entire diameter of the cutting element. Further, interface surfaces may also include generally hyperbolic paraboloid shapes as well as generally parabolic cylinder shapes. However, as disclosed herein, other geometric shapes are also envisioned for both the working surface and/or interface surface.

Figure 1:
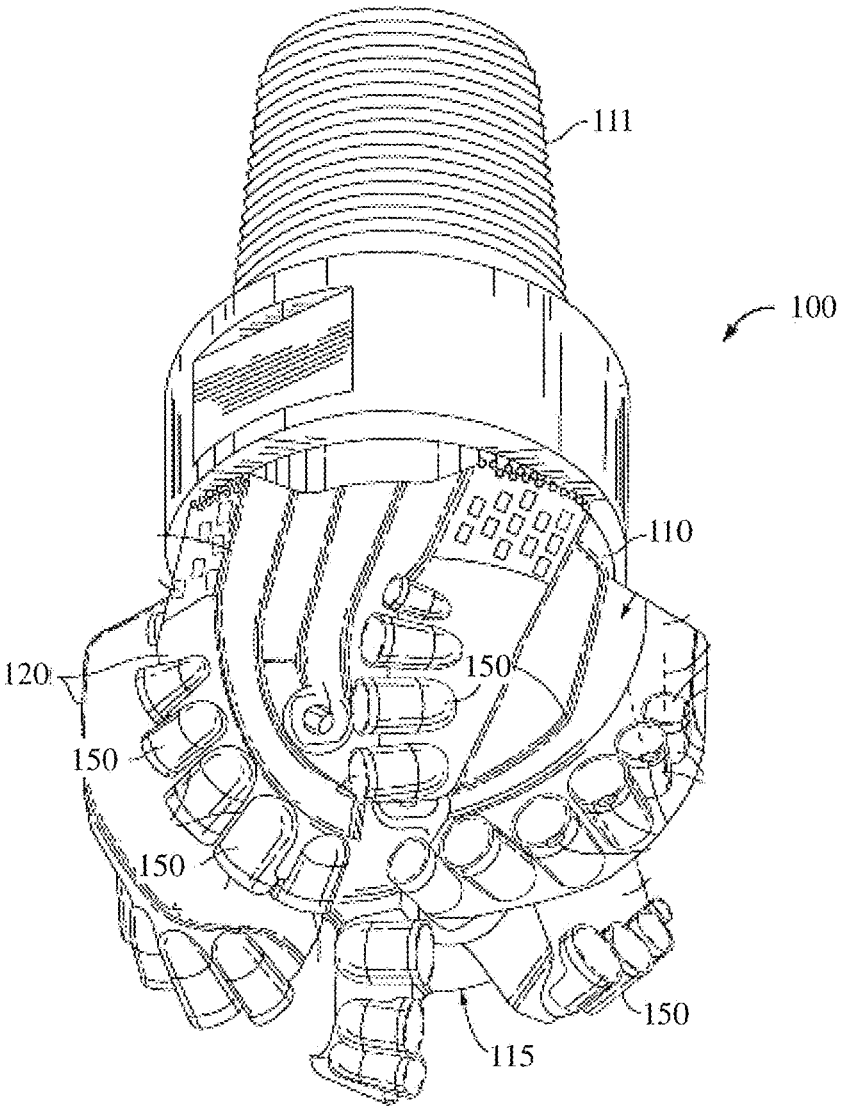
FIG. 1 shows a conventional drag bit.
Figure 2:
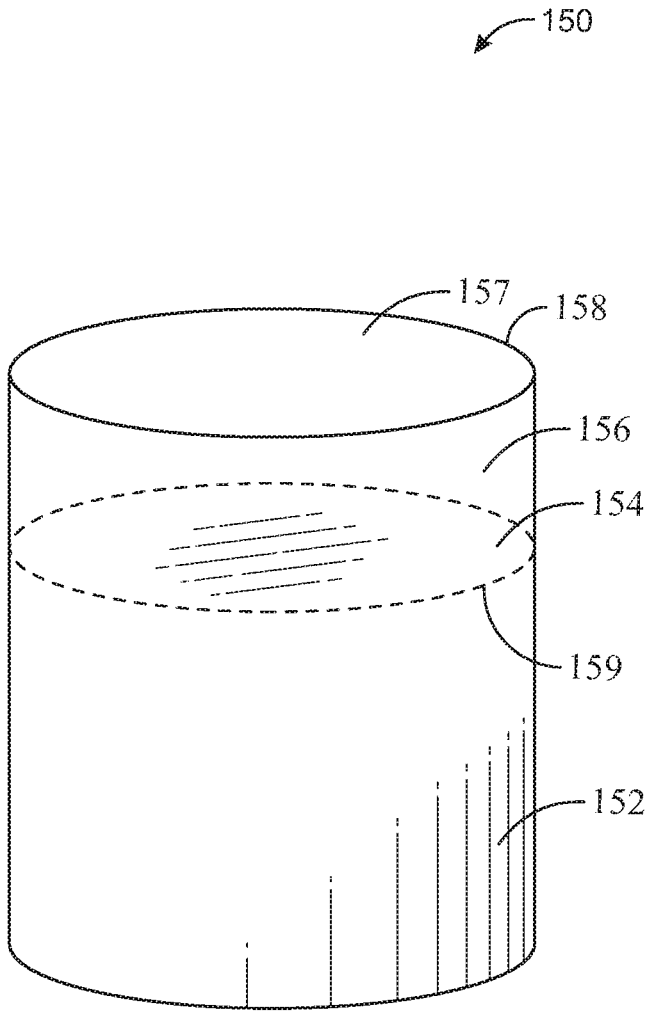
FIG. 2 shows a conventional cutting element.
Figure 3:
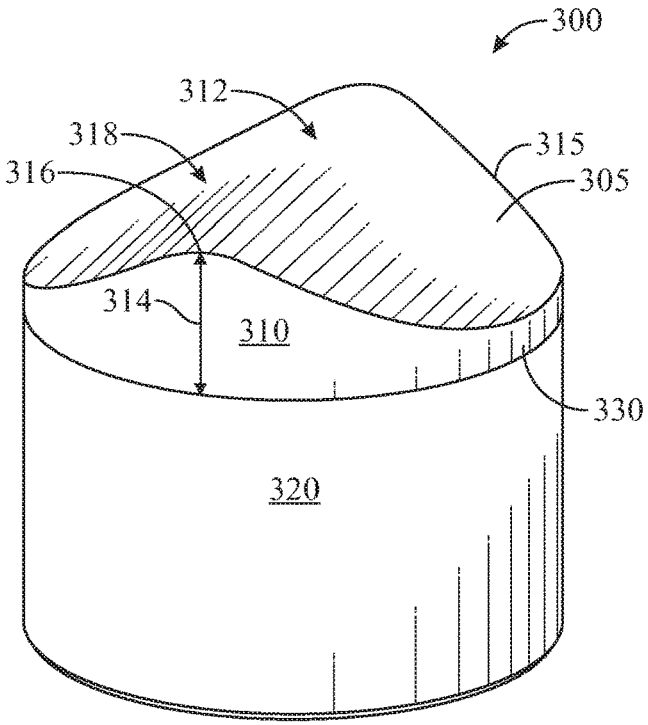
FIGS. 3-5 show a cutting element having a non-planar top surface.

For example, a cutting element 300 having a non-planar top surface 305 is shown in FIG. 3. Particularly, the cutting element 300 has an ultrahard layer 310 disposed on a substrate 320 at an interface 330, where the non-planar top surface 305 geometry is formed on the ultrahard layer 310. The ultrahard layer 310 has a peripheral edge 315 surrounding (and defining the bounds of) the top surface 305. The top surface 305 has a cutting crest 312 extending a height 314 above the substrate 320 (at the cutting element circumference), and at least one recessed region extending laterally away from crest 312. As used herein, the crest refers to a portion of the non-planar cutting element that includes the peak(s) or greatest height(s) of the cutting element, which extends in a generally linear fashion or along a diameter of the cutting element. The presence of the crest 312 results in an undulating peripheral edge 315 having peaks and valleys. The portion of the peripheral edge 315 which is proximate the crest 312 forms a cutting edge portion 316. As shown, the cutting crest 312 may also extend across the diameter of the ultrahard layer, such that two cutting edge portions 316 are formed at opposite sides of the ultrahard layer. The top surface 305 further includes at least one recessed region 318 (two as illustrated) continuously decreasing in height in a direction away from the cutting crest 312 to another portion of the peripheral edge 315 that is the valley of the undulating peripheral edge 315. The cutting crest 312 and recessed regions 318 in the embodiment shown forms a top surface 305 having a parabolic cylinder shape, where the cutting crest 312 is shaped like a parabola that extends across the diameter of the ultrahard layer 310 and/or substrate 320. While not illustrated, at least a portion of the peripheral edge (for example, the cutting edge portion and extending around the portion of the edge that will come into contact with the formation for an expected depth of cut) may be beveled or chamfered. In one or more embodiments, the entire peripheral edge may be beveled, which may include a variable (in angle and/or width) chamfer or bevel around the circumference of the cutting element. In one or more embodiments, a cutting element may also have a radiused edge.

Figure 4:
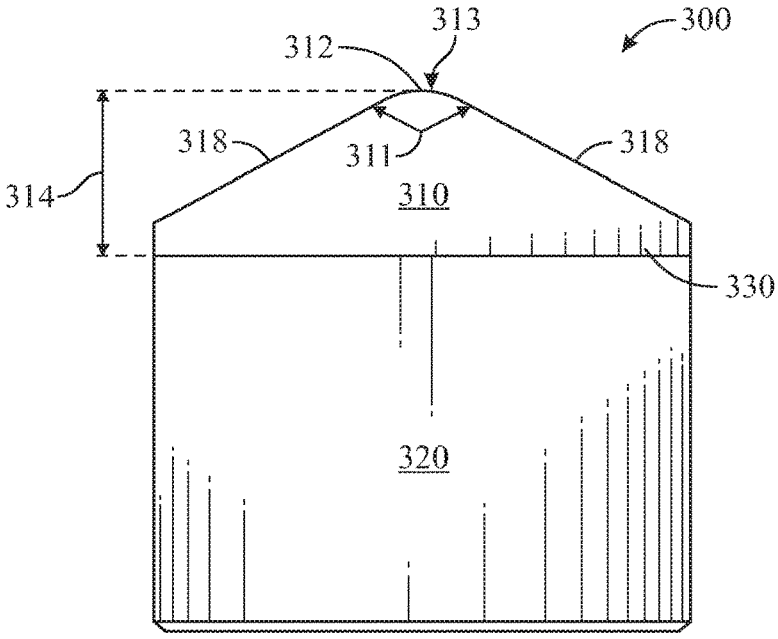

In one or more other embodiments, the cutting crest 312 may extend less than the diameter of the substrate 320 or even greater than the diameter of the substrate 320. For example, the ultrahard layer 310 may form a tapered sidewall at least proximate the cutting edge portion, for example, forming an angle with a line parallel to the axis of the cutting element that may range from −5 degrees (forming a larger diameter (e.g., major dimension) than the substrate 320) to 20 degrees (forming a smaller diameter (e.g., major dimension) than the substrate 320). Depending on the size of the cutting element, the height 314 of the cutting crest 312 may range, for example, from about 0.1 inch (2.54 mm) to 0.3 inch (7.62 mm). Further, unless otherwise specified, heights of the ultrahard layer (or cutting crests) are relative to the lowest point of the interface of the ultrahard layer and substrate. FIG. 4 shows a side view of the cutting element 300. As shown, the cutting crest 312 has a convex cross-sectional shape (viewed along a plane orthogonal (i.e., perpendicular) to cutting crest length (e.g., major dimension) across the diameter of the ultrahard layer), where the uppermost point of the crest has a radius of curvature 313 that tangentially transitions into the laterally extending portion of the top surface 305 at an angle 311. According to embodiments of the present disclosure, a cutting element top surface may have a cutting crest with a radius of curvature ranging from 0.02 inches (0.5 mm) to 0.30 inches (7.6 mm), or in another embodiment, from 0.06 inches (1.5 mm) to 0.18 inches (4.6 mm). Further, while the illustrated embodiment shows a cutting crest 312 having a curvature at its upper peak, it is also within the scope of the present disclosure that the cutting crest 312 may have a plateau or substantially planar face along at least a portion of the diameter, axially above the recessed regions 318 laterally spaced from the cutting crest 312. Thus, in such an embodiment, the cutting crest may have a substantially infinite radius of curvature. In such embodiments, the plateau may have a radiused transition into the sidewalls that extend to form recessed regions 318. Further, in some embodiments, along a cross-section of the cutting crest 312 extending laterally into recessed regions 318, cutting crest 312 may have an angle 311 formed between the sidewalls extending to recessed regions 318 that may range from 110 degrees to 160 degrees. Further, depending on the type of upper surface geometry, other crest angles, including down to 90 degrees may also be used.

Figure 5:
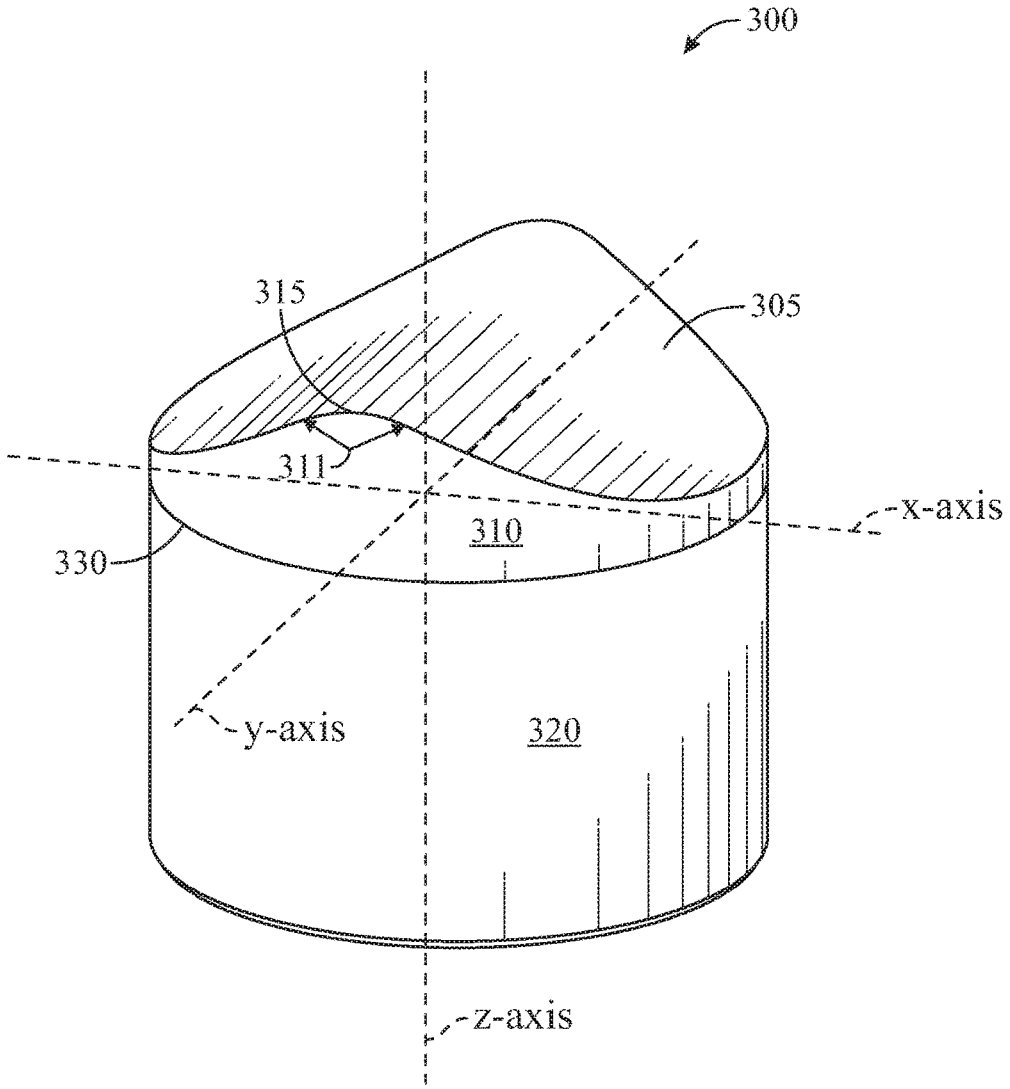
Figure 6:
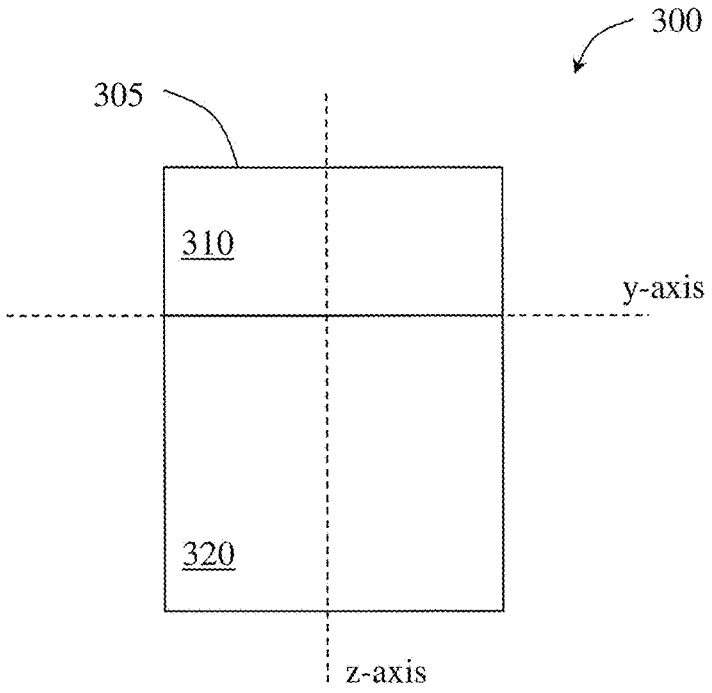
FIGS. 6 and 7 show cross-sectional views of a cutting element according to embodiments of the present disclosure.
Figure 7:
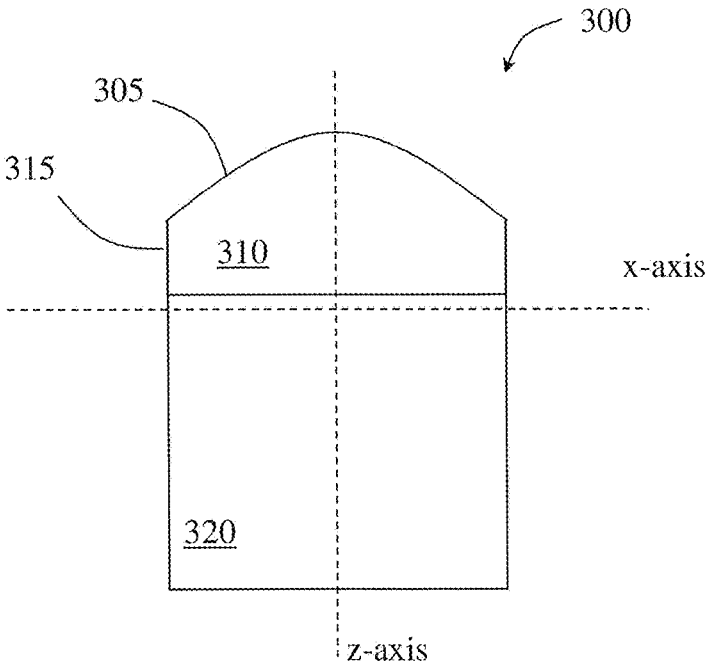

The geometry of a cutting element top surface may also be described with respect to an x-y-z coordinate system. For example, the cutting element shown in FIG. 3 is reproduced in FIG. 5 along an x-y-z coordinate system. The cutting element 300 has an ultrahard layer 310 disposed on a substrate 320 at an interface 330, and a longitudinal axis coinciding with the z-axis extending there through. The non-planar top surface 305 formed on the ultrahard layer 310 has a geometry formed by varying heights (where the height is measured along the z-axis) along the x-axis and y-axis. As shown, the greatest height (apex or peak) formed in the top surface (which may also be referred to as the cutting crest 312 in FIG. 3) extends across the diameter of the cutting element along the y-axis, such that the crest height extends from a first portion of the peripheral edge 315 to a second portion of the peripheral edge 315 opposite from the first portion. From the sake of convenience, the y-axis is defined based on the extension of the cutting element crest; however, one skilled in the art would appreciate that if defined differently, the remaining description based on the x-, y-, z-coordinate system would similarly vary. A cross-sectional view of the cutting element 300 along the intersection of the y-axis and z-axis is shown in FIG. 6. The y-z cross-sectional view of the cutting element may be referred to as the crest profile view as the uniformity, extension, etc., of the crest may be observed from such a cross-sectional view. As shown in the crest-profile view in FIG. 6, the top surface 305 along the crest height (i.e., crest profile) is substantially linear. A cross-sectional view of the cutting element 300 along the intersection of the x-axis and the z-axis is shown in FIG. 7, and may be referred to as the crest geometry view, as the curvature, etc., of the crest may be observed from such a cross-sectional view. As shown in the crest geometry view in FIG. 7, the top surface 305 peaks at the z axis (at the crest height), and continuously decreases from the crest height, moving along the x-axis in either direction towards the peripheral edge 315 of the cutting element (which may also be referred to as the recessed regions 318 in FIG. 3), such that the top surface 305 has a generally parabolic shape along the cross-section. Depending on the curvature of the cross-section illustrated in FIG. 7, the cross-section may also be described as the cross-section of a cone with a rounded apex, i.e., two angled sidewalls tangentially transitioning into the rounded apex (having the radius of curvature ranges described above). However, sidewalls with curvature, either concave or convex, may also be used. In this illustrated embodiment, the generally parabolic shape in the x-z cross-sectional view (or crest geometry view) extends along the y-axis, such that the three dimensional shape of the non-planar top surface 305 has parabolic cylinder shape.

Further, while some embodiments may have a uniform angle 311, radius of curvature for the cutting crest 312, or height 314 along the length (e.g., major dimension) of cutting crest 312, the present disclosure is not so limited. Rather, in one or more embodiments, the angle 311 may vary along the length of cutting crest 312. For example, angle 311 may increase from the cutting edge portion 316 extending along the y-axis towards the central or z-axis of the cutting element 300 and then decrease extending away from the central or z-axis towards the cutting edge portion 316 on the opposite side of the cutting element 300. Such difference in the angle may be up to 20 percent of the angle at the cutting edge 316 or up to 10 percent in some embodiments. In other embodiments, the angle 311 may increase extending away from the cutting edge portion 316 without decreasing (such as by reaching a peak angle extending at that peak angle for a length (e.g. major dimension) of cutting crest 312 or by continuously increasing along the length (e.g. major dimension) of cutting crest 312). Another variation on the angle 311 may include an angle 311 that is not symmetrical with respect to the y-z plane. That is, while the embodiment illustrated in FIGS. 3-7 shows an angle 311 that is bisected by the y-z plane, the present disclosure is not so limited. Rather, the angle 311 may be skewed with respect to the y-z plane so that on one side of the cutting crest 312, the top surface 305 extends laterally away from the cutting crest 312 to a first recessed region 318 at a more severe slope than on the other side of the cutting crest 312. It is also intended that this asymmetric angle 311 may vary along the length (e.g. major dimension) of the cutting crest 312.

In one or more embodiments, the radius of curvature of cutting crest 312 may increase from the cutting edge portion 316 extending along the length of cutting crest 312. For example, the radius of curvature may increase from the cutting edge portion 316 extending along the y-axis towards the central axis of the cutting element 300 and then decrease extending away from the central axis towards the cutting edge portion 316 on the opposite side of the cutting element 300. In other embodiments, the radius of curvature may increase extending away from the cutting edge portion 316 without decreasing (such as by reaching a peak radius of curvature and extending at that peak radius of curvature for a length of cutting crest 312 or by continuously increasing along the length of cutting crest 312).

Further, in one or more embodiments, the height 314 may vary along the length of cutting crest 312. For example, the height 314 may decrease (or increase) from the cutting edge portion 316 extending along the y-axis towards the central axis of the cutting element 300 and then decrease (or increase) extending away from the central axis towards the cutting edge portion 316 on the opposite side of the cutting element 300. In other embodiments, the height may decrease extending away from the cutting edge portion 316 without increasing (such as by reaching a minimum height and extending at that minimum height for a length of cutting crest 312 or by continuously decreasing along the length of cutting crest 312). In one or more embodiments, the lower height may have a differential of the greater height of less than about 50% of the greater height, or less than 40, 30, 20, or 10% in embodiments.

As mentioned above, top surface 305 may have an asymmetric angle 311; however, other variations on the top surface 305 that result in asymmetry about either and/or both of the x-z plane and y-z plane may exist. For example, the cutting crest 312 itself may lie on a plane that does not bisect the cutting element, i.e., the cutting crest 312 may be laterally offset from a central plane.

According to embodiments of the present disclosure, a cutting element may include a substrate, an ultrahard layer, and a non-planar interface formed between the substrate and the ultrahard layer. The substrate may have an upper surface with a geometry defined by an x-y-z-coordinate system, where the height of the substrate, measured along a z-axis, varies along the x-axis and optionally the y-axis. A top surface of the ultrahard layer may also have a geometry defined by the x-y-z-coordinate system, where the height of the ultrahard layer varies along the x-axis and optionally the y-axis.

Figure 8:
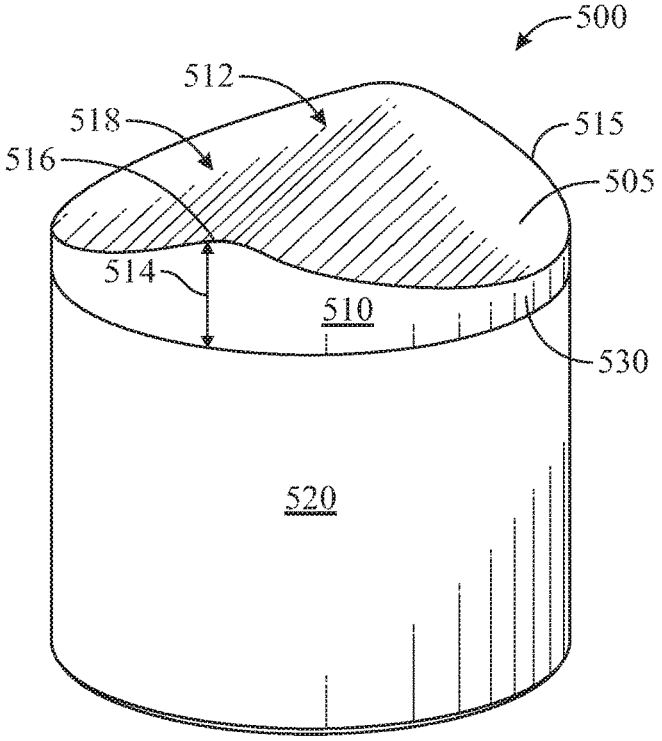
FIGS. 8 and 9 show a cutting element having a non-planar top surface.
Figure 9:
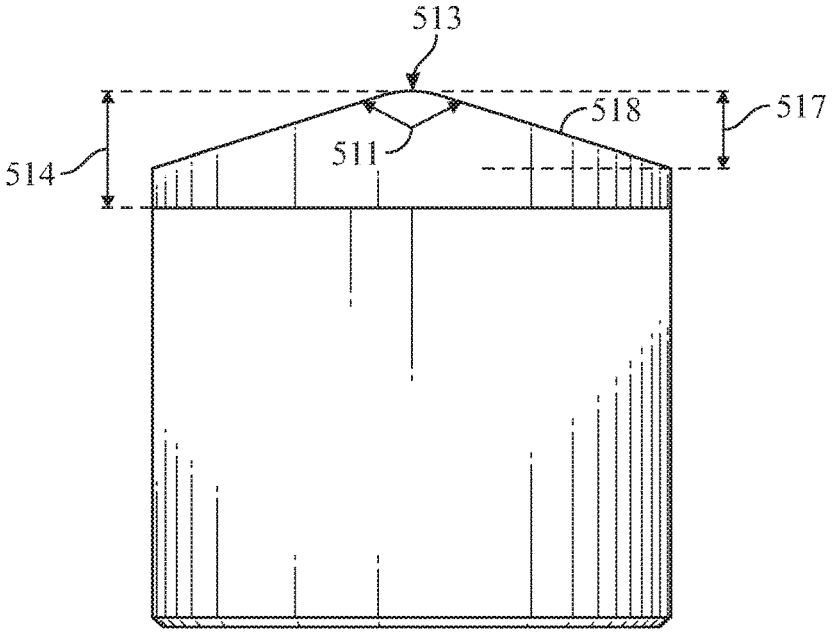

FIGS. 8 and 9 show another example of a cutting element 500 having a non-planar top surface 505. The cutting element 500 has an ultrahard layer 510 disposed on a substrate 520 at an interface 530, where the non-planar top surface 505 is formed on the ultrahard layer 510. The ultrahard layer 510 has a peripheral edge 515 surrounding the top surface 505. The top surface 505 has a cutting crest 512 extending a height 514 above the substrate 520, and at least one recessed region 518 extending laterally from crest 512. The crest 512, proximate a portion of the peripheral edge 515, forms a first cutting edge portion 516. The peripheral edge 515 may be undulating from a peak at the cutting edge portion 516, and a valley proximate at least one recessed region 518, which continuously decreases in height in a direction away from the crest 512. As shown, the recessed regions 518 extends a height above the substrate/ultrahard layer interface (along the circumference), but may have a height differential 517 (from the cutting edge portion 516), which is also equal to the total variation in height of the top surface 505. According to some embodiments, a non-planar top surface of a cutting element may have a height differential 517 ranging between 0.04 in (1.02 mm) and 0.2 in (5.08 mm) depending on the overall size of the cutting element. For example, the height differential 517 relative to the cutting element diameter may range from 0.1 to 0.5, or from 0.15 to 0.4 in other embodiments. Additionally, in one or more embodiments, the height of the diamond at the peripheral edge adjacent recessed region 518 (i.e., at the side of the cutting element having the lowest diamond height) may be at least 0.04 inches (1.02 mm).

Figure 10:
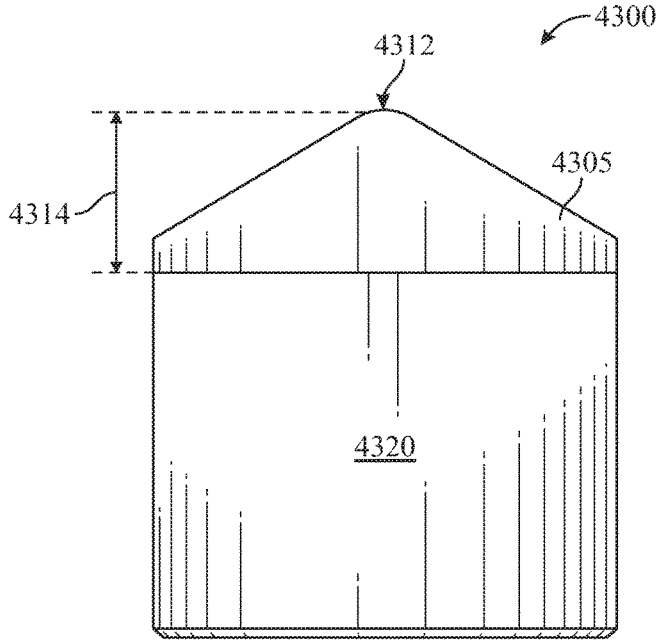
FIG. 10 shows a cutting element having a non-planar top surface.
Figure 11:
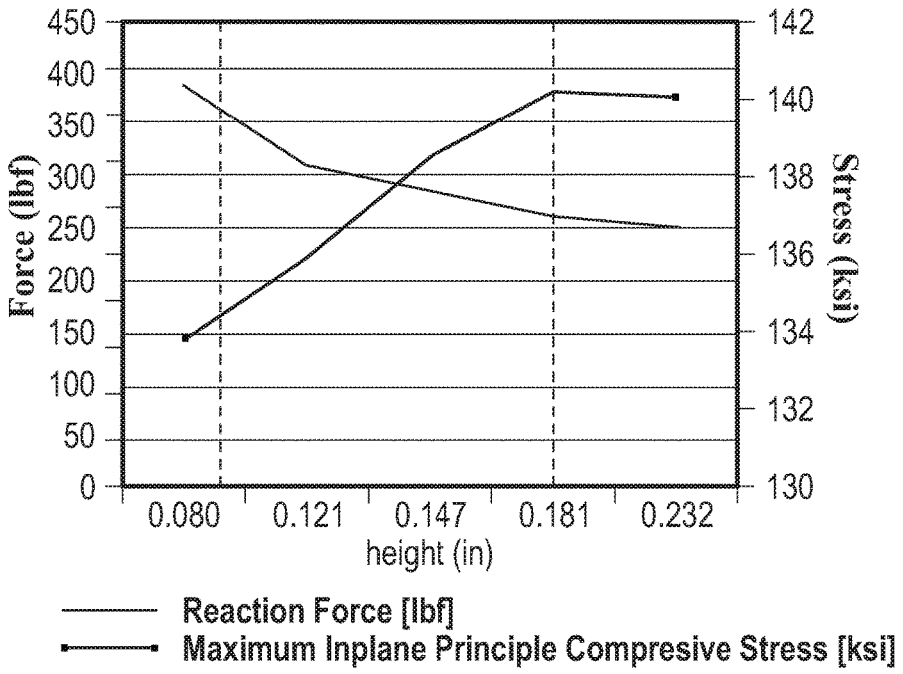
FIG. 11 shows a graph of simulation results for cutting elements having non-planar top surfaces.

Embodiments having a top surface with a parabolic cylinder shape may have a cutting crest extending a height from the substrate (at the circumference axially below the crest) ranging between 0.08 in (2.03 mm) and 0.2 in (5.08 mm). For example, FIG. 11 shows FEA simulation results of the reaction force and maximum in-plane principle compressive stress for cutting elements 4300 (of FIG. 10) having a parabolic cylinder top surface 4305 with a cutting crest 4312 extending a height 4314 from the substrate 4320 and a cutting element diameter of 16 mm. As shown, the performance of the cutting elements having the cutting crest extend a height ranging from 0.09 in (2.29 mm) to 0.18 in (4.57 mm) is improved.

Figure 12:
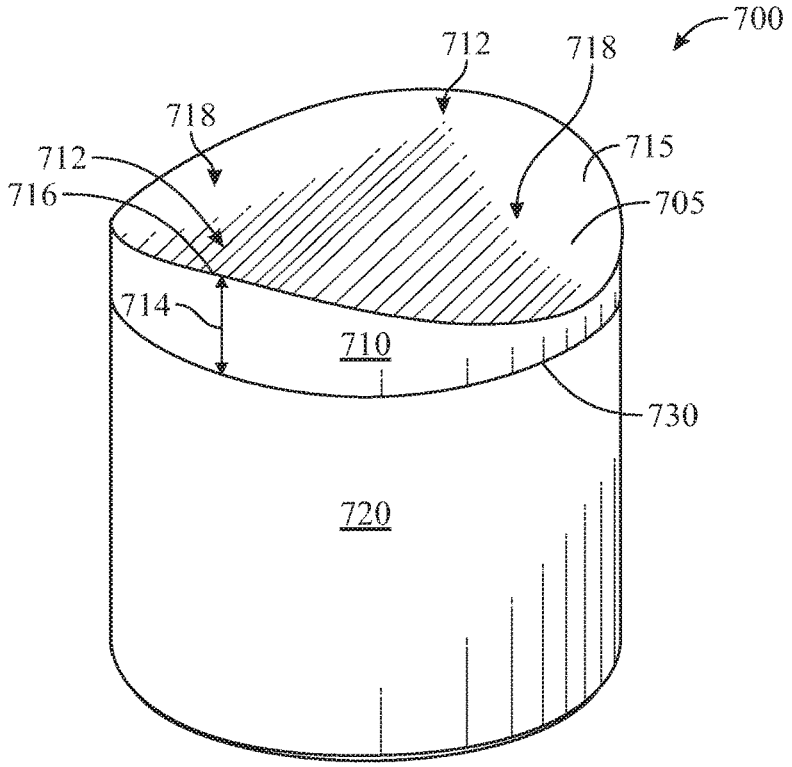
FIGS. 12-14 show a cutting element having a non-planar top surface.
Figure 13:
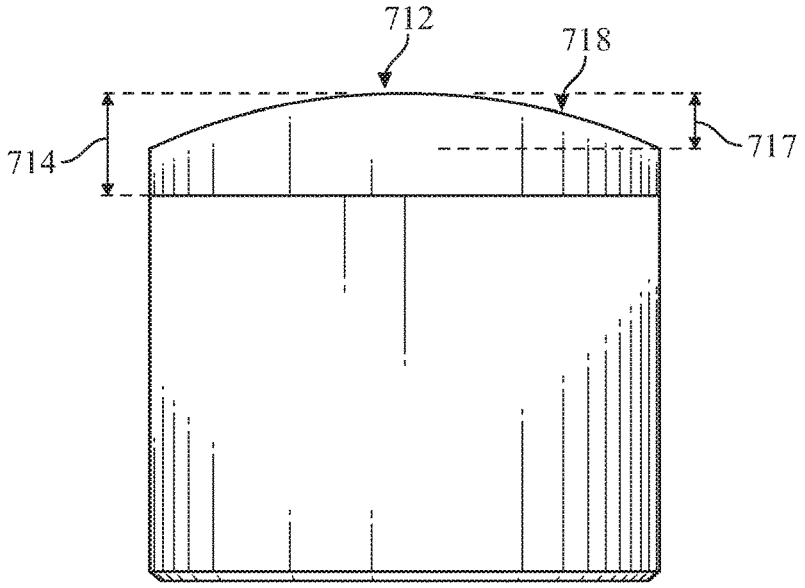

FIGS. 12 and 13 show another example of a cutting element 700 having a non-planar top surface 705. The cutting element 700 has an ultrahard layer 710 disposed on a substrate 720 at an interface 730, where the non-planar top surface 705 is formed on the ultrahard layer 710. The ultrahard layer 710 has a peripheral edge 715 surrounding the top surface 705. The top surface 705 has a non-uniform cutting crest 712. That is, the crest 712 has a non-linear profile (in the y-z plane or crest profile view) such that the crest 712 extends a variable height 714 along its length above the substrate 720/ultrahard layer 710 interface (at the circumference of the cutting element 700). Cutting crest 712 intersects a portion of the peripheral edge 715 to form a cutting edge portion 716. At least one recessed region 718 continuously decreases in height in a direction away from the cutting edge portion 716 to another portion of the peripheral edge 715. Further, as mentioned crest 712 has a variable height that is at its greatest at the intersection with peripheral edge 715 and at its lowest proximate a central or z-axis of the cutting element (i.e., top surface 705 has a reduced height between the two cutting edge portions, thereby forming a substantially saddle shape or hyperbolic paraboloid). As shown, the total height differential of the top surface (between crest and recessed region) is equal to a depth 717. According to some embodiments, a saddle shaped top surface of a cutting element may have a height differential 717 ranging between 0.04 in (1.02 mm) and 0.2 in (5.08 mm) depending on the overall size of the cutting element. For example, the height differential 717 relative to the cutting element diameter may range from 0.1 to 0.5, or from 0.15 to 0.4 in other embodiments. Additionally, in one or more embodiments, the height of the diamond at the peripheral edge adjacent recessed region 718 (i.e., at the side of the cutting element having the lowest diamond height) may be at least 0.04 inches (1.02 mm).

Figure 14:
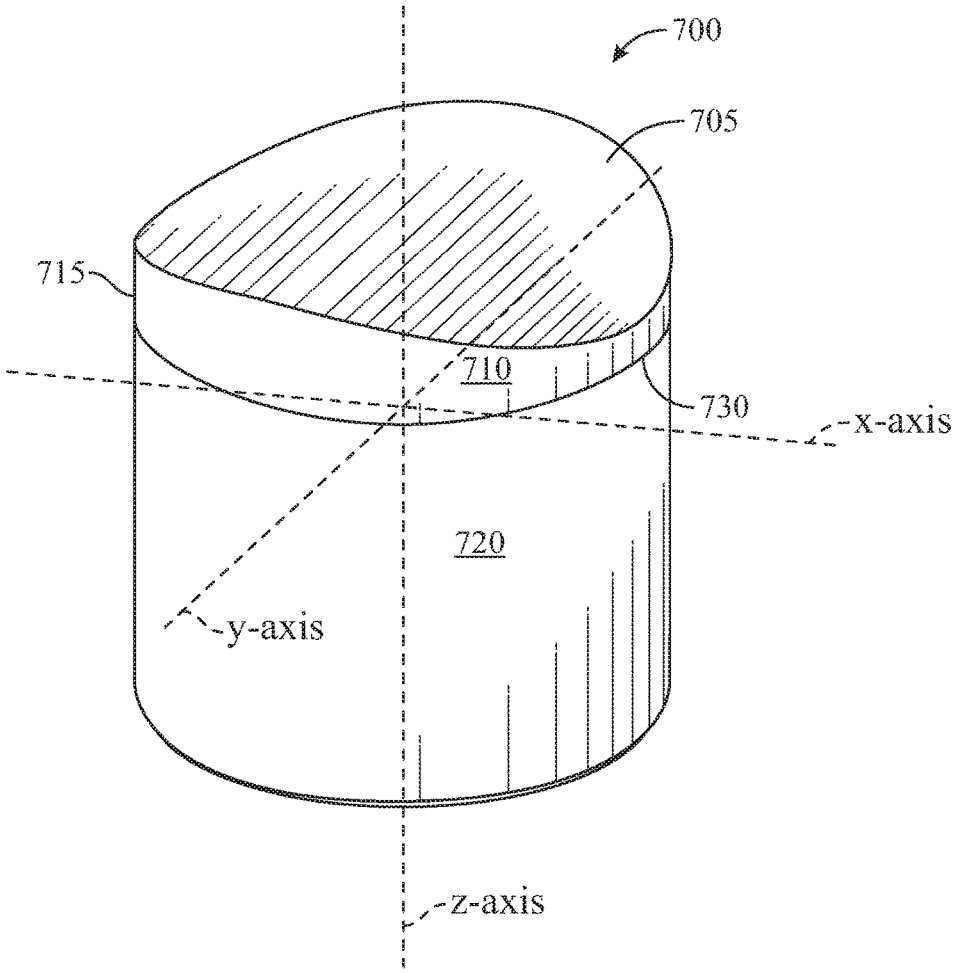
Figure 15:
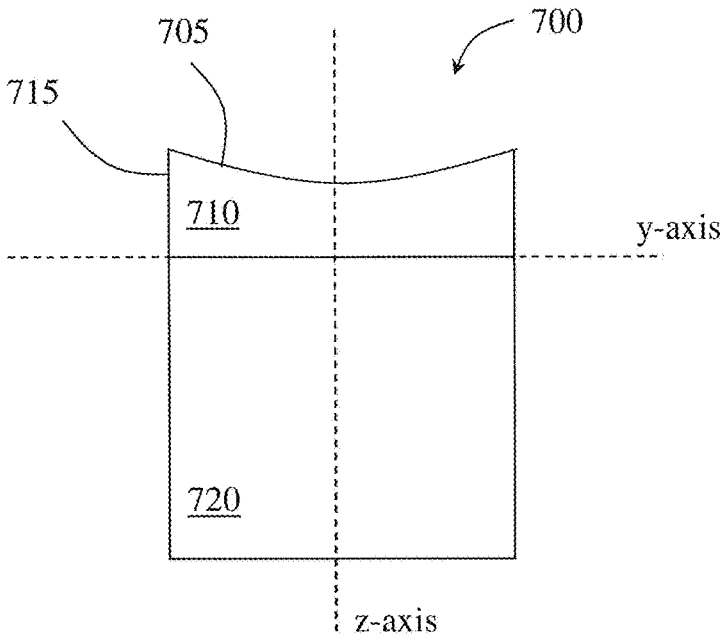
FIGS. 15 and 16 show cross-sectional views of a cutting element according to embodiments of the present disclosure.
Figure 16:
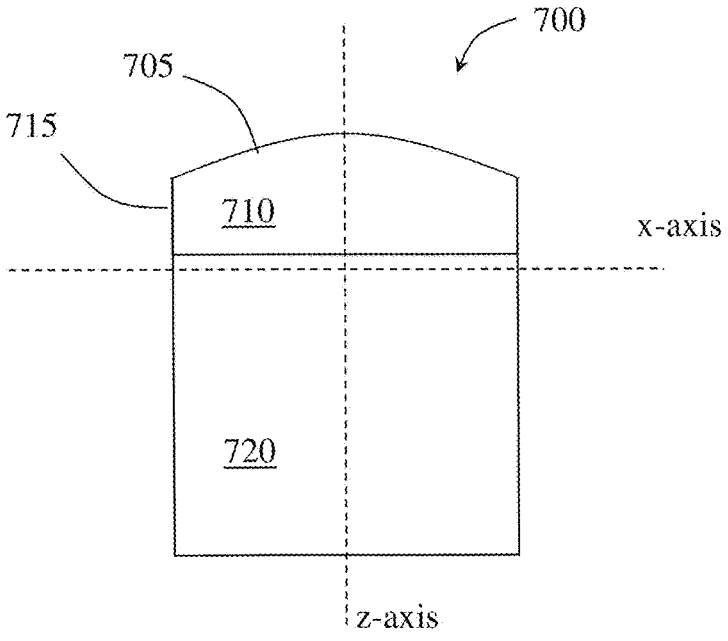

The geometry of the cutting element top surface shown in FIGS. 12 and 13 may also be described with respect to an x-y-z coordinate system. For example, the cutting element shown in FIG. 12 is reproduced in FIG. 14 along an x-y-z coordinate system. The cutting element 700 has an ultrahard layer 710 disposed on a substrate 720 at an interface 730, and a longitudinal axis coinciding with the z-axis extending there through. The non-planar top surface 705 formed on the ultrahard layer 710 has a geometry formed by varying heights (where the height is measured along the z-axis from a common base plane) along the x-axis and y-axis. As shown, the peak heights formed in the top surface (which may also be referred to as cutting crest 712 in FIG. 7) are formed along the y-axis at the peripheral edge 715 of the cutting element 700. A cross-sectional view of the cutting element 700 along the intersection of the y-axis and z-axis is shown in FIG. 15, and may be referred to as a crest profile view. The crest profile view shows a non-uniform (non-linear) crest having a variable height along the y-axis. Specifically, as illustrate the height of the top surface geometry gradually decreases from the peak heights proximate the peripheral edge 715 (on either side of the cutting element) towards the z-axis to form a concave cross-sectional shape of the top surface 705 along the y-z plane. A cross-sectional view of the cutting element 700 along the intersection of the x-axis and the z-axis is shown in FIG. 16, and shows the general geometric profile of the crest. As illustrated, the height of the top surface gradually increases from the peripheral edge (which may also be referred to as the recessed regions 718 in FIG. 12) towards the z-axis to form a convex cross-sectional shape of the top surface 705 along the x-z plane. The three dimensional shape of the top surface 705 formed by the varying heights has a saddle or hyperbolic paraboloid shape.

Figure 17:
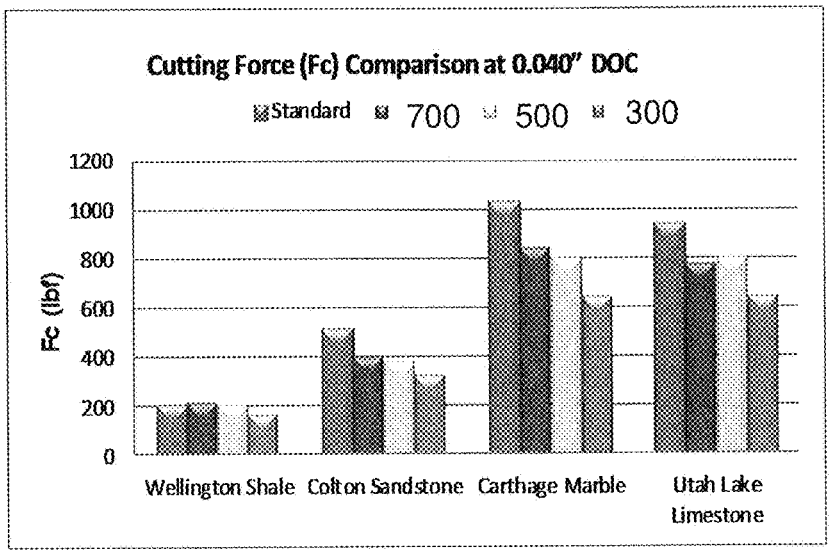
FIGS. 17 and 18 show graphs comparing the cutting force of cutting elements having non-planar and planar top surfaces.
Figure 18:
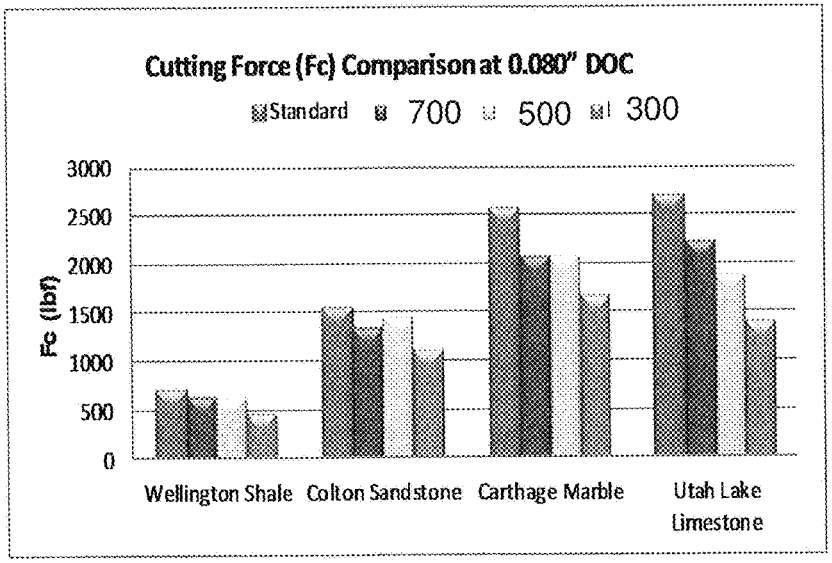
Figure 19:
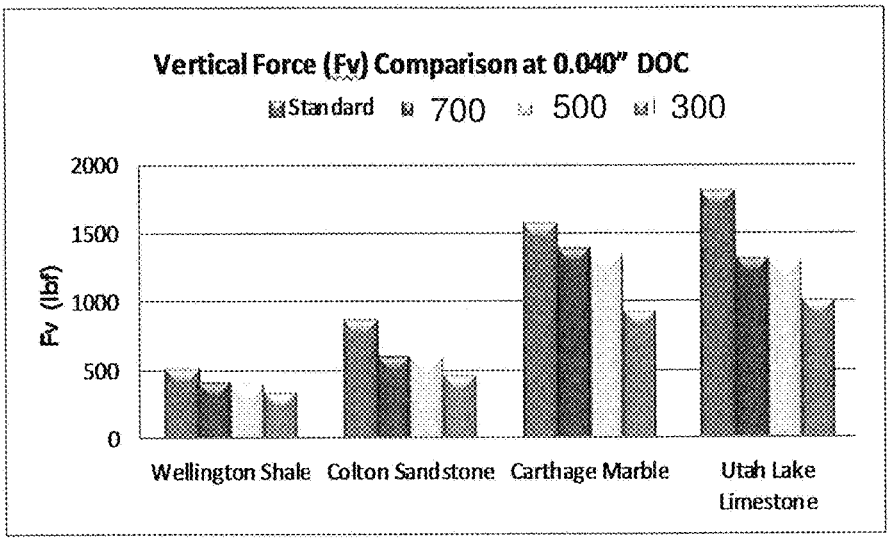
FIGS. 19 and 20 show graphs comparing the vertical force of cutting elements having non-planar and planar top surfaces.
Figure 20:
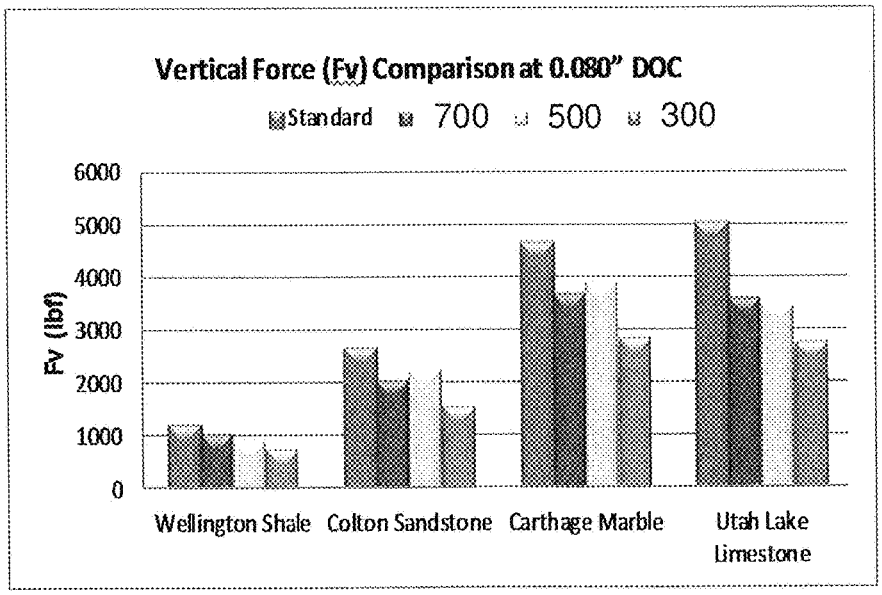

Test samples of the cutting elements shown in FIGS. 3, 8, and 12 (e.g., cutters 300, 500, and 700, respectively) were produced and tested against a standard cutting element having a planar top surface in various drilling environments. FIGS. 17 and 18 show a graph comparison of the cutting force of the standard cutting element and cutting elements 300, 500, 700 (from FIGS. 3, 8, and 12, respectively) at a 0.04 in (1.02 mm) depth of cut (FIG. 17) and a 0.08 in (2.03 mm) depth of cut (FIG. 18) in a Wellington shale formation, a Colton sandstone formation, a Carthage marble formation, and a Utah Lake limestone formation. FIGS. 19 and 20 show a graph comparison of the vertical force of the standard cutting element and cutting elements at a 0.04 in (1.02 mm) depth of cut (FIG. 19) and a 0.08 in (2.03 mm) depth of cut (FIG. 20) in a Wellington shale formation, a Colton sandstone formation, a Carthage marble formation, and a Utah Lake limestone formation. As shown, cutting element 300 outperformed the standard cutting element with between about 30 and 40 percent lower cutting forces and vertical forces.

Figure 21:
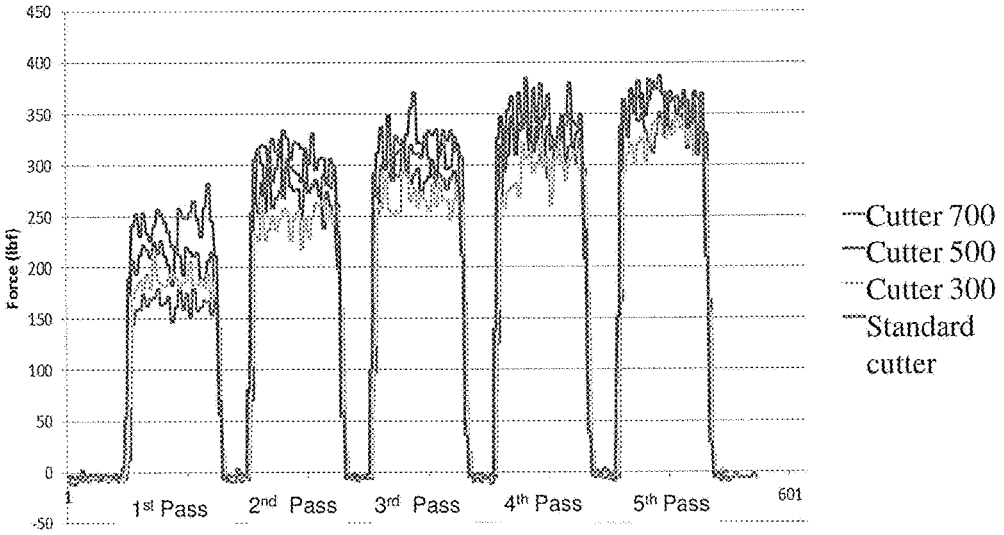
FIG. 21 shows the vertical forces for cutting elements having planar and non-planar top surfaces at five passes.
Figure 22:
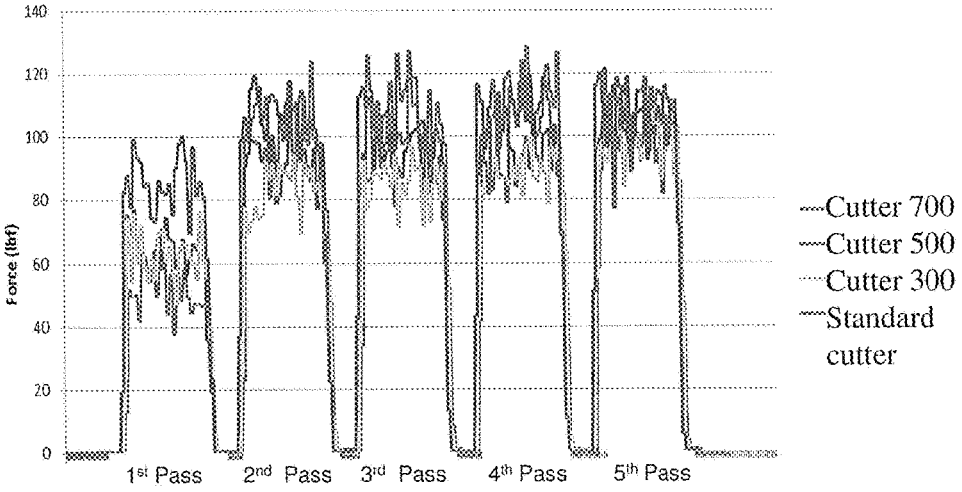
FIG. 22 shows the cutting forces for cutting elements having planar and non-planar top surfaces at five passes.
Figure 23:
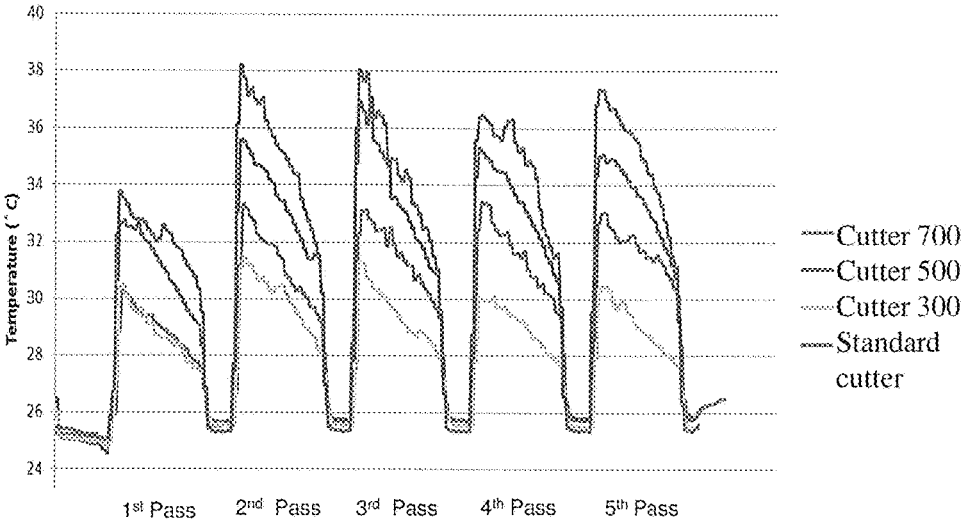
FIG. 23 shows the temperature of cutting elements having planar and non-planar top surfaces at five passes.
Figure 24:
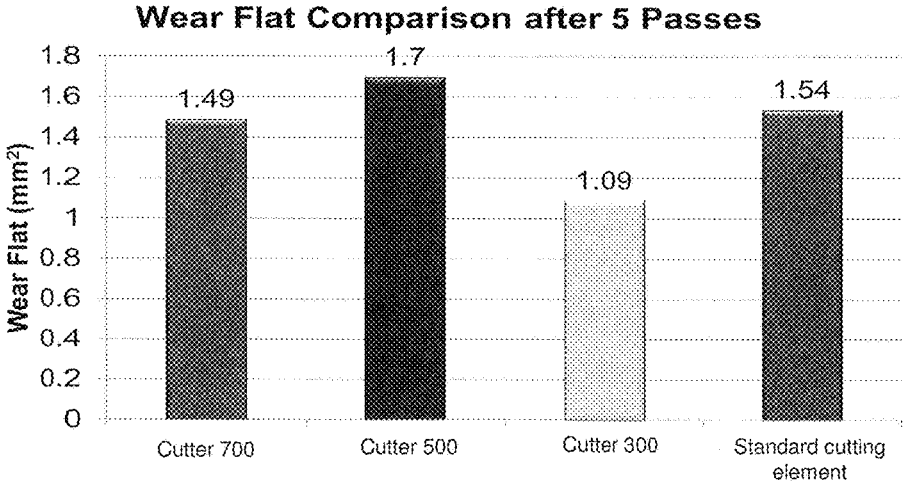
FIG. 24 shows a graph comparison of the wear flats for cutting elements having planar and non-planar surfaces after five passes.

FIGS. 21-24 show test results for running cutting elements 300, 500, 700 (from FIGS. 3, 8, and 12, respectively), in comparison with a standard cutting element through five testing passes. Particularly, FIG. 21 shows the vertical forces for each cutting element type at each pass, where the cutting element type shown in FIG. 3 had a reduction of about 28 percent in vertical forces when compared with the standard cutting element. FIG. 22 shows the cutting forces for each cutting element type at each pass, where the cutting element type shown in FIG. 3 had a reduction of about 23 percent in cutting forces when compared with the standard cutting element. FIG. 23 shows the temperature of each cutting element type at each pass, where the cutting element type shown in FIG. 23 had a reduction of about 20 percent in temperature when compared with the standard cutting element. FIG. 24 shows the wear flat area (i.e., the area of the cutting element top surface worn away) formed on each cutting element type after five testing passes, where the cutting element type shown in FIG. 3 had about 30 percent less wear than the standard cutting element.

In the embodiments discussed above, the crests of the cutting elements extended linearly in length but also possessed a generally concave shape along its length in other embodiments. The present disclosure is not so limited. Rather, other embodiments may relate to a cutting element having a non-planar ultrahard layer having a cutting crest extending across the diameter (or at least a portion thereof) that includes one or more peaks and/or valleys present along the crest length.

Figure 25:
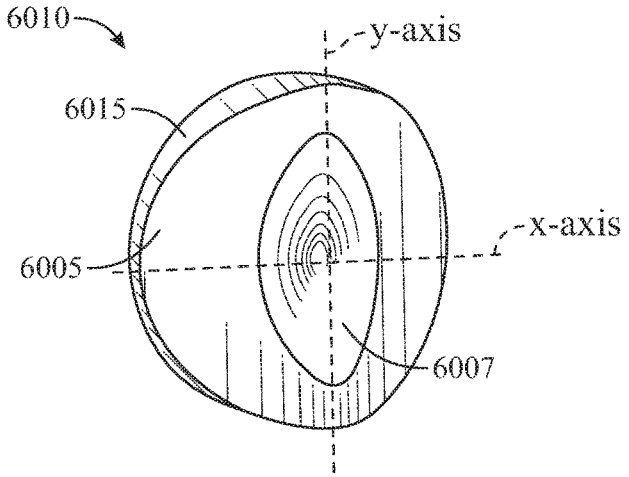
FIG. 25 shows a top view of a cutting element top surface according to embodiments of the present disclosure.
Figure 26:
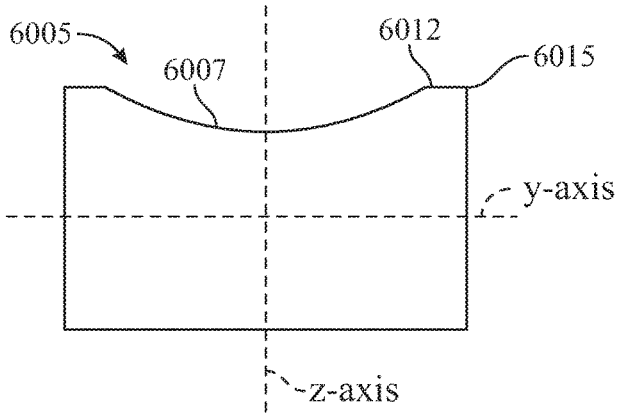
FIGS. 26 and 27 show cross-sectional views of a cutting element top surface according to embodiments of the present disclosure.
Figure 27:
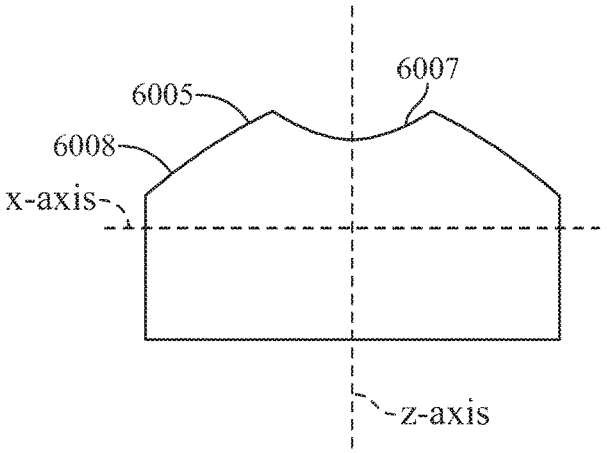

For example, FIGS. 25-27 show a cutting element top surface according to some embodiments of the present disclosure. Particularly, FIG. 25 shows a top view of a non-planar top surface 6005 formed on the ultrahard layer 6010, FIG. 26 shows a cross-sectional view of the top surface 6005 along a plane intersecting a z-axis running axially through the cutting element and an y-axis running radially through the diameter of the cutting element, and in particular, along the length of the crest, and FIG. 27 shows a cross-sectional view of the top surface 6005 along a plane intersecting the z-axis and a x-axis, where the x-axis runs radially through the diameter of the cutting element and is perpendicular with the x-axis. The top surface 6005 has a geometry formed by varying the height of the ultrahard layer above the substrate (at the circumference) along both the x-axis and y-axis, where the height of the top surface is measured along the z-axis from a common base plane, such as a plane perpendicular to the z-axis that is axially lower than the lowest height of the top surface. As shown in FIG. 26, the length of the crest 6012 in the top surface 6005 is formed along the y-axis and adjacent to the peripheral edge 6015 of the cutting element. As shown, the crest 6012 (having similar radius of curvature as those described in FIGS. 3-6 above) extends linearly away from the peripheral edge 6015 toward the z-axis, and includes at least one concave region 6007 along a portion of the crest profile. In one or more embodiments, there may be a spacing of at least 0.03 inches (0.76 mm) or 0.04 inches (1.02 mm) between the peripheral edge 6015 and at least one concave region 6007. The peripheral edge 6015 reaches its peak height adjacent the cutting crest 6012, which forms the cutting edge when the cutting element engages with a formation. Concave region 6007 in the crest profile is formed along the y-axis, such that the height of the top surface decreases along the y-axis from peripheral edge towards the z-axis to form a concave cross-sectional shape. Thus, the cutting element possesses a crest (having a radius of curvature defined above) with a cutting region proximate the peripheral edge that transitions into a concave or modified region rearward from the peripheral edge towards the z-axis (or central axis of the substrate). As shown in FIG. 27, the lowest height 6008 of the top surface 6005 is formed along the x-axis and adjacent to the peripheral edge 6015. The height of the top surface gradually increases from the lowest height 6008 towards the modified region 6007. In a cross-sectional view of the top surface intersecting the greatest height 6006 or cutting crest along a plane perpendicular to the y-axis, the height gradually increases from the peripheral edge to the greatest height to form a convex cross-sectional shape of the top surface 6005. In some embodiments, the top surface may extend linearly to the greatest height or may have a generally convex curvature, either of which may tangentially transition into a central apex or peak having the radius of curvature ranges described above. The three dimensional shape of the top surface 6005 formed by the varying height has a parabolic cylinder shape with an elongated recess formed in a portion of the peak of the parabola.

Figure 28:
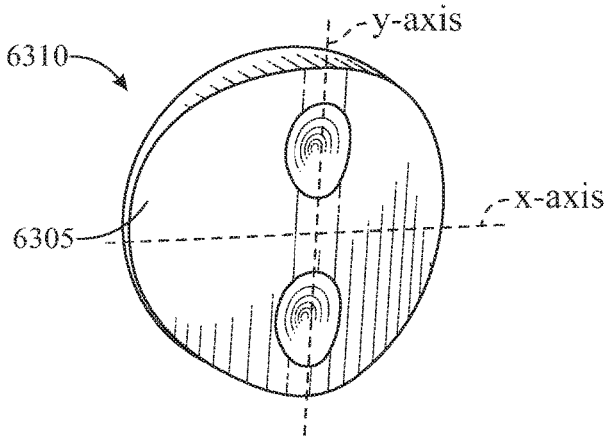
FIG. 28 shows a top view of a cutting element top surface according to embodiments of the present disclosure.
Figure 29:
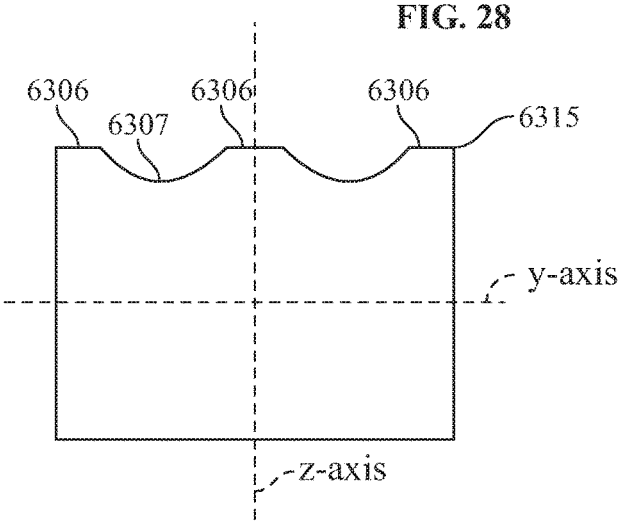
FIGS. 29 and 30 show cross-sectional views of a cutting element top surface according to embodiments of the present disclosure.
Figure 30:
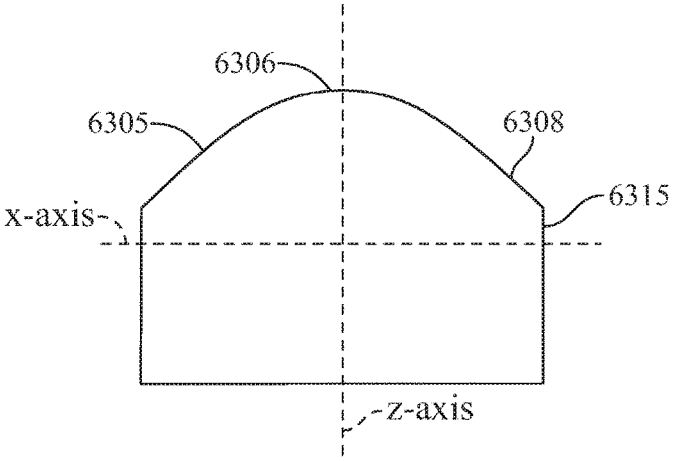

FIGS. 28-30 show another example of a cutting element top surface having at least one concave (otherwise modified) region formed in the top surface along the cutting crest according to embodiments of the present disclosure. Particularly, FIG. 28 shows a top view of a non-planar top surface 6305 of the ultrahard layer 6310, FIG. 29 shows a cross-sectional view of the top surface 6305 along a plane intersecting a z-axis running axially through the cutting element and a y-axis running radially through the diameter of the cutting element, and FIG. 30 shows a cross-sectional view of the top surface 6305 along a plane intersecting the z-axis and an x-axis, where the x-axis runs radially through the diameter of the cutting element and is perpendicular with the y-axis. The top surface 6305 has a geometry formed by varying heights along the x-axis and y-axis, where the height of the top surface geometry is measured along the z-axis from a common base plane. As shown in FIG. 29, a crest 6312 (generally having the greatest height of the non-planar cutting element) is formed in the top surface 6305 along the y-axis. The crest may intersect the peripheral edge 6315 and extend radially inward from the peripheral edge 6315 across at least a portion of the diameter of the cutting element. As illustrated, the portion of the cutting crest 6312 adjacent the peripheral edge may be referred to as the cutting portion. Along the y-z cross-sectional plane, the top surface 6305 includes a cutting crest 6312 (having the greatest height 6306) at both sides of the cutting element that extend away from the peripheral edge 6315 toward the central axis (z-axis). A distance from the edge and cutting region, the crest 6312 includes a plurality of concave recesses formed therein. As compared to FIGS. 25-27, the cutting element in FIGS. 28-30 possesses two, shorter modified regions that transition along central cutting crest from the greatest height 6306 prior to reaching the central axis.

The two concave regions 6307 are formed along the y-axis, such that the height of crest decreases along the y-axis from the peak heights to form concave cross-sectional shapes. In addition to such shape along the crest profile, there may also be height variances along the x-z or crest geometry view. As shown in FIG. 30, the lowest heights 6308 formed in the top surface 6305 are formed along the x-axis and adjacent to the peripheral edge 6315. The height of the top surface geometry gradually increases from the lowest heights 6308 towards the z-axis to form a convex cross-sectional shape along the plane intersecting the z and y axis. The cutting element would possess a similar general cross-sectional shape if taken along a plane along the x-axis parallel to the y-z plane at one of the cutting crests adjacent the peripheral edge. Between that plane, and the y-z plane, another plane along the x-axis parallel to the y-z plane (and intersecting a modified region) may possess two sidewalls extending towards a central concave region, similar to the overall geometry illustrated in FIG. 27. As shown in FIG. 28, the three dimensional shape of the top surface 6305 formed by the varying height has a parabolic cylinder shape with two modified regions formed along the peak or crest of the parabola. In other embodiments, more than two modified regions may be formed along the non-planar shape of a cutting element top surface.

Figure 31:
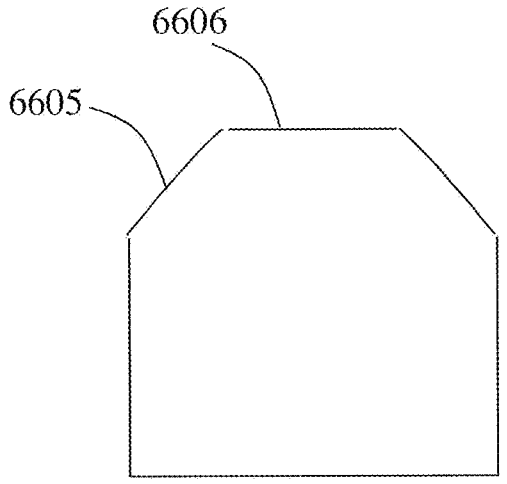
FIGS. 31 and 32 show cross-sectional views of cutting element top surfaces according to embodiments of the present disclosure.
Figure 32:
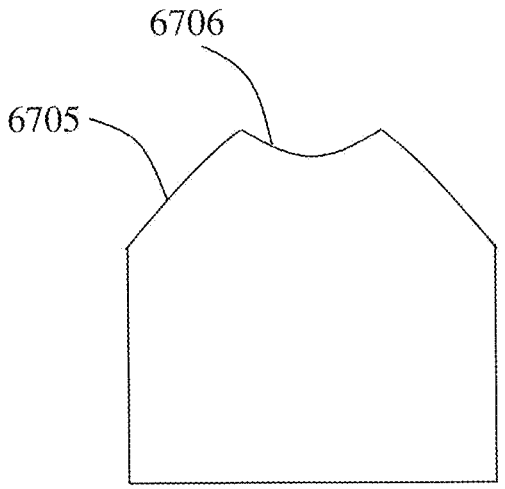

While the above embodiments illustrated a modified region along the crest length that show a generally convex shape. However, it is noted that, as used herein, a modified region may include a region of a cutting element top surface that present a discontinuity in the otherwise continuous shape of the top surface (or crest). A modified region may have various shapes and sizes. For example, a modified region may have a planar or non-planar cross-sectional shape. According to some embodiments, in a cross-sectional view of a top surface along a plane intersecting a modified region and extending axially through the cutting element, the height of the top surface may gradually increase from the peripheral edge to the modified region to form a cropped or truncated parabola or a trapezoid, depending on the slope of the gradually increasing height from the peripheral edge to the modified region. For example, FIG. 31 shows a cross-sectional view of a cutting element top surface 6605 geometry along a plane extending axially through the cutting element and intersecting a modified region 6606 formed in the top surface 6605, where the modified region has a planar cross-sectional shape. When viewed along a cross-sectional plane perpendicular to the view shown in FIG. 31, the modified region 6606 may have a concave shape. For example, FIG. 32 shows a cross-sectional view of a cutting element top surface 6705 geometry along a plane extending axially through the cutting element and intersecting a modified region 6706 formed in the top surface, where the modified region 6706 has a concave cross-sectional shape. The modified region 6706 may have a planar or non-planar shape when viewed along a cross-sectional plane perpendicular to the view shown in FIG. 32.

Described in another way, a modified region may have a length and width, where the length (e.g, major dimension of the crest) extends a direction along crest, and the width (e.g., minor dimension of the crest) extends a direction orthogonal (i.e., perpendicular) to the crest's length along the cutting element top surface. A cross-sectional view of the modified region along its length may have a planar or non-planar shape, and a cross-sectional view of the modified region along its width may have a planar or non-planar shape. For example, a modified region may have a concave cross-sectional shape along its length and a concave cross-sectional shape along its width. In another example, a modified region may have a planar cross-sectional shape along its length and a concave cross-sectional shape along its width. Cutting elements having at least one modified region formed in the top surface may have improved cutting efficiency, depth of cut control, and frontal impact resistance.

In addition to having modified concave regions along the crest length, there may also be protrusions along the crest length, or grooves or protrusions anywhere on the laterally extending portions of top surface, such as to form a chip breaker that may aid in the breaking off of chips of formation as the cutting element engages with the formation.

Further, as mentioned above, the crest geometry may have a generally convex cross-sectional profile (laterally extending into a recessed region); however, the present disclosure is not so limited. Rather, referring now to FIG. 33, the cutting crest 3312 has a substantially constant height, similar to the embodiment illustrated in FIG. 5-6. However, the non-planar top surface 3305 does not form a simple convex surface transitioning from cutting crest 3312 to recessed region 3318. Rather, the non-planar top surface 3305 has an undulating surface that extends laterally away from cutting crest 3312 (i.e., has both peaks and valleys) until reaching recessed regions 3318. Said another way, the non-planar top surface 3305 may have at least one elongated secondary crest 3342 formed in the lateral space between the cutting crest 3312 and recessed region 3318. In one or more embodiments, the cutting crest may be substantially parallel with the elongated secondary crest, as shown; however, in other embodiments, the secondary crest may possess a curvature bowing towards the peripheral edge, whereas cutting crest may be substantially linear.

Figure 33:
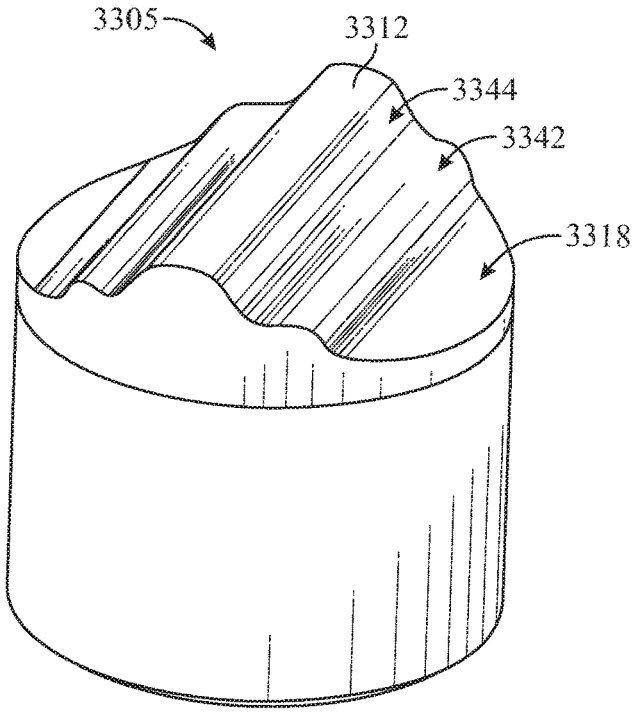
FIGS. 33 and 34 show perspective views of cutting elements according to embodiments of the present disclosure.

Further, while the embodiment illustrated in FIG. 33 shows a non-planar top surface 3305 that smoothly transitions from cutting crest 3312 to elongated valley 3344 to elongated peak 3342 to recessed region 3318, the present disclosure is not so limited. Rather, there may instead be a non-smooth transition between cutting crest 3312 and recessed region 3318 to form an elongated secondary crest 3342 formed in the lateral space between the cutting crest 3312 and recessed region 3318.

Figure 34:
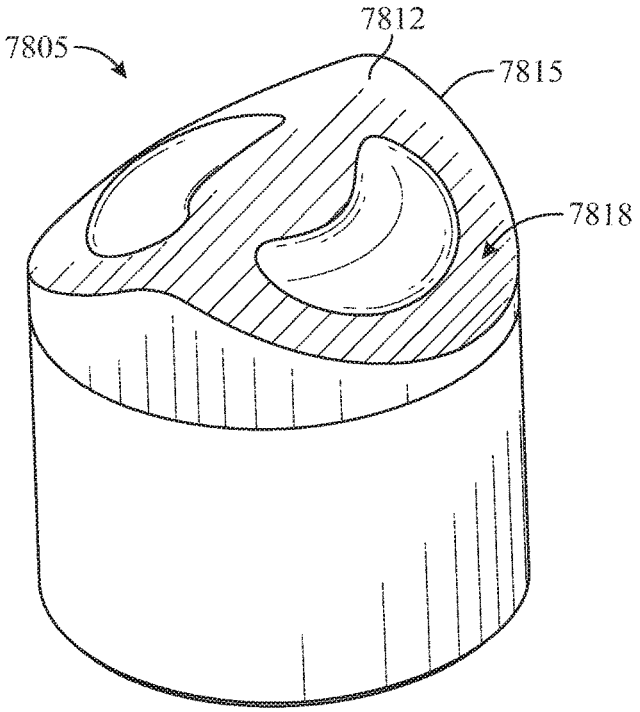

Referring now to FIG. 34, another embodiment of a non-planar top surface is shown. As shown, the cutting crest 7812 has a substantially constant height, similar to the embodiment illustrated in FIG. 5-6. The non-planar top surface 7805 does not form a simple convex surface transitioning from cutting crest 7812 to recessed region 7818, which extends a lateral distance away from cutting crest 7812. The non-planar top surface 7805 may have at least one secondary crest 7242 formed in the lateral space between the cutting crest 7812 and recessed region 7818. While the embodiments illustrated in FIG. 33 include a cutting crest that is substantially parallel with the elongated secondary crest, in the embodiment illustrated in FIG. 34, the secondary crest 7842 may possess a curvature bowing towards the peripheral edge 7815 (along the x-axis), whereas cutting crest 7812 may be substantially linear. Further, while the elongated secondary crest 7242 extends to the peripheral edge 7215 in the embodiment illustrated in FIG. 33, the secondary crest 7842 extends to less than the peripheral edge 7815 along the y-axis. In such embodiments, the secondary crest may extend along 30 to 90% of the edge-to-edge length along the y-axis. In one or more embodiments, the secondary crest may extend linearly or may have a curvature bowing towards the peripheral edge (along the x-axis).

Figure 55:
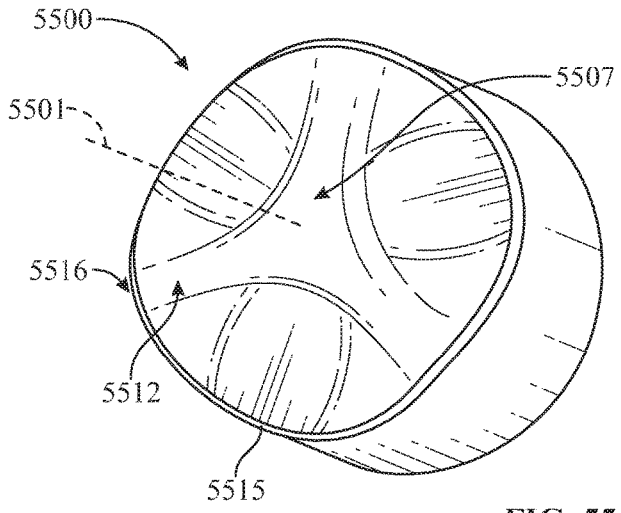
FIG. 55 shows a perspective view of a cutting element according to embodiments of the present disclosure.
Figure 56:
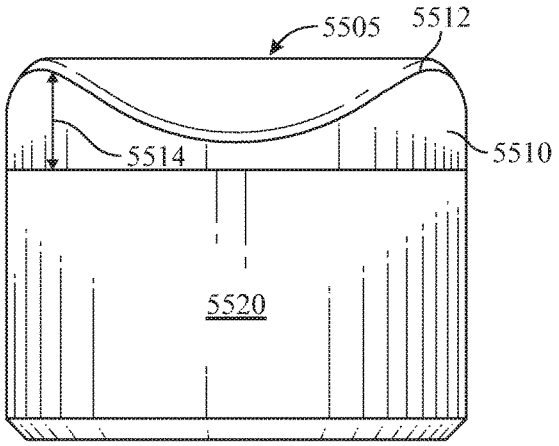
FIGS. 56 and 57 show side views of the cutting element of FIG. 55.
Figure 57:
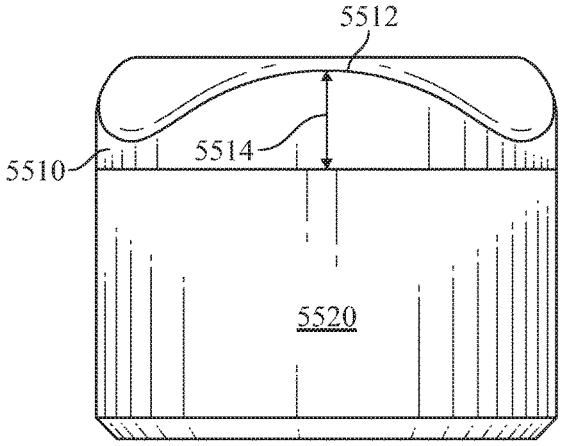

In addition to the above non-planar working surfaces which have two cutting edge portions (e.g. cutting edge portion 316 in FIGS. 3-7), embodiments of the present disclosure may also include embodiments in which more than two cutting edge portions are included. For example, referring to FIGS. 55-57, another embodiment of a cutting element is shown. Cutting element 5500 includes an ultrahard layer 5510 on a substrate 5520 where the non-planar top surface 5505 geometry is formed on the ultrahard layer 5510. The ultrahard layer 5510 has a peripheral edge 5515 surrounding (and defining the bounds of) the top surface 5505. Top surface 5505 includes a plurality of cutting crests 5512 (three in the illustrated embodiment, at about 120 degrees from one another) that extend a height 5514 above substrate 5520. Like the above described embodiments, cutting crests 5512 form the peaks or greatest heights of non-planar working surface 5505 as well as cutting element 5500. The portion of the peripheral edge 5515 that is proximate the crests 5512 form a cutting edge portion 5516. Unlike the above embodiments which include a cutting crest that extends along a diameter of a cutting element, cutting crests 5512 extend from a cutting edge portion 5516 radially inward toward a central axis 5501 and intersect each other in a central region 5507 of top surface 5505. In the illustrated embodiment, central region 5507 is at the same or substantially the same height 5514 as cutting crests 5512 at the cutting edge portion 5516, but is substantially planar or flat, with a convex transition into the concavities that terminate at recessed region. In some embodiments, the central region 5507 may be lower or higher than cutting edge portion 5516, and while illustrated as being substantially flat, central region 5507 may also be curved. Further, in one or more embodiments, the central region 5507 may extend along ⅛ to ⅔ of the cutting element diameter.

The peak of each of cutting crest 5512 has a convex cross-sectional shape (viewed along a plane perpendicular to cutting crest length), with a radius of curvature ranging from 0.02 inches (0.5 mm) to 0.30 inches (7.6 mm), or in another embodiment, from 0.06 inches (1.5 mm) to 0.18 inches (4.6 mm). While not illustrated, at least a portion of the peripheral edge (for example, the cutting edge portion and extending around the portion of the edge that will come into contact with the formation for an expected depth of cut) may be beveled or chamfered. In other embodiments, the entire peripheral edge may be beveled. Further in some embodiments, the chamfer or bevel may vary between the crest and the valley.

Figure 58:
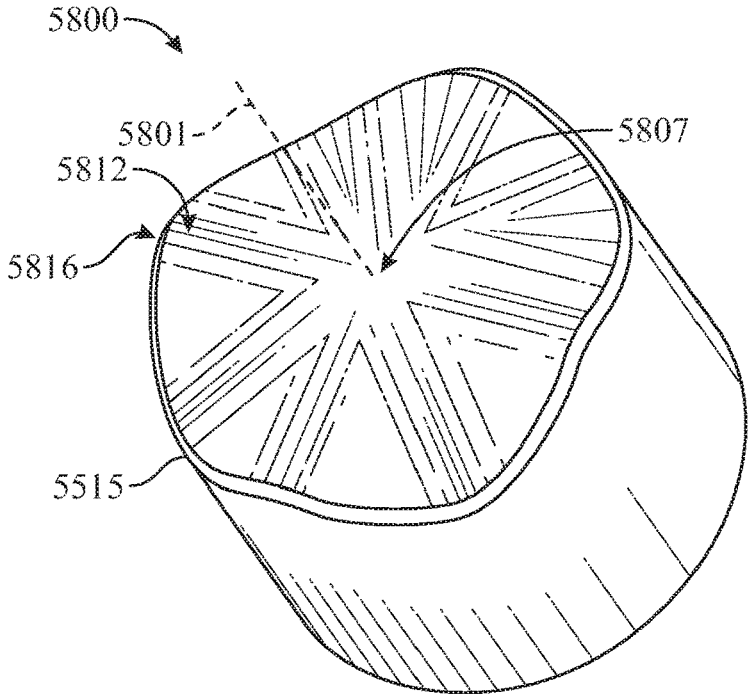
FIG. 58 shows a perspective view of a cutting element according to embodiments of the present disclosure.
Figure 59:
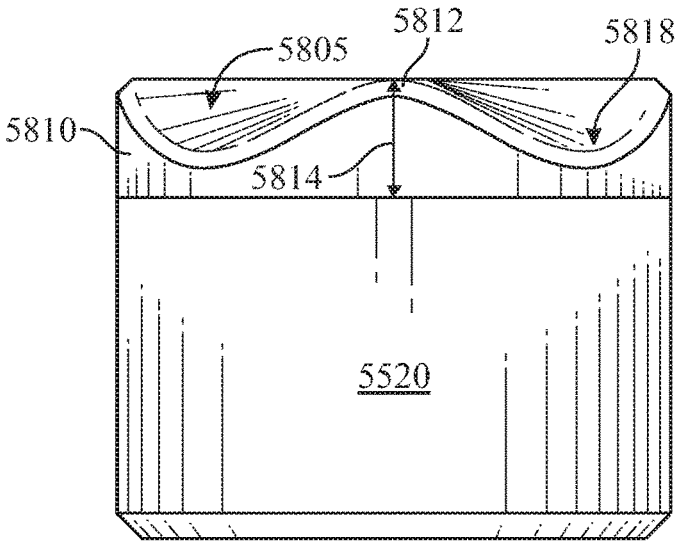
FIG. 59 shows a side view of the cutting element of FIG. 58.

Referring now to FIGS. 58-59, another embodiment of a cutting element is shown. Cutting element 5800 includes an ultrahard layer 5810 on a substrate 5820 where the non-planar top surface 5805 geometry is formed on the ultrahard layer 5810 and is surrounded by a peripheral edge 5815. Top surface 5805 includes a plurality of cutting crests 5812 (four in the illustrated embodiment, at about 90 degrees from one another) that extend a height 5814 above substrate 5820. Like the embodiment shown in FIG. 55, cutting crests 5812 extend from a cutting edge portion 5816 radially inward toward a central axis 5801 and intersect each other in a central region 5807 of top surface 5805. In the illustrated embodiment, central region 5807 is at the same or substantially the same height 5814 as cutting crests 5812 at the cutting edge portion 5816, but is substantially planar, with a convex transition into the concavities that terminate at recessed region 5818. The peak of each of cutting crest 5812 has a convex cross-sectional shape (viewed along a plane perpendicular to cutting crest length), with a radius of curvature ranging from 0.02 inches (0.5 mm) to 0.30 inches (7.6 mm), or in another embodiment, from 0.06 inches (1.5 mm) to 0.18 inches (4.6 mm). The curvature of the valleys between cutting crests 5812 may fall within these same ranges or may be different. Further, depending on the orientation of a cutting element within a cutter pocket, the spacing between cutting crests and the depth of cut, multiple cutting edge portions may engage the formation simultaneously. Such effect may be achieved, for example, for the cutting element shown in FIG. 58 when the cutting element is placed where the crest of the valley is vertical to the formation.

Figure 60:
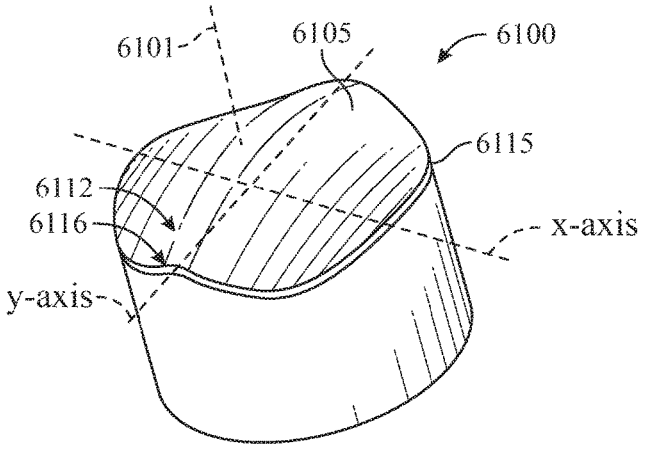
FIG. 60 shows a perspective view of a cutting element according to embodiments of the present disclosure.
Figure 61:
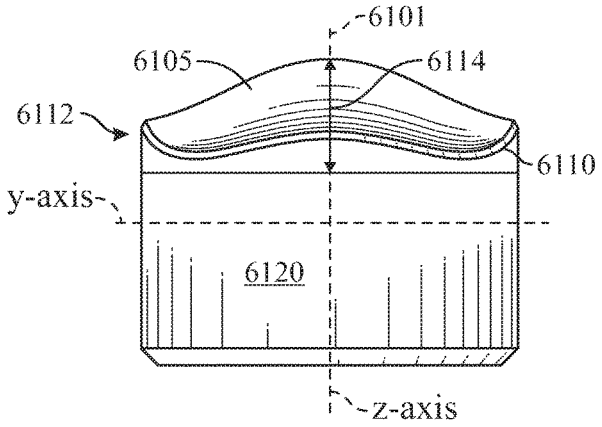
FIGS. 61 and 62 show side views of the cutting element of FIG. 60.
Figure 62:
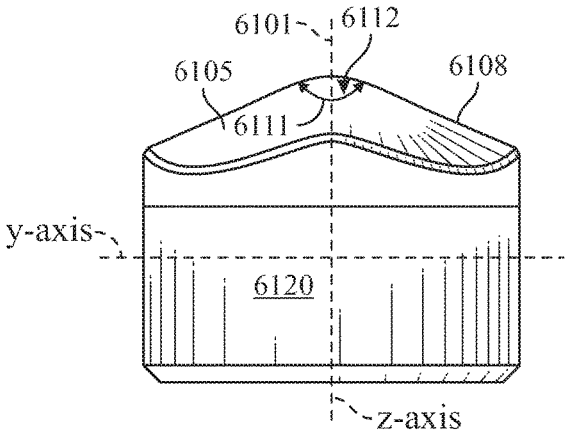

Referring now to FIGS. 60-62, another embodiment of a cutting element is shown. Cutting element 6100 includes an ultrahard layer 6110 on a substrate 6120, where the non-planar top surface 6105 is formed on the ultrahard layer 6110 and is surrounded by peripheral edge 6115. Top surface 6105 includes a cutting crest 6112 that forms the peak or greatest height of non-planar working surface 6105 as well as cutting element 6100. Cutting crest 6112 extends along a diameter of cutting element 6100. The portion of the peripheral edge 6115 that is proximate the cutting crest 6112 forms a cutting edge portion 6116. Unlike the above embodiments which include a cutting crest of substantially even height, cutting crest 6112 has a height 6114 across the diameter of cutting element 6100 along the y-axis, with the peak height 6114 being proximate central axis 6101. The height of the top surface 6105 decreases from the peak height 6114 extending away from the central (or z-) axis 6101 along both the x- and y-axis. However, along the y-axis there is a discrete cutting crest 6112 that has a continuously curved cross-section along its length (seen in the y-z plane view of FIG. 61), such cutting crest 6112 having a radius of curvature (measured perpendicular to the y-axis and length of cutting crest 6112) that is smaller (e.g., substantially smaller) than the curvature of the remainder of top surface 6105. Such radius of curvature may range from 0.02 inches (0.5 mm) to 0.30 inches (7.6 mm), or in another embodiment, from 0.06 inches (1.5 mm) to 0.18 inches (4.6 mm). As illustrated, the top surface 6105 at a cross-section perpendicular to and bisecting the length of cutting crest 6112 (seen in the x-z plane view of FIG. 62) extends linearly to peripheral edge 6115, with the linear segments 6108 tangentially joining the cutting crest 6112 with the above described radius of curvature. Between linear segments 6108 is angle 6111 that may range from 110 degrees to 160 degrees. The top surface 6105 between the linear segments and the cutting crest may be generally concave.

According to embodiments of the present disclosure, cutting elements having an ultrahard layer with a non-planar top surface, such as described above, may have a non-planar interface formed between the ultrahard layer and substrate. For example, according to embodiments of the present disclosure, a cutting element may include a substrate, an upper surface of the substrate including a crest extending along at least a majority of a diameter of the substrate, the upper surface transitioning from the crest into a depressed region, and an ultrahard layer disposed on the substrate upper surface, thereby forming a non-planar interface therebetween. The top surface of the ultrahard layer may have at least one cutting crest extending from a cutting edge portion of the peripheral edge of the top surface radially inward towards a central axis, the peripheral edge decreasing in height in a direction away from the at least one cutting crest and cutting edge portion to another portion of the peripheral edge.

In some embodiments, a cutting element may have a substrate with a side surface, a crest, and at least one depressed region, where the height of the substrate at the crest is greater than the height of the substrate along the at least one depressed region. The crest and the at least one depressed region may define a substrate interface surface, or upper surface, having a substantially hyperbolic paraboloid shape or parabolic cylinder shape. The cutting element may further have an ultrahard layer disposed on the substrate interface surface, thereby forming a non-planar interface, where the ultrahard layer has a peripheral edge surrounding a top surface, the top surface having at least one cutting crest extending a height above the substrate portion along a portion of the peripheral edge to form a first cutting edge portion and at least one recessed region that has a continuously decreasing height from the height of the cutting crest, the height decreasing in a direction away from the cutting crest to another portion of the peripheral edge.

The non-planar shapes of ultrahard layer top surfaces and substrate upper surfaces are described throughout this application separately in addition to a few that are described in combination with each other. However, embodiments of the present disclosure may include cutting elements having any non-planar ultrahard layer top surface design described herein used in combination with any non-planar substrate upper surface design described herein.

Figure 35:
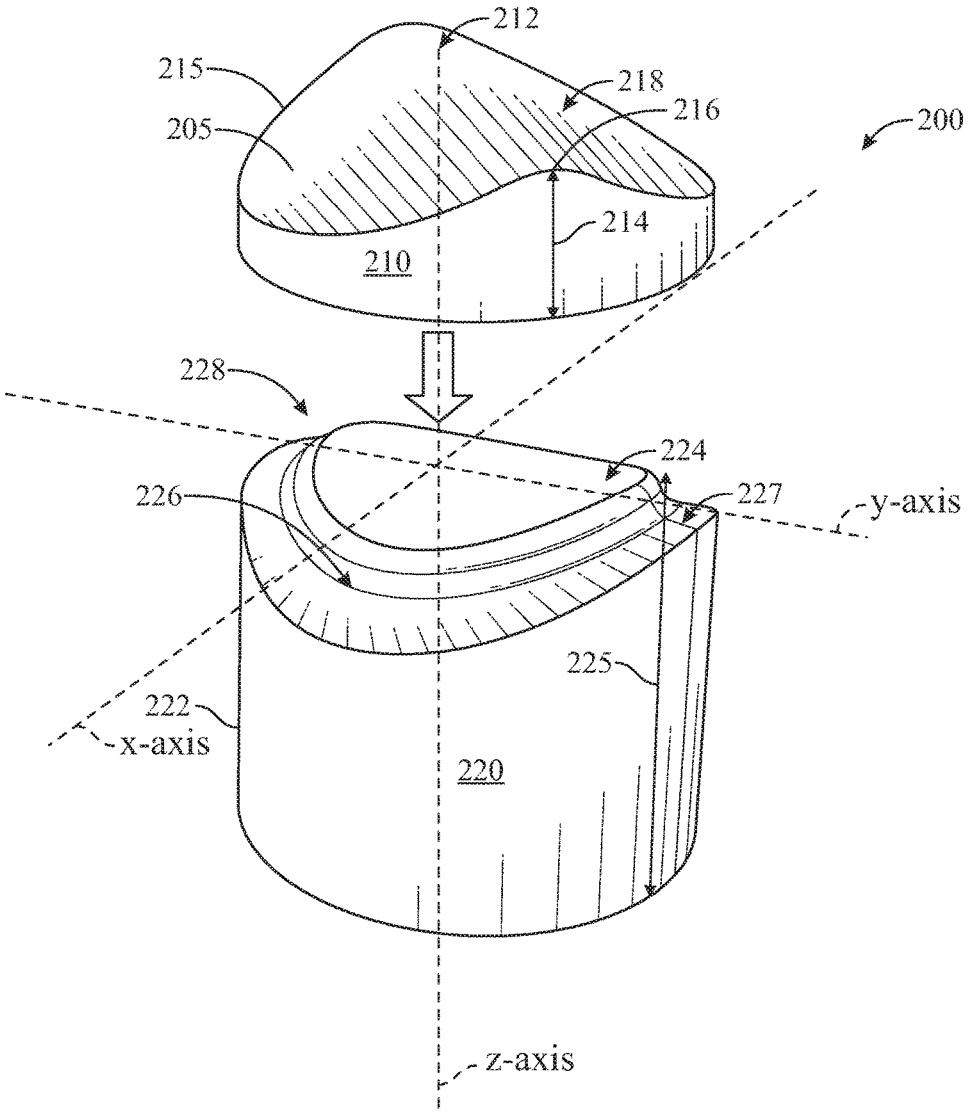
FIG. 35 shows a perspective view of an unassembled cutting element according to embodiments of the present disclosure.

FIG. 35 shows an example of an unassembled cutting element according to embodiments of the present disclosure. The cutting element 200 has a substrate 220 and an ultrahard layer 210. The substrate 220 has a side surface 222, a crest 224, and at least one depressed region 226 extending laterally away from crest 224. The substrate 220 has a height 225 along the crest greater than the height along the at least one depressed region 226, such that the crest 224 and the at least one depressed region 226 define at least a portion of the upper surface 228 having a hyperbolic paraboloid shape. A crest 224 may be defined as a region of the substrate 220 having the greatest height that extends in one direction across a diameter of the cutting element (or at least a portion of the diameter of the cutting element), while a depressed region 226 may be defined as a region of the substrate 220 having a lesser height than the crest that generally decreases in height away from the crest in a direction generally perpendicular to the crest length. According to embodiments of the present disclosure, a non-planar substrate upper surface may include a crest and a depressed region having a height differential (between the greatest height and the lowest point on the depressed region) between the two ranging between 0.04 in (1.02 mm) and 0.4 in (10.16 mm). Further, in one or more embodiments, proximate the radial ends of crest 224 is a stepped transition 227 to the substrate side surface so that the cutting edge portion of the cutting crest may have sufficient thickness behind the cutting edge to withstand cutter wear and/or loads during drilling. For example, a stepped transition 227 may extend around the entire circumference of the substrate, and can have a uniform or non-uniform step around the entire circumference. In one or more embodiments, the width of the stepped transition 227 relative to the diameter may range from 0.03 to 0.25, and the height of the stepped transition 227 relative to the total height 225 of the substrate may range from 0.03 to 0.2. Further, while the illustrated stepped transition 227 shows a concave surface, convex and straight tapered transitions may also be used.

The ultrahard layer 210 has a peripheral edge 215 surrounding a top surface 205, the top surface 205 having at least one cutting crest 212 extending a height 214 along a portion of the peripheral edge 215 to form a first cutting edge portion 216. The cutting crest 212 extends from the first cutting edge portion 216 radially inward towards a central axis and across the diameter of the cutting element. Extending laterally away from cutting crest 212 is at least one recessed region 218. The peripheral edge 215 undulates and decreases in height in a direction away from the cutting crest 212 and cutting edge portion 216 to at least one recessed region 218 formed along another portion of the peripheral edge. In other words, the top surface 205 may have a height that continuously decreases from the cutting crest 212 to at least one recessed region 218. As shown, the cutting crest 212 and recessed regions 218 form top surface 205 having a parabolic cylinder, but any of the above described top surfaces or any other geometric shape may be used. Further, as illustrated, the top surface 205 has a non-planar shape that is different from the substrate upper surface 228 shape. Despite different types of geometry between the top surface 205 and substrate upper surface 228, in one or more embodiments, the crest 212 of top surface 205 and crest 224 of upper surface 228 may be substantially aligned, i.e., co-planar or within 5 degrees of being co-planar, or within 0.1 inches (2.54 mm) of lateral alignment or within 5% (of the diameter) of lateral alignment. In other embodiments, a non-planar top surface of an ultrahard layer may substantially correspond with the shape of a substrate upper surface. For example, a cutting element may have an ultrahard layer with a hyperbolic paraboloid shaped top surface and a substrate with a substantially hyperbolic paraboloid shaped upper surface. In other embodiments, the cutting crest of the ultrahard layer and the crest of the substrate may have substantially similar curvatures. For example, the curvatures may be within 20% of each other, or within 10% or 5% in other embodiments.

Upon assembling the ultrahard layer 210 to the substrate 220, a non-planar interface is formed between the ultrahard layer interface surface and the substrate upper surface 228, where the ultrahard layer interface surface mates with the substrate upper surface 228.

Figure 36:
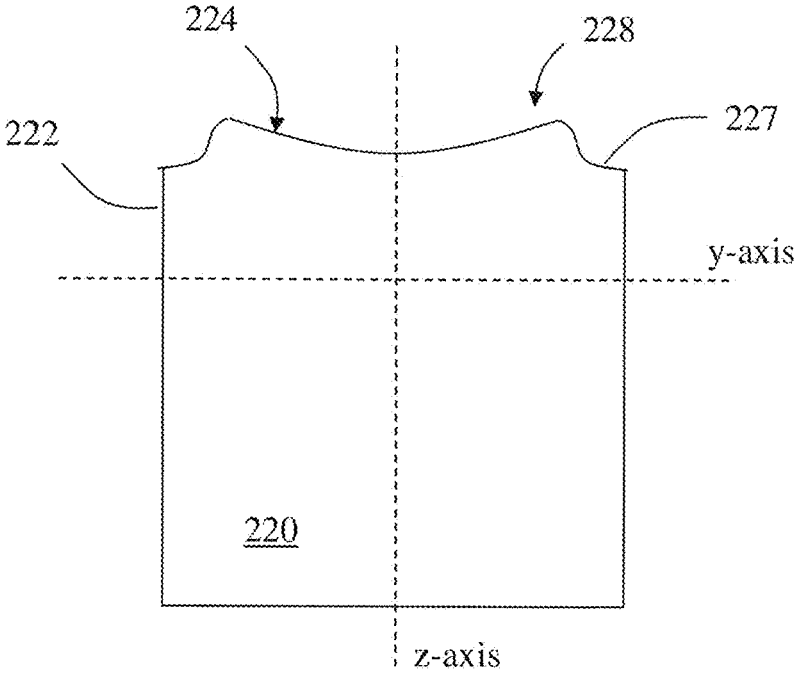
FIGS. 36 and 37 show cross-sectional views of the cutting element substrate shown in FIG. 35.
Figure 37:
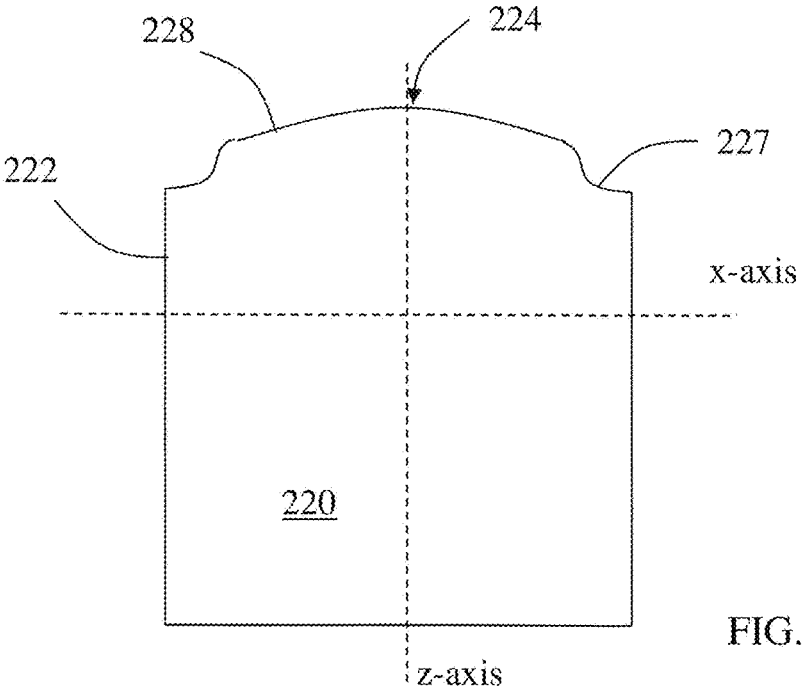
Figure 38:
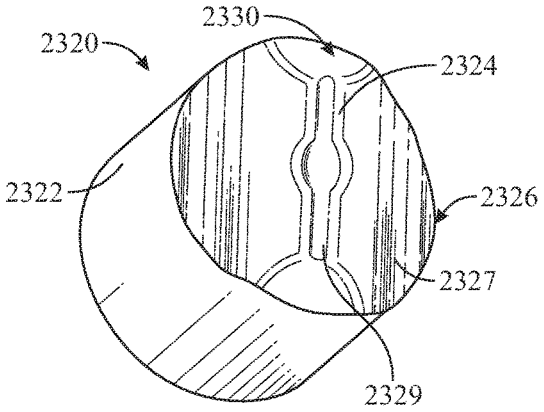
FIG. 38 shows a perspective view of a substrate according to embodiments of the present disclosure.

The geometry of the cutting element substrate shown in FIG. 35 may also be described with respect to an x-y-z-coordinate system. The substrate 220 has a non-planar upper surface 228, a side surface 222, and a longitudinal axis coinciding with the z-axis extending there through. The non-planar upper surface 228 has a geometry formed by varying heights (where the height is measured along the z-axis) along the x-axis and y-axis. As described with respect to the ultrahard layer above, the crest 224 includes the peak heights, relative to the z-axis. The crest 224 extends along the y-axis of the substrate 220. That is, the y-axis is defined as extending through the length of the crest 224. Further, while one or more embodiments of the present disclosure involve the crest (at peak heights) extending across the entire diameter of the cutting element, the crest 224 of the substrate may extend less than the entire diameter, i.e., the upper surface may extend to peaks of crest 224 which extend less than the entire diameter, and which may transition into a stepped portion 227 formed adjacent to side surface 222. A cross-sectional view of the substrate 220 along the intersection of the y-axis and z-axis is shown in FIG. 36 (i.e., the crest profile view). As shown, the height of the substrate upper surface gradually decreases from the peak heights towards the z-axis to form a concave cross-sectional shaped-crest 224 bordered by the stepped portion 227 in the upper surface 228. A cross-sectional view of the substrate 220 along the intersection of the x-axis and the z-axis is shown in FIG. 37 (i.e., the crest geometry view), which shows the height of the substrate upper surface gradually decreases from the crest 224 at the z-axis to lower heights (which may also be referred to as the depressed regions 226 in FIG. 35) to form a convex cross-sectional shape bordered by the stepped portion 227 formed in the substrate upper surface 228. Further, in one or more embodiments, the radius of curvature of the crest 224 may range from 0.02 inches (0.5 mm) to 0.30 inches (7.6 mm). As discussed above, the cutting crest formed in the ultrahard layer may have a radius of curvature ranging from ranging from 0.06 inches (1.5 mm) to 0.18 inches (4.6 mm). The three dimensional shape of the substrate upper surface 228 formed by the varying heights has a substantially continuous hyperbolic paraboloid shape bordered by the stepped portion 227.

FIGS. 38-41 show another example of a substrate according to embodiments of the present disclosure. The substrate 2320 has a side surface 2322, crest 2324, and at least one depressed region 2326 extending laterally from crest 2324. The substrate 2320 has a height 2325 along the crest 2324 that is greater than the height along the at least one depressed region 2326. The crest 2324 and the depressed regions 2326 define an upper surface 2328 having a generally parabolic cylinder shape. As shown, crest 2324 has an elongated shape extending across a portion (at least a majority) of the substrate diameter, with peak heights at the radial ends of the crest 2324. Proximate the radial ends of crest 2324 are tapered transitions 2330 which transitions the substrate upper surface 2328 from the crest 2324 to the substrate side surface 2322. Further, unlike the stepped transition 227 shown in FIG. 35, which extends around the entire substrate circumference, the present embodiment includes a tapered transition 2330, which extends around a portion of the substrate circumference, particularly proximate the radial ends of crest 2324. Upon assembly with an ultrahard layer, the tapered transition 2330 may be included so that the cutting edge portion of the cutting crest (of the ultrahard layer) may have sufficient thickness behind the cutting edge to withstand cutter wear and/or loads during drilling. In one or more embodiments, the width 2334 (radial width towards the central axis) of the tapered transition 2330 relative to the diameter may range from 0.03 to 0.25, and the height 2332 of the tapered transition 2330 relative to the total height 2325 of the substrate may range from 0.03 to 0.2. As illustrated, the tapered transition 2330 has a concave surface geometry, but it is also envisioned that planar or convex tapered transitions may also be used.

In addition to tapered transition 2330 proximate the radial ends of crest 2324, the height of the substrate further decreases laterally from the crest 2324 towards the depressed regions 2326. Further, the changes in height from the crest 2324 to depressed regions 2326 may not form a continuous parabolic cylinder, but instead may form a general parabolic cylinder shape. For example, between the crest 2324 and depressed region 2326, the upper surface transitions into a plateau 2327, before transitioning into depressed region 2326. In the illustrated embodiment, plateau 2327 extends substantially along the length of crest 2324, a lateral and axial distance away from crest 2324. As illustrated, depressed region 2326 extends a depth 2336 below crest 2324 that is greater than the height 2332 of crest 2324 at the tapered transition 2330. In one more embodiments, the ratio of the height 2332 of crest 2324 at tapered transition 2330 to the depth 2336 of depressed region 2326 before crest 2324 may range from 0.1 to 1, or from 0.2 to 0.6 in more particular embodiments.

Figure 39:
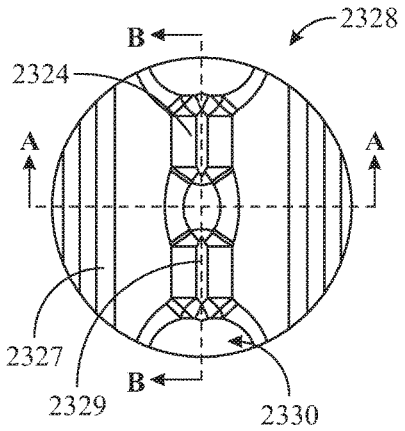
FIG. 39 shows a top view of a substrate according to embodiments of the present disclosure.
Figure 40:
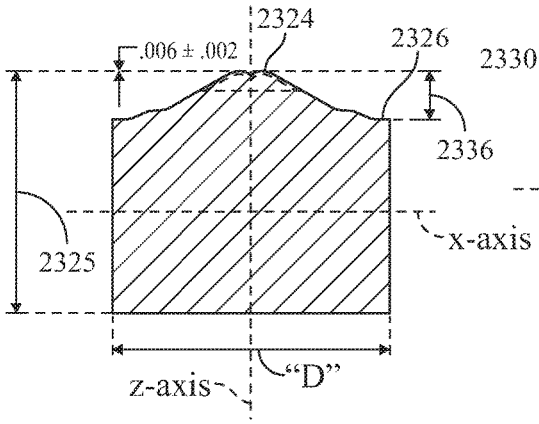
FIGS. 40 and 41 show cross-sectional views of the substrate of FIG. 39.
Figure 41:
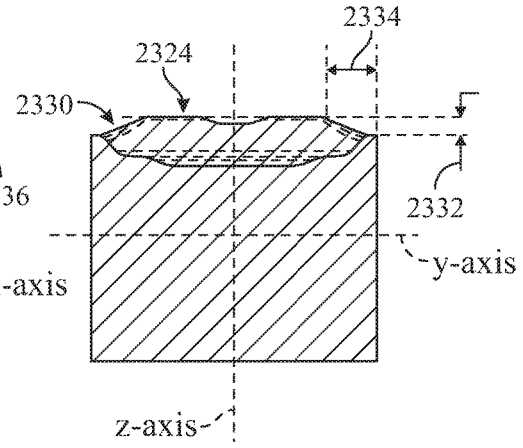

In addition to the discontinuity of curvature extending laterally away from the crest 2324 to form plateaus 2327, the height of the upper substrate surface may have one or more peaks or valleys forming the crest 2324, including one or more concave regions 2329 as illustrated in FIG. 39. Specifically, as illustrated, the crest 2324 includes two substantially parallel peaks with an elongated concave region or groove 2329 extending along a substantial length of crest 2324. Proximate the central axis of substrate 2320, the concave region 2329 is more pronounced, extending deeper into the substrate 2320 and having a greater lateral extent. With such greater depth and lateral extent of concave region 2329, proximate the central axis of substrate, the crest 2324 similarly bows laterally outward and has a reduced height as compared to the radial ends of crest 2324. As described more below, other types and combinations of surface alterations may be formed in a substrate upper surface.

Figure 42:
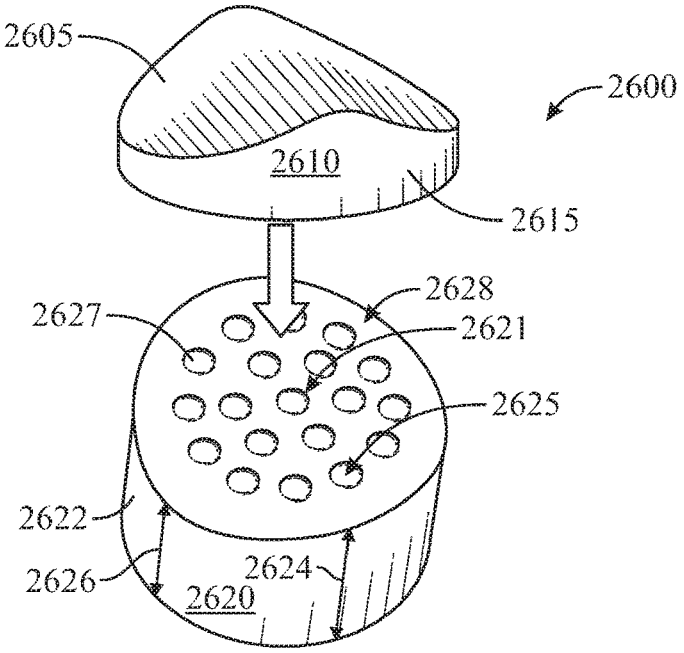
FIGS. 42 and 43 show perspective views of unassembled cutting elements according to embodiments of the present disclosure.

Referring now to FIG. 42, another example of an unassembled cutting element according to embodiments of the present disclosure is shown. The cutting element 2600 has a substrate 2620 and an ultrahard layer 2610. The substrate 2620 has a side surface 2622 and a non-planar upper surface 2628, the geometry of which is defined by varying heights. As shown, the substrate 2620 has a crest 2624 extending across a diameter of the substrate 2620 and at least one depressed regions 2626 extending laterally away from crest 2624. The height of the substrate 2620 decreases from the peak height of the crest 2624 (at radially outward ends of the crest) towards a central region 2621 and as well as to the at least one depressed region 2626. The crest 2624, depressed regions 2626, and the varying height between the crest 2624 regions and depressed regions 2626 form a substrate upper surface 2628 having a substantially parabolic cylinder shape. The ultrahard layer 2610 has an ultrahard layer interface surface 2617, a top surface 2605 opposite from the ultrahard layer interface surface 2617, and a peripheral surface 2615 surrounding the top surface 2605. The top surface 2605 of the ultrahard layer 2610 has a parabolic cylinder shape, such as described above. Upon assembling the ultrahard layer 2610 to the substrate 2620, a non-planar interface is formed between the ultrahard layer interface surface 2617 and the substrate upper surface 2628.

Further, the substrate upper surface 2628 may have a substantially hyperbolic paraboloid shape with at least one surface alteration formed thereon. The at least one surface alteration includes at least one protrusion 2625. The protrusions 2625 may be radially dispersed around the central region 2621 on the substrate upper surface 2628. The ultrahard layer interface surface has corresponding dimples radially dispersed thereon such that the ultrahard layer interface surface mates with the substrate upper surface 2628. In some embodiments, protrusions (and corresponding dimples) may be axisymmetric, symmetric, or non-symmetric around the interface surface. Further, in some embodiments, a substrate upper surface may have one protrusion, while in other embodiments a substrate upper surface may have more than one protrusion.

Figure 43:
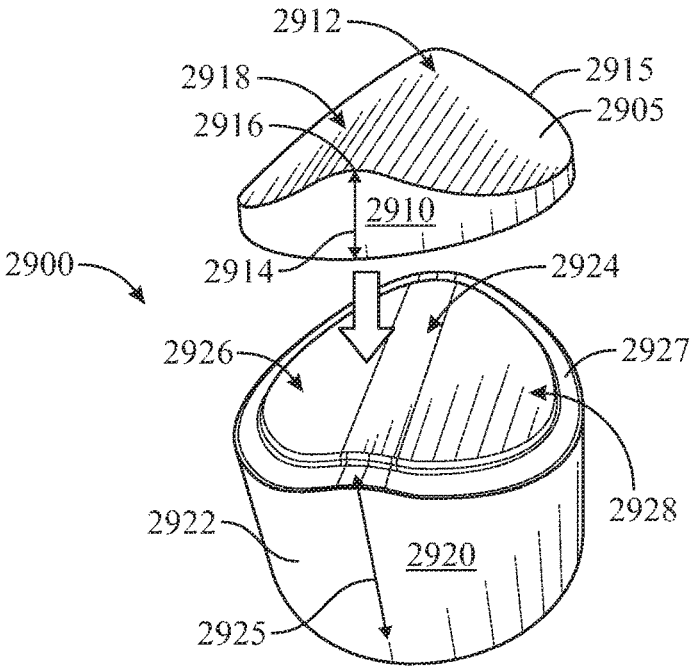

FIG. 43 shows another example of an unassembled cutting element substrate according to embodiments of the present disclosure. The cutting element 2900 has a substrate 2920 and an ultrahard layer 2910. The substrate 2920 has a side surface 2922, crest 2924, and at least one depressed region 2926 extending laterally away from crest 2924. The substrate 2920 has a height 2925 at the crest 2924 greater than the height at the at least one depressed region 2926, such that the crest 2924 and the at least one depressed region 2926 define a substrate upper surface 2928 having a parabolic cylinder shape. In the embodiment shown, the crest 2924 (having the height 2925 along the apex of the peak) extends across a majority of the diameter of the upper surface 2928. The height of the substrate decreases at a steeper slope from the crest 2924 near the central axis of the substrate as compared to the slope of the decreasing height from the radial ends of the crest 2924. The ultrahard layer 2910 has a peripheral edge 2915 surrounding a top surface 2905 and an ultrahard layer interface surface opposite of the top surface 2905. The top surface 2905 has a cutting crest 2912 extending a height 2914 along a portion of the peripheral edge 2915 to form a first cutting edge portion 2916 and at least one recessed region 2918 extending laterally away from the cutting crest 2912. The height of the top surface 2905 continuously decreases in a direction away from the cutting crest to another portion of the peripheral edge.

Further, the substrate upper surface 2928 may include a stepped portion 2927 formed around its periphery. As shown, the stepped portion 2927 has a height less than the radially inward and adjacent portion of the substrate upper surface. The height difference between the stepped portion 2927 and the radially inward and adjacent portions of the substrate upper surface may be equal around the entire periphery such that the stepped portion 2927 has a shape corresponding with parabolic cylinder shape of the radially inward and adjacent portions of the substrate upper surface. In other words, the stepped portion 2927 may have a shape that continues the general curvature of the parabolic cylinder shape of the remaining substrate upper surface 2928, but is disjointed from the remaining substrate upper surface 2928 at a height less than the radially inward and adjacent portion. The cutting element 200 shown in FIG. 35 also has a stepped portion formed around the periphery (adjacent to the side surface) of the substrate, where the stepped portion has a shape that continues the general saddle shape of the remaining substrate interface surface, but is disjointed from the remaining substrate interface surface at a lower height.

The ultrahard layer 2910 may have a step corresponding to the substrate stepped portion 2927, such that the ultrahard layer interface surface mates with the substrate upper surface 2928. Upon assembling the ultrahard layer 2910 to the substrate 2920, a non-planar interface is formed between the ultrahard layer interface surface and the substrate upper surface 2928.

Figure 44:
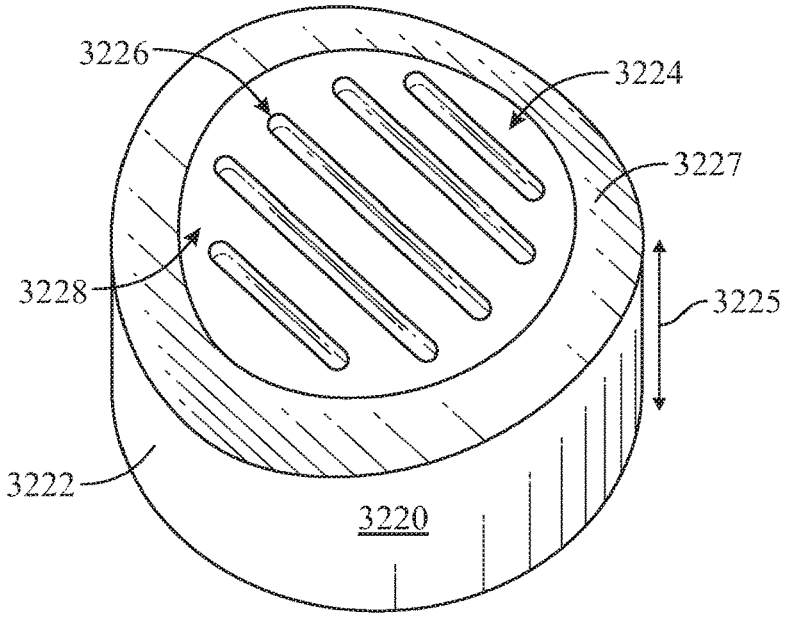
FIGS. 44-50 show perspective views of substrates according to embodiments of the present disclosure.

According to embodiments of the present disclosure, a cutting element substrate may have a stepped portion and at least one surface alteration formed in the substrate interface surface. For example, referring now to FIG. 44, another example of an unassembled cutting element substrate according to embodiments of the present disclosure is shown. The cutting element has a substrate 3220 and an ultrahard layer. The substrate 3220 has a side surface 3222, a crest 3224, and at least one depressed region 3226 extending laterally from the crest 3224. The substrate 3220 has a height 3225 along the crest 3224 that is greater than the height along the at least one depressed region 3226. The crest 3224 and the depressed regions 3226 define a substrate upper surface 3228 having a parabolic cylinder shape.

As shown, the changes in height from crest 3224 to depressed regions 3226 may not form a continuous parabolic cylinder shape, but instead may form a general parabolic cylinder shape having at least one surface alteration 3225 formed thereon. Further, the substrate upper surface 3228 may include a stepped portion 3227 formed around its periphery. As shown, the stepped portion 3227 has a height less than the radially inward and adjacent region of the substrate upper surface 3228. The height difference between the stepped portion 3227 and the radially inward and adjacent portions of the upper surface 3228 may be equal around the entire periphery such that the stepped portion 3227 has a curvature corresponding with parabolic cylinder shape of the radially inward and adjacent portion of the upper surface 3228. Further, substrate upper surface 3228 has at least one surface alteration 3225 that includes a plurality of parallel (or substantially parallel) grooves extending the distance of the upper surface between the stepped portion 3227. However, in other embodiments, one or more grooves may be formed in the substrate interface surface, and may be parallel, non-parallel, or axisymmetric, for example.

Figure 45:
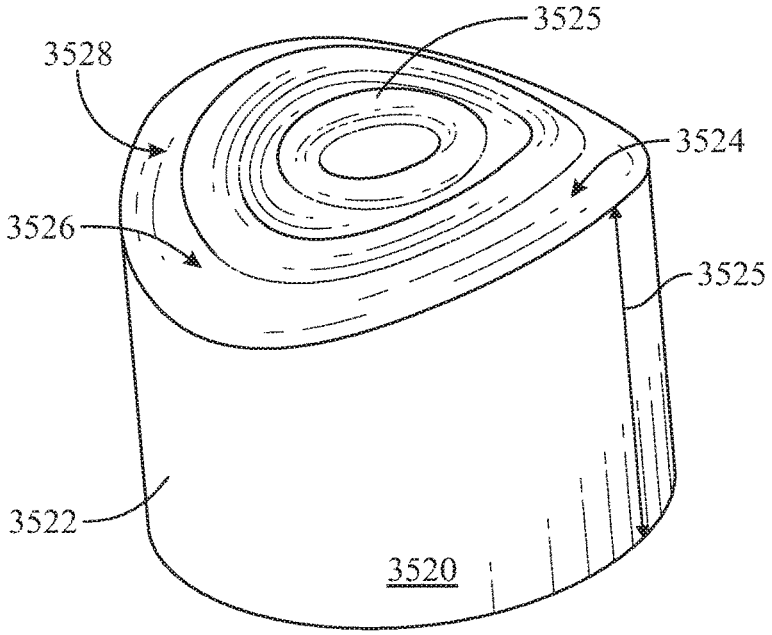

Referring now to FIG. 45, another example of an unassembled cutting element substrate according to embodiments of the present disclosure is shown. The cutting element has a substrate 3520 and an ultrahard layer. The substrate 3520 has a side surface 3522, a crest 3524, and at least one depressed region 3526 extending laterally away from crest 3524. The height 3525 of the substrate 3520 along the crest 3524 is greater than the height of the substrate along the at least one depressed region 3526. The height of the substrate decreases from the crest 3524 towards the central axis of the substrate and from crest along the side surface 3522 towards the depressed regions 3526. The varying height between the crest 3524 and the depressed regions 3526 define a substrate upper surface 3528 having a generally hyperbolic paraboloid shape. As shown, the changes in height from crest 3524 to depressed regions 3526 may not form a continuous hyperbolic paraboloid shape, but instead may form a general hyperbolic paraboloid shape having at least one surface alteration 3225 formed thereon. For example, the at least one surface alteration 3525 may include at least one ridge forming a ring pattern. As shown, the at least one surface alteration 3525 includes two concentric rings formed on the substrate interface surface 3528. However, in other embodiments, more or less than two rings may be formed in a hyperbolic paraboloid shaped substrate upper surface.

Figure 46:
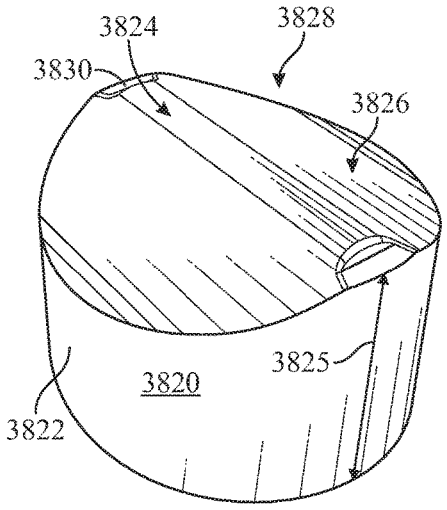

FIGS. 46-50 show substrates used in cutting elements according to some embodiments of the present disclosure. Referring to FIG. 46, a substrate 3820 according to embodiments of the present disclosure has a side surface 3822, a crest 3824, and at least one depressed region 3826 extending laterally away from crest 3824. The height 3825 of the substrate 3820 along the crest is greater than the height along the at least one depressed region 3826. The crest 3824 and the depressed regions 3826 define a substrate upper surface 3828 having a parabolic cylinder shape that extends a substantial majority, but less than all, of the diameter of the cutting element. The upper surface also includes tapered transitions 3830 formed proximate the radial ends of the crest 3824 adjacent to the side surface 3822.

Figure 47:
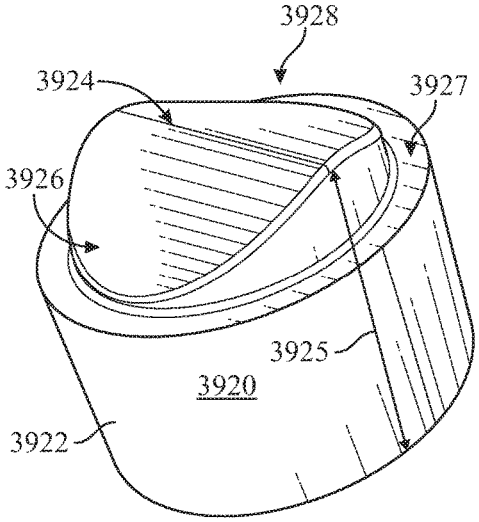

FIG. 47 shows a substrate 3920 according to other embodiments of the present disclosure having a side surface 3922, a crest 3924, and at least one depressed region 3926 extending laterally away from the crest 3924. A height 3925 of the substrate 3920 along the crest 3924 is greater than the height along the at least one depressed region 3926. A stepped portion 3927 is formed around the periphery of the substrate upper surface 3928, where the height of the substrate along the stepped portion 3927 is less than the remaining portion of the upper surface having crest 3924 and the depressed regions 3926. As shown, the stepped portion 3927 has a uniform height around the periphery of the upper surface 3928 such that the stepped portion 3927 does not correspond with the shape of the remaining portion of the substrate upper surface 3928. The crest 3924 and the depressed regions 3926 define a portion of the upper surface 3928 having a parabolic cylinder shape surrounded by the stepped portion 3927, where the crest 3924 extends from one side of the stepped portion 3927 to an opposite side of the stepped portion 3927. In one or more embodiments, the width of the stepped portion 3927 may be at least 0.015 inches (0.38 mm) or at least 0.02 inches (0.5 mm) in another embodiment, and up to 0.3 inches (7.6 mm). Further, in one or more embodiments, the width of the stepped portion relative to the diameter may range from 0.03 to 0.25, and the height of the stepped portion relative to the total height of the substrate may range from 0.03 to 0.02. Additionally, while the illustrated embodiment shows a substantially flat or planar stepped portion 3927, it is also within the scope of the present application that the stepped portion 3927 may form a curved or otherwise non-planar annular region.

Figure 48:
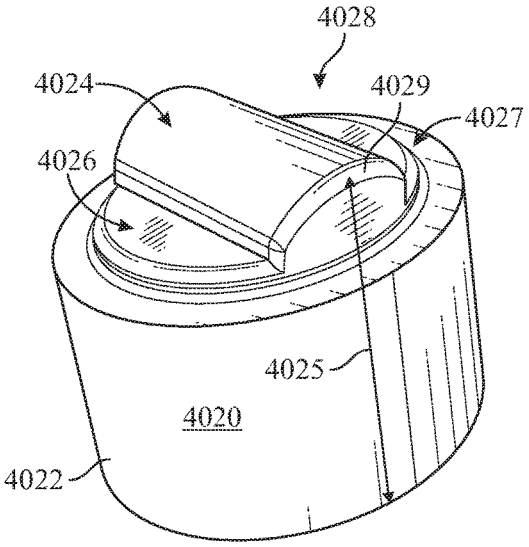

FIG. 48 shows a substrate 4020 according to other embodiments of the present disclosure having a side surface 4022, a crest 4024, and at least one depressed region 4026 extending laterally away from crest 4024. The substrate 4020 has a height 4025 along the crest 4024 greater than the height along the at least one depressed region 4026. As shown, the height of the substrate 4020 at the crest 4024 may gradually decrease towards the depressed regions 4026, such as at a constant rate of change or along a radius of curvature, and then may sharply decrease or drop in height to the depressed regions 4026. According to embodiments of the present disclosure, the height of a substrate may gradually and/or abruptly change from at least one crest to a depressed region, for example, the height may have a constant slope, a constant rate of change, or radius of curvature, a varied slope, a varied rate of change, a combination of constant and varied slopes or rates of change, or a drop (i.e., an undefined vertical slope). Further, a stepped portion 4027 is formed around the periphery of the substrate upper surface 4028, where the stepped portion 4027 has a height less than both the crest 4024 and the depressed regions 4026. As shown, the stepped portion 4027 has a uniform height around the periphery of the substrate upper surface 4028 such that the stepped portion 4027 does not correspond with the shape of the remaining portion of the substrate upper surface 4028. The crest 4024 and the depressed regions 4026 define a portion of the upper surface 4028 having a generally parabolic cylinder shape surrounded by the stepped portion 4027, where the crest 4024 extends from one side of the stepped portion 4027 to an opposite side of the stepped portion 4027. Further, the portion of the upper surface 4028 within the stepped portion 4027 has a rounded chamfer 4029 around the border of its shape. However, other embodiments may have differently shaped chamfers or bevels formed around an entire border or partial border of one or more regions of a substrate upper surface.

Figure 49:
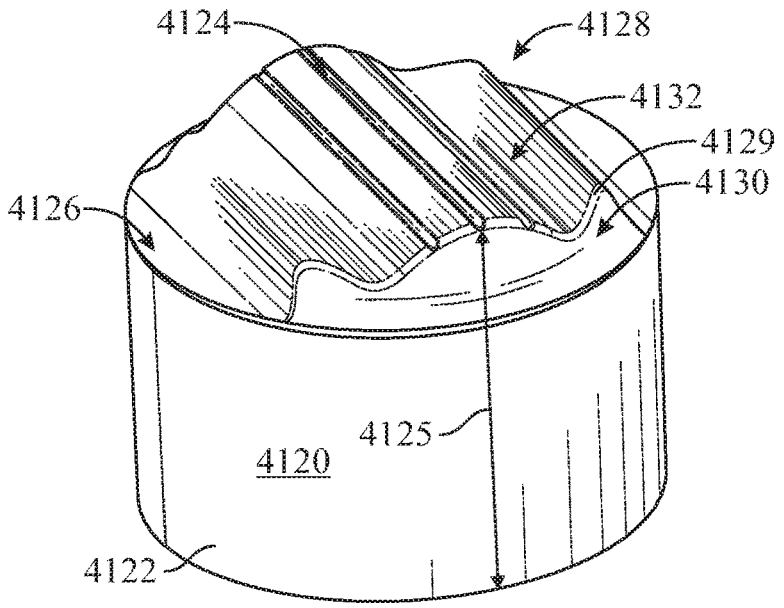

In some embodiments, the height of a substrate may non-continuously decrease from a crest to a depressed region. For example, FIG. 49 shows a substrate 4120 according to some embodiments of the present disclosure. The substrate 4120 has a side surface 4122, a crest 4124, and at least one depressed region 4126 laterally spaced from the crest 4124. An undulating surface 4132 extends from the crest 4124 to the depressed region 4126, forming a valley and hill pattern, where the height of the hills is lower than the height of the crest 4124. Further, the height of the depressed regions 4126 is lower than the height of the valleys. At the radial ends of crest 4124 and the undulating surface 4132, the substrate includes a tapered transition 4130 transitioning the crest 4124 and undulating surface 4132 into side surface 4122. Further, a bevel 4129 formed along the radial ends of the crest 4124 and the undulating surface 4132 adjacent the tapered transition 4130.

Figure 50:
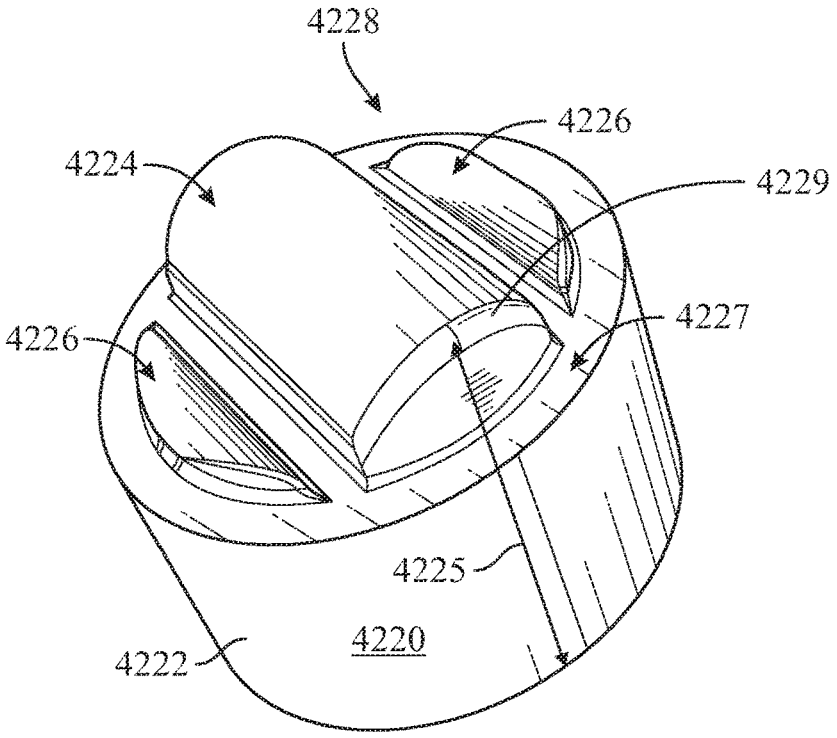

In some embodiments, the height of a substrate may discontinuously decrease from a crest to a depressed region. For example, FIG. 50 shows a substrate 4220 according to embodiments of the present disclosure having a crest 4224 and at least one depressed region 4226 spaced laterally from the crest 4224, where the height 4225 of the substrate along the crest 4224 is greater than the height of the substrate at the depressed regions 4226. A stepped portion 4227 is formed around crest 4224 and depressed regions 4226 and adjacent the side surface 4222 of the substrate 4220. The stepped portion 4227 has a uniform height around the periphery of the substrate such that the shape of the stepped portion does not correspond with the shape of the remaining portion of the substrate upper surface 4228. The stepped portion 4227 may also extend through the remaining portion of the substrate upper surface, forming grooves 4221 between the crest 4224 and depressed regions 4226. Thus, moving from the crest 4224 to the depressed regions 4226, the height of the substrate is at a peak at crest 4224, and moving laterally away from crest, continuously decreases until reaching a radially stepped portion 4227, which serves as a discontinuity in the height. Moving from radially stepped portion 4227 to depressed region 4226, the substrate upper surface has an elevated height between interior stepped portion 4227 that continuously decreases moving laterally towards depressed region 4226. At the radial ends of the crest and upper surface, rounded chamfer 4229 may be included. As shown, the rounded or radiused chamfer 4229 may be formed on either side of the crest 4224.

Figure 51:
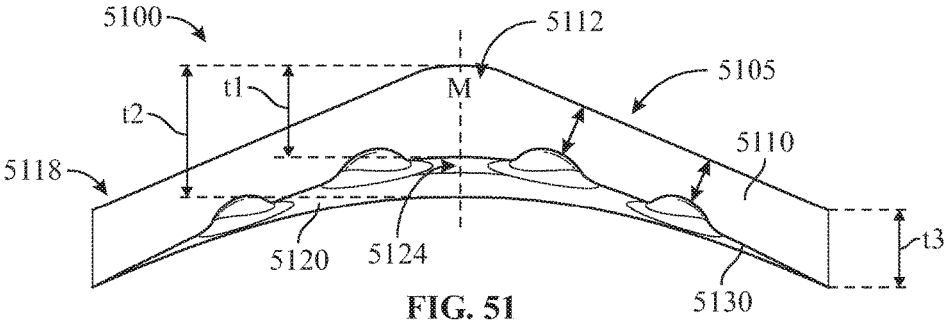
FIG. 51 shows a cross-sectional view of a cutting element according to embodiments of the present disclosure.
Figure 52:
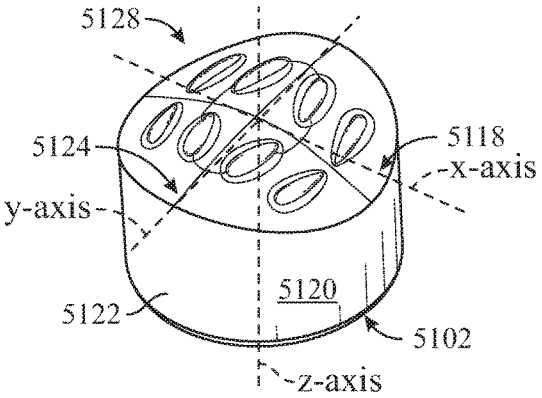
FIG. 52 shows a perspective view of the substrate of the cutting element of FIG. 51.
Figure 53:
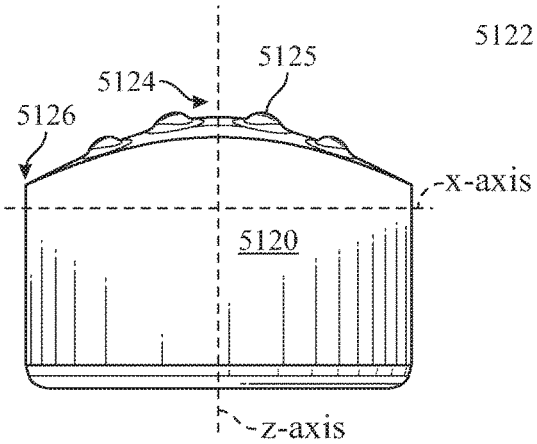
FIGS. 53 and 54 show side views of the substrate of FIG. 52
Figure 54:
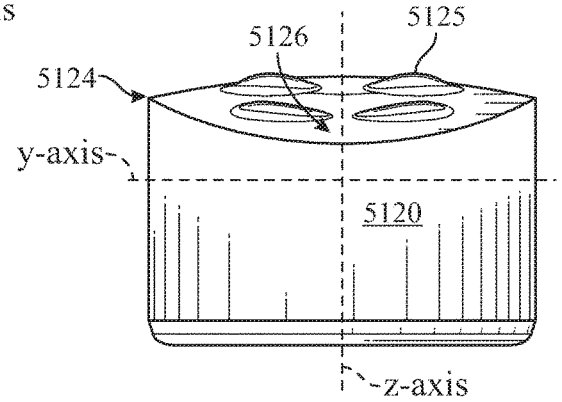

Referring now to FIGS. 51-54, another embodiment of a cutting element 5100 is shown. FIG. 51 shows an ultrahard layer 5110 disposed on a substrate 5120 at an interface 5130. Ultrahard layer 5110 forms a non-planar top surface 5105 (particularly a parabolic cylinder) that has a cutting crest 5112 that extends lengthwise along the y-axis. Extending laterally (along the x-axis) away from the cutting crest 5112, the ultrahard layer 5110 has at least one recessed region 5118 that is formed by the continuous decreases in height of top surface 5105 in a direction away from the cutting crest 5112. Thus, the ultrahard layer 5110 may be similar to that described, for example in FIGS. 3-7. As shown in the cross-sectional view that illustrates the shape of the ultrahard layer top surface 5105, the substrate also possesses a similar, but not the same, curvature. That is, substrate 5120 has a crest 5124 that extends in substantial alignment with cutting crest 5112 (along the y-axis). However, crest 5124 does not have a uniform height but rather its ends (adjacent side surface 5122) are lower than its peak height (proximate central or z-axis). As a result, ultrahard layer 5110 has a thickness t1 at the central or z-axis that is smaller than the thickness t2 at the ends of the crest 5124 along the y-axis. In one or more embodiments, t2 is greater than t1, but is less than three times t1. In addition to this thickness difference, there is also a thickness difference between t1 and t3 (which is the thickness of the ultrahard layer 5110 at recessed region 5118 of ultrahard layer 5110 that extends laterally (along the x-axis)). However, the thickness difference between t1 and t2 is not the result of a difference in height of ultrahard layer 5110 relative to a bottom face 5102 of cutting element 5100 but rather is a result of the geometry of the substrate 5120 upper surface 5128. Specifically, the upper surface 5128 possesses convex curvature extending in two directions, specifically, along both the x- and y-axis. The radius of curvature of the upper surface 5128 taken along the x-z cross-section is smaller than the radius of curvature taken along the y-z cross-section. That is, the radius of curvature along crest 5124 is larger than the radius of curvature formed by the upper surface 5128 extending laterally away from crest 5124. Curvature along crest 5124 may allow for a thicker ultrahard layer 5110 at the cutting edge portion of the peripheral edge.

In addition to the dual curvatures along each of the x- and y-axis, the upper surface also includes a plurality of protrusions 5125, which in the illustrated embodiment, are a plurality of generally tear-drop shaped protrusions 5125 (having one rounded end and one end coming to a point). However, protrusions may be of other shapes, including other elongate (longer than wide) shapes, such as ovals, but may also be non-elongate shapes such as circles, etc. As shown, the points of generally tear-drop shaped protrusions 5125 are pointed inward towards the x-axis from both sides of the x-axis. A plurality of protrusions 5125 are on either side of crest 5124 on the substrate upper surface 5128 extending towards depressed regions 5126. With such orientation, the length of the plurality of protrusions are generally aligned with (substantially parallel or within 20 degrees of) the length of crest 5124. In one or more embodiments, the protrusions 5125 extend a height ranging from about 0.010 to 0.050 inches (0.25 to 1.3 mm). In some embodiments, the protrusions 5125 extend a height that is equal to or greater than about 5%, about 10%, about 15%, or about 20%, and less than or equal to about 50%, about 45%, about 40%, or about 35% the smallest thickness of the ultrahard layer 5110.

Substrates according to embodiments of the present disclosure may be formed of cemented carbides, such as tungsten carbide, titanium carbide, chromium carbide, niobium carbide, tantalum carbide, vanadium carbide, or combinations thereof cemented with iron, nickel, cobalt, or alloys thereof. For example, a substrate may be formed of cobalt-cemented tungsten carbide. Ultrahard layers according to embodiments of the present disclosure may be formed of, for example, polycrystalline diamond, such as formed of diamond crystals bonded together by a metal catalyst such as cobalt or other Group VIII metals under sufficiently high pressure and high temperatures (sintering under HPHT conditions), thermally stable polycrystalline diamond (polycrystalline diamond having at least some or substantially all of the catalyst material removed), or cubic boron nitride. Further, it is also within the scope of the present disclosure that the ultrahard layer may be formed from one or more layers, which may have a gradient or stepped transition of diamond content therein. In such embodiments, one or more transition layers (as well as the other layer) may include metal carbide particles therein. Further, when such transition layers are used, the combined transition layers and outer layer may collectively be referred to as the ultrahard layer, as that term has been used in the present application. That is, the interface surface on which the ultrahard layer (or plurality of layers including an ultrahard material) may be formed is that of the cemented carbide substrate.

Cutting elements according to embodiments of the present disclosure may be disposed in one or more rows along a blade of a cutting tool. For example, according to embodiments of the present disclosure, a drill bit may have a bit body, at least one blade extending from the bit body, and a first row of cutting elements disposed along a cutting face of the at least one blade. One or more of the cutting elements in the first row may include a cutting element having a non-planar top surface and a non-planar interface formed between an ultrahard layer and a substrate of the cutting element, such as described above. The bit may also have a second row of cutting elements disposed along a top face of the at least one blade and rearward from the first row. One or more of the cutting elements in the second row may include a cutting element having a non-planar top surface and a non-planar interface formed between an ultrahard layer and a substrate of the cutting element, such as described above. In some embodiments, one or more of the non-planar cutting elements in the first and/or second rows may have different shapes (e.g., cutting elements having one or more of the above described variations) from other of the non-planar cutting elements.

Figure 63:
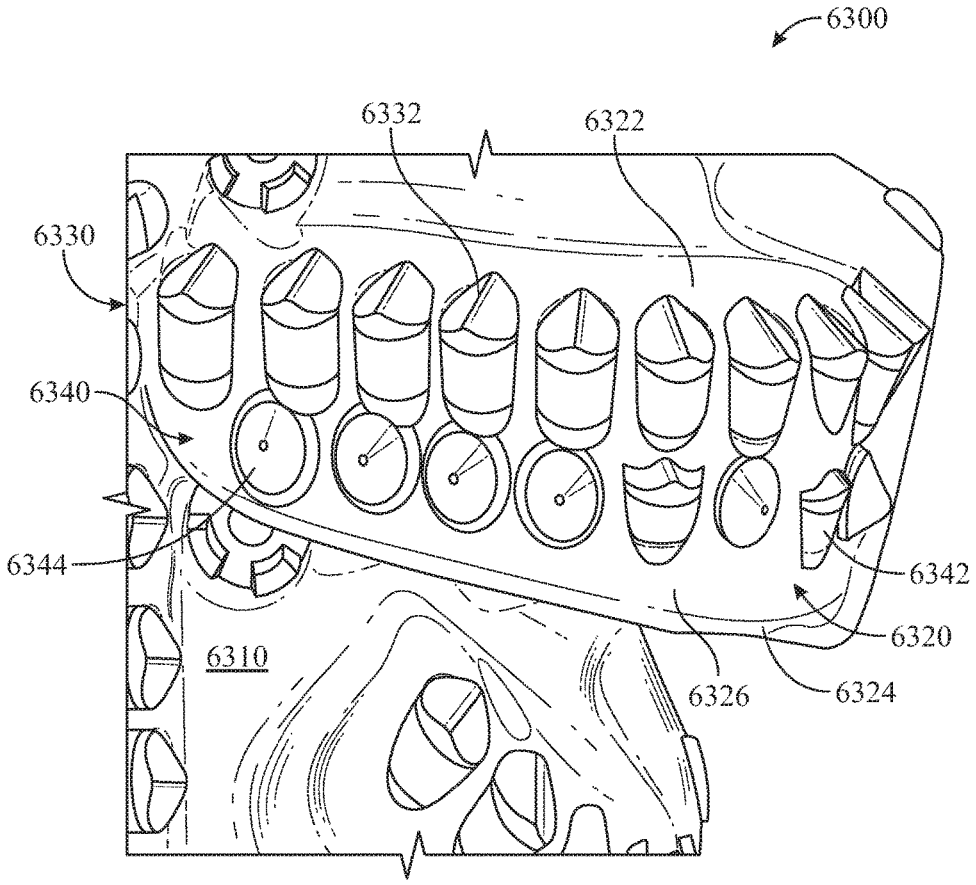
FIG. 63 shows a partial bottom view of a drill bit according to embodiments of the present disclosure.

FIG. 63 shows a partial view of a drill bit according to embodiments of the present disclosure. The drill bit 6300 has a bit body 6310 and at least one blade 6320 extending from the bit body 6310. Each blade 6320 has a cutting face 6322 that faces in the direction of bit rotation, a trailing face 6324 opposite the cutting face 6322, and a top face 6326. A first row 6330 of cutting elements is disposed adjacent the cutting face 6322 of at least one blade 6320. One or more of the cutting elements in the first row 6330 may include a cutting element 6332 (that may be any of the above described cutting elements). For example, the cutting element 6332 may include a substrate having an upper surface with a crest formed therein, the crest transitioning into a depressed region, and an ultrahard layer on the upper surface, thereby forming a non-planar interface between the ultrahard layer and the substrate. In another embodiment, a top surface of the ultrahard layer has at least one cutting crest extending along a diameter from a cutting edge portion of an undulating peripheral edge. In the embodiment shown, the cutting crest along the top surface of the cutting element 6332 forms a substantially parabolic cylinder shape. Further, in one or more embodiments, any of the top surface geometries may be used in combination with any of the substrate/interface surface geometries.

The bit 6300 further includes a second row 6340 of cutting elements disposed along the top face 6326 of the blade 6320, rearward of the first row 6330. In other words, the first row 6330 of cutting elements is disposed along the blade 6320 at the cutting face 6322, while the second row 6340 of cutting elements is disposed along the top face 6326 of the blade 6320 in a position that is distal from the cutting face 6322. One or more of the cutting elements in the second row 6340 may include a cutting element 6342 according to embodiments of the present disclosure. For example, as shown, the cutting element 6342 may have a non-planar top surface and a non-planar interface formed between an ultrahard layer and a substrate of the cutting element, such as described above. A non-planar top surface of a cutting element in either the first row 6330 or the second row 6340 or in both the first row 6330 and the second row 6340 may have a parabolic cylinder or a hyperbolic paraboloid shape. Further, other cutting elements having planar or non-planar top surfaces may be in a first row and/or second row on a blade. For example, as shown in FIG. 63, the second row 6340 of cutting elements may also include cutting elements 6344 having a conical top surface (or other non-conical but substantially pointed cutting surfaces), where the conical top surface may have a rounded apex with a radius of curvature. Cutting elements 6344 having a conical top surface may be positioned on the blade 6320 such that the central or longitudinal axis of the cutting element 6344 is at an angle with the top surface 6326 of the blade 6320, where the angle may range from, for example, greater than 0 degrees to 90 degrees. Likewise, other cutting elements having planar or non-planar top surfaces may have a central or longitudinal axis at an angle with the top surface of the blade ranging from greater than 0 degrees to 90 degrees. As shown in FIG. 63, cutting elements 6332, 6342 according to embodiments of the present disclosure may be positioned on the blade 6320 at an angle (formed between a line parallel to the bit axis and a line extending through the radial ends of the cutting crest) ranging from greater than 0 degrees to 40 degrees (or at least 5, 10, 15, 20, 25, 30, or 35 degrees in various other embodiments).

Figure 67:
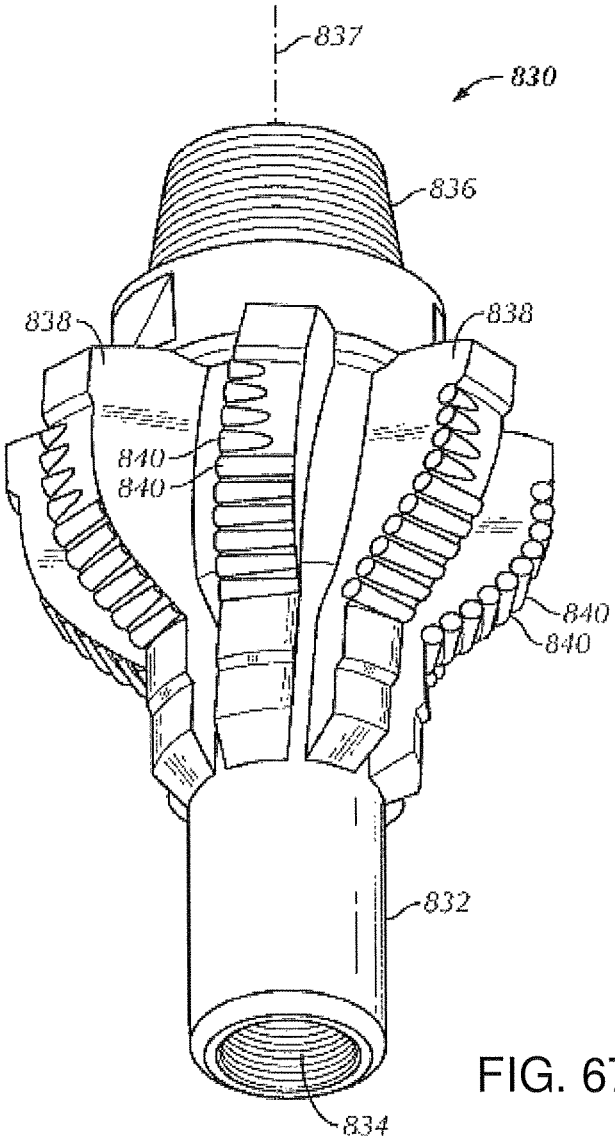
FIG. 67 shows a hole opener according to embodiments of the present disclosure.
Figure 68:
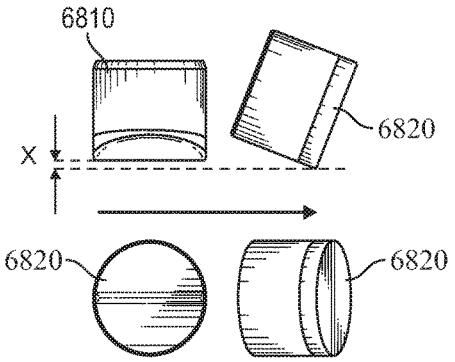
FIGS. 68-70 show side and top views of cutting element orientations according to embodiments of the present disclosure.
Figure 69:
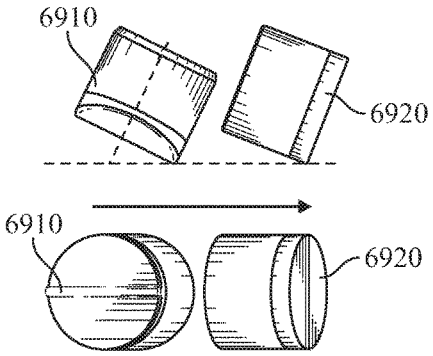
Figure 70:
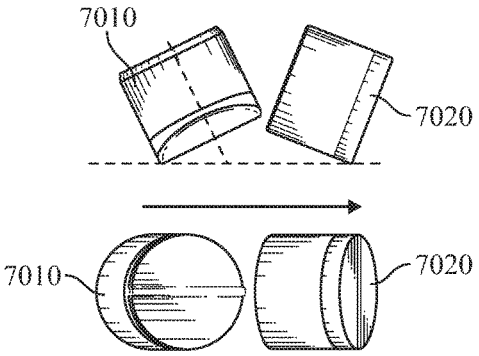
Figure 71:
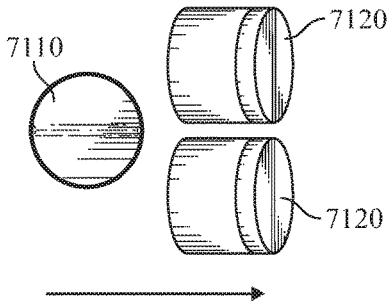
FIGS. 71 and 72 show top views of cutting element combinations according to embodiments of the present disclosure.
Figure 72:
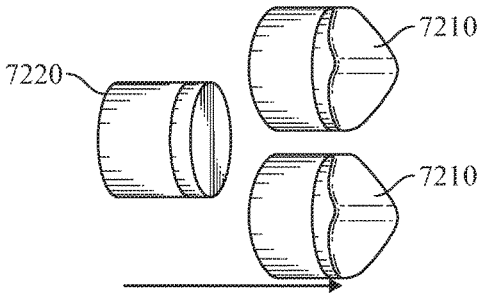

However, as shown in FIG. 68, cutting elements 6832 may be oriented substantially perpendicular to the blade top. That is, the cutting elements 6832 may also be orientated at an angle (formed between a line parallel to the bit axis and a line extending through the radial ends of the cutting crest) ranging from greater than 65 degrees to 115 degrees (or at least 65, 75, 80, 85, 90, 95, 100, 105, 110 degrees in some embodiments). Such angle may also be expressed as the angle formed between a line parallel to the bit axis and a central axis of the cutting element, which would range from 0 to ±25 degrees (or at least 0, ±5, ±10, or ±15 degrees). For example, while FIG. 68 shows a cutting element 6810 of the present disclosure tracking a shear cutter 6820, the cutting element 6810 being oriented substantially perpendicular to a blade top surface (with an angle formed between a line parallel to the bit axis and a central axis of the cutting element being 0), FIG. 69 shows a cutting element 6910 tracking a shear cutter 6920 and being oriented with a negative angle (up to −25 degrees), where the cutting edge of the cutting element 6910 is angled in a direction away from direction of rotation, and FIG. 70 shows a cutting element 7010 oriented tracking a shear cutter 7020 and being oriented with a positive angle (up to 25 degrees), where the cutting edge of the cutting element 7010 is angled in a direction towards the direction of rotation. Such orientation may be used on the cutting elements of the present disclosure in any of the illustrated cutting element arrangements (and combinations with shear cutters and conical cutter) provided herein above or below. In particular, however, embodiments may include such cutting elements of the present disclosure as back-up or secondary cutting elements directly behind shear cutters or as primary cutting elements, alone or in combination with shear cutters or other non-planar cutting elements. It is also envisioned that the secondary or backup cutting elements may be at distinct radial positions with respect to the primary cutting elements. For example, referring to FIG. 71, a cutting element 7110 of the present disclosure may be a secondary cutting element at a distinct radial position (relative to a bit centerline) as compared to primary shear cutter 7120 (i.e., cutting element 7110 is behind and between two adjacent shear cutters). Conversely, in FIG. 72, cutting element 7210 of the present disclosure is a primary cutting element, and shear cutter 7220 is a secondary cutting element at a distinct radial position (relative to a bit centerline) as compared to primary cutting elements 7210 of the present disclosure (i.e., a shear cutter is behind and between two adjacent cutting elements 7210). Additionally, when using primary and secondary cutting elements, there may be an exposure difference X, shown for example, in FIG. 68, that may range up to ±0.100 inches (2.54 mm). Thus, while there may be no exposure difference (X=0), the cutting element 6810 of the present disclosure may have a greater ($0<X\leq 0.100$ inches) or lesser ($-0.100$ inches$<X<0$) exposure than the shear cutter 6820. Such exposure difference may be used in any embodiment, including combinations shown in any of FIGS. 63-72 (and also including combinations of the same or similar cutting elements).

Referring back to FIG. 63, in one or more other embodiments, cutting elements 6344 having a conical top surface may be positioned on the blade 6320 at an angle (formed between a line parallel to the bit axis and a central axis of the cutting element) ranging from 0 degrees to 20 degrees, where the tip of the cutting element rotationally leads its substrate, i.e., points in the direction of the leading face.

Further, in the embodiment shown in FIG. 63, cutting elements in the second row 6340 may be positioned rearward of cutting elements in the first row 6330 such that one or more cutting element in the second row 6340 shares a radial position with one or more cutting element in the first row. Cutting elements sharing the same radial position on a blade are positioned at the same radial distance from the central or longitudinal axis of the bit, such that as the bit rotates, the cutting elements cut along the same radial path. A cutting element in the second row 6340 and a cutting element in the first row 6330 sharing a same radial position may be referred to as a backup cutting element and a primary cutting element, respectively. In other words, as used herein, the term "backup cutting element" is used to describe a cutting element that trails any other cutting element on the same blade when the bit is rotated in the cutting direction, and the term "primary cutting element" is used to describe a cutting element provided on the leading edge of a blade. Thus, when a bit is rotated about its central axis in the cutting direction, a "primary cutting element" does not trail any other cutting elements on the same blade. Other cutting elements in the second row 6340 may partially overlap the radial position of cutting elements in the first row 6330 or may be positioned in a radially adjacent position to cutting elements in the first row (i.e., where a cutting element in the second row is positioned rearward of a cutting element in the first row and do not share a radial position along the bit blade). Further, while the illustrated embodiment shows the first row 6330 being filled entirely with cutting elements 6342 having the geometry of the present disclosure, fewer than all of the cutting elements on the first row 6330 may have such geometry and may include substantially pointed cutting elements or planar cutting elements. Such mixing of cutting element types may also be intended for the second row, or the second row may include cutting elements of the same type.

Figure 64:
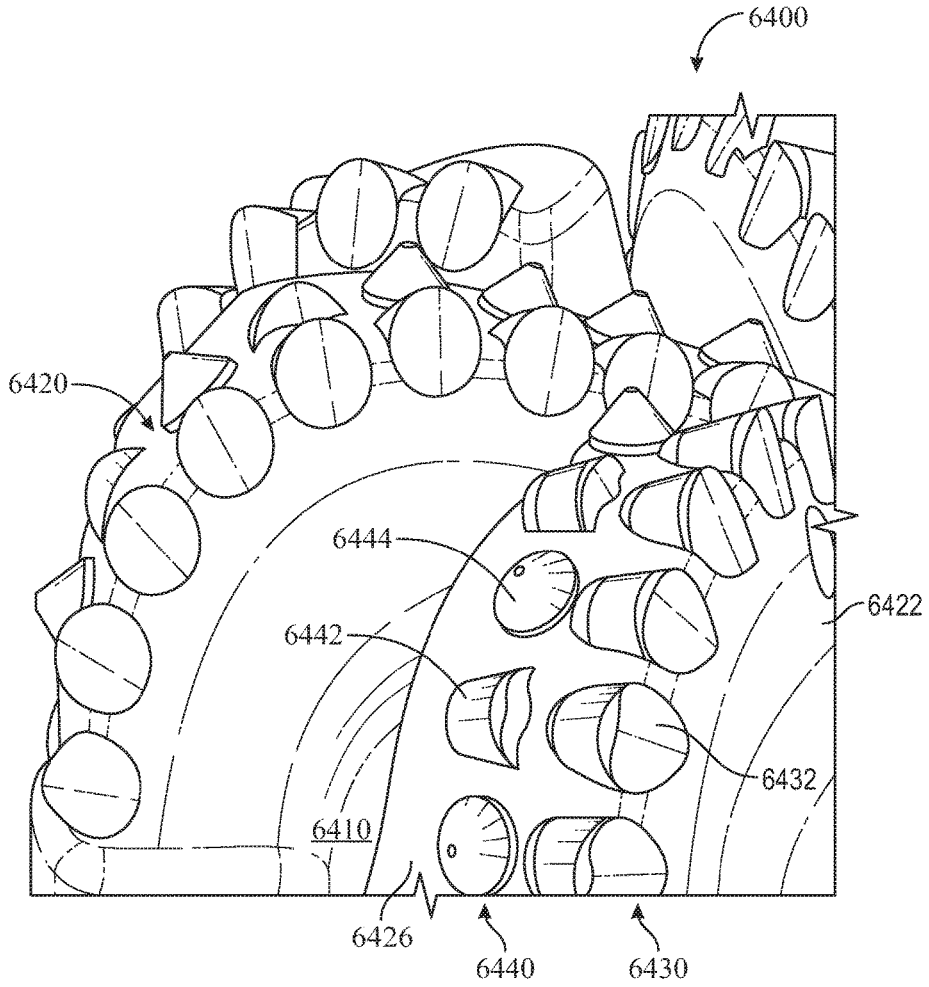
FIG. 64 shows a partial side view of a drill bit according to embodiments of the present disclosure.

FIG. 64 shows a partial view of a drill bit according to embodiments of the present disclosure. The drill bit 6400 has a bit body 6410 and at least one blade 6420 extending from the bit body 6410. Each blade 6420 has a cutting face 6422 that faces in the direction of bit rotation, a trailing face opposite the cutting face 6422, and a top face 6426. A first row 6430 of cutting elements is disposed along the cutting face 6422 of at least one blade 6420. One or more of the cutting elements in the first row 6430 may include a cutting element 6432 having a non-planar top surface and/or a non-planar interface formed between an ultrahard layer and a substrate of the cutting element, according to embodiments of the present disclosure, such as described above. For example, the cutting element 6432 may include a substrate having an upper surface with a crest formed therein, where the crest transitions into a depressed region, and an ultrahard layer on the upper surface, thereby forming a non-planar interface between the ultrahard layer and the substrate. Further, a top surface of the ultrahard layer has a cutting crest extending across a diameter of the cutting element and decreases in height extending laterally away from the cutting crest. In the embodiment shown, the cutting crest along the top surface of the cutting element 6432 forms a parabolic cylinder shape.

The bit 6400 further includes a second row 6440 of cutting elements disposed along the top face 6426 of the blade 6420, rearward of the first row 6430. Cutting elements in the second row 6440 include at least one cutting element 6442 having a hyperbolic paraboloid shaped top surface according to embodiments of the present disclosure and at least one cutting element 6444 having a conical top surface, where the conical top surface may have a rounded apex with a radius of curvature. Cutting elements 6444 may be positioned in an alternating arrangement with cutting elements 6442 along the second row 6440. In other embodiments, a single type of cutting element (e.g., a cutting element according to embodiments disclosed above, a cutting element having a conical top surface, or a cutting element having a planar top surface) may be positioned adjacent to each other within a row of cutting elements. For example, as shown in FIG. 64, a portion of the second row 6440 includes a plurality of cutting elements 6444 having a conical top surface positioned adjacent to each other, and another portion of the second row 6840 includes cutting elements 6444 having a conical top surface in an alternating arrangement with cutting elements 6442 according to embodiments of the present disclosure. Further, the entire first row 6430 of cutting elements includes a plurality of cutting elements 6432 according to embodiments of the present disclosure.

Figure 73:
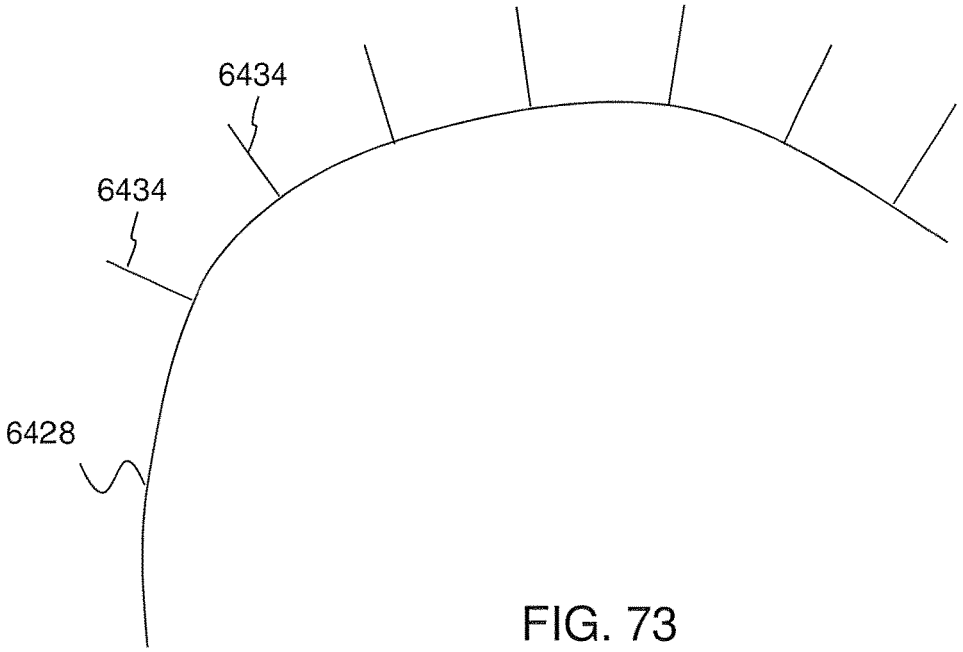
FIG. 73 shows cutting element alignment according to embodiments of the present disclosure.

Further, as shown, one or more of the cutting elements 6432 of the present disclosure may be aligned (with respect to rotation of the cutting element about its central axis) so that the length of cutting crest 6434 of cutting element 6432 may extend substantially perpendicular (within 20, 10, or 5 degrees of perpendicular in various embodiments) away from a profile curve 6428 of the blade 6420 (illustrated in FIG. 73). Such alignment is indicative of the rotation of the cutting elements 6432 and can be implemented for any back rake angle at which the cutting element 6432 is oriented. Such alignment may be achieved through the use of any type of alignment tool, such as a tweezer-like tool that aligns the cutting crest 6434 relative to the blade top face 6422 (e.g., allows a user to manually align the cutting crest or mechanically aligns the cutting crest). Any suitable tool and method may be used to align the cutting crest.

In yet other embodiments, a single type of cutting element may be positioned in a row along a region of the blade. For example, one or more cutting elements having the same shaped top surface may be positioned in a row of cutting elements along a region of a blade. Regions of a blade may generally be divided into a cone region, a shoulder region, and a gage region, where the cone region refers to the radially innermost region of the bit, the gage region refers to the region of the blade along the outer diameter of the bit, and the shoulder region refers to the region of the bit positioned radially between the cone region and the gage region. The shoulder region may also be described as the region of the blade having a convex or upturned curve profile.

Figure 65:
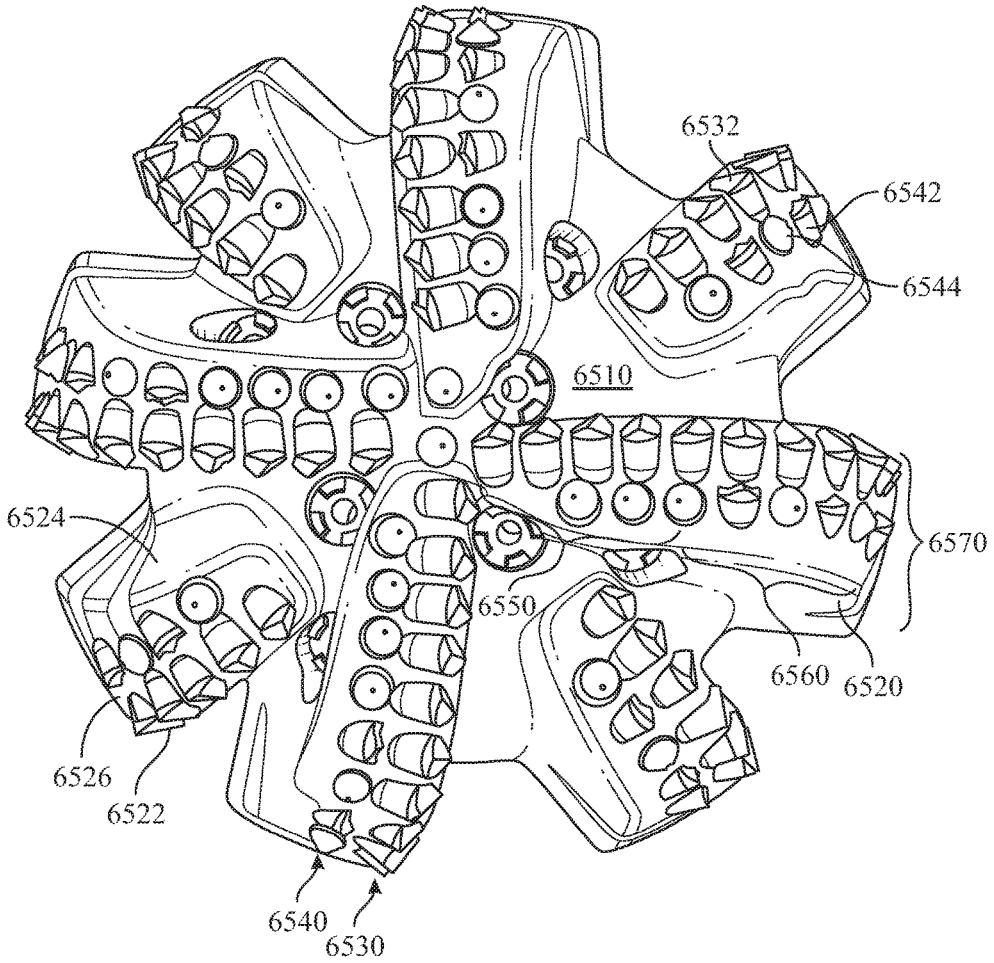
FIG. 65 shows a bottom view of a drill bit according to embodiments of the present disclosure.
Figure 66:
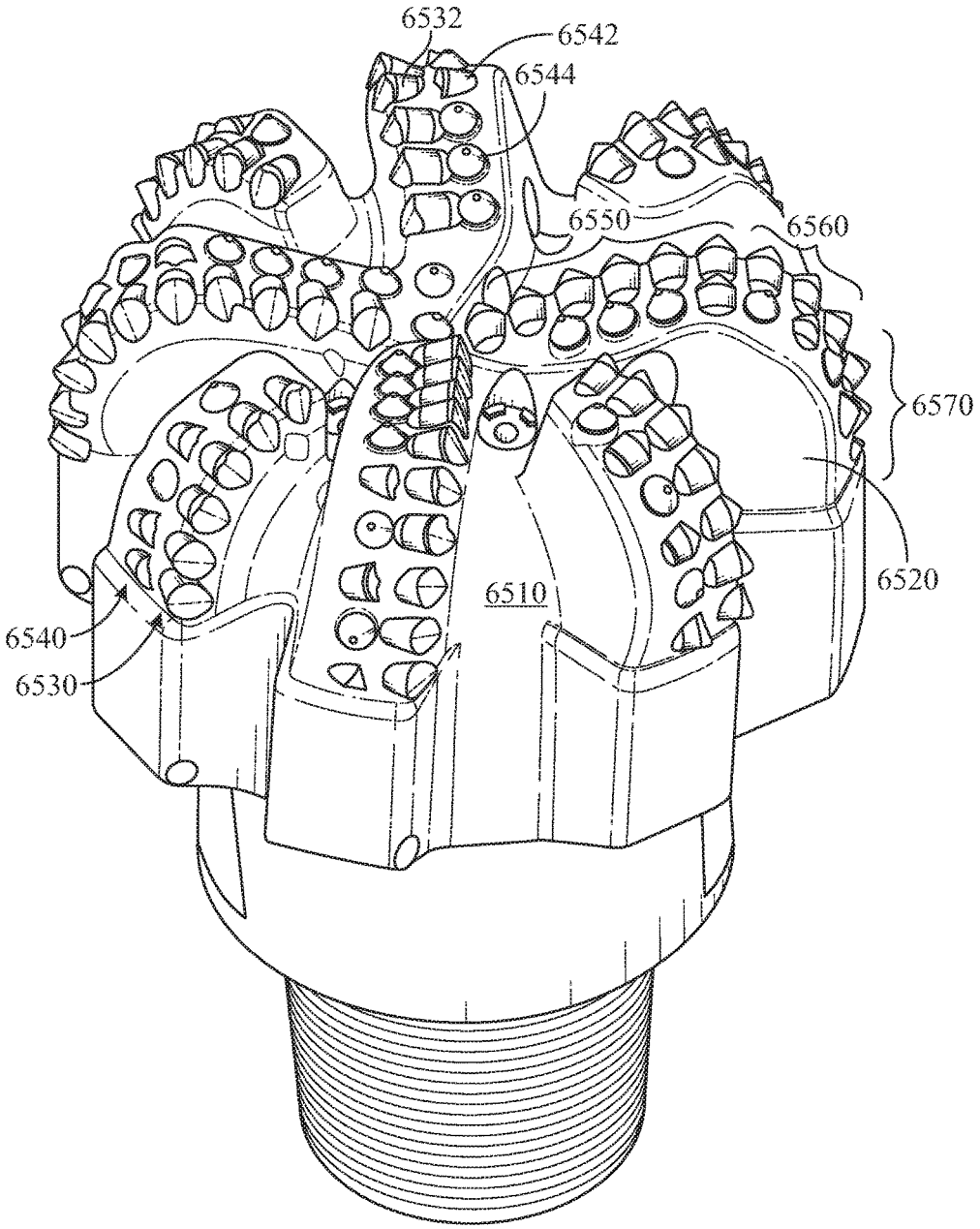
FIG. 66 shows a side view of a drill bit according to embodiments of the present disclosure.

For example, FIGS. 65 and 66 show a bottom view and a perspective view of a drill bit 6500 according to embodiments of the present disclosure having a bit body 6510 and a plurality of blades 6520 extending therefrom. Each blade 6520 has a leading face 6522, a trailing face 6524 opposite the leading face, and a top face 6526. A first row 6530 of cutting elements is disposed along the leading edge (where the leading face transitions to the top face) of at least one blade, where the cutting elements 6532 in the first row have non-planar top surfaces according to embodiments described above. A second row 706540 of cutting elements is disposed along the top face of the blade and rearward of the first row 6530 of cutting elements, where the second row 6540 includes cutting elements 6542 according to embodiments of the present disclosure and cutting elements 6544 having a conical top surface. The second row 6540 of cutting elements along a cone region 6550 of the blade 6520 includes cutting elements 6544 having a conical top surface, and the second row 6540 of cutting elements along a shoulder region 6560 of the blade 6520 includes an alternating arrangement of cutting elements 6544 having a conical top surface and cutting elements 6542 according to embodiments of the present disclosure. Further, the second row 6540 of cutting elements along a gage region 6570 of the blade 6520 includes one or more cutting elements 6544 having a conical top surface. However, in other embodiments, different combinations of types of cutting elements may be positioned in a row along a cone region, a shoulder region and a gage region of a blade. For example, one or more cutting elements having a planar top surface may be positioned in a row of cutting elements along the cone, shoulder and/or gage region of a blade; one or more cutting elements having an parabolic cylinder shaped top surface may be positioned in a row of cutting elements along the cone, shoulder and/or gage region of a blade; one or more cutting elements having a hyperbolic paraboloid shaped top surface may be positioned in a row of cutting elements along the cone, shoulder and/or gage region of a blade; and/or one or more cutting elements having a non-planar top surface may be positioned in a row of cutting elements along the cone, shoulder and/or gage region of a blade.

Figure 74:
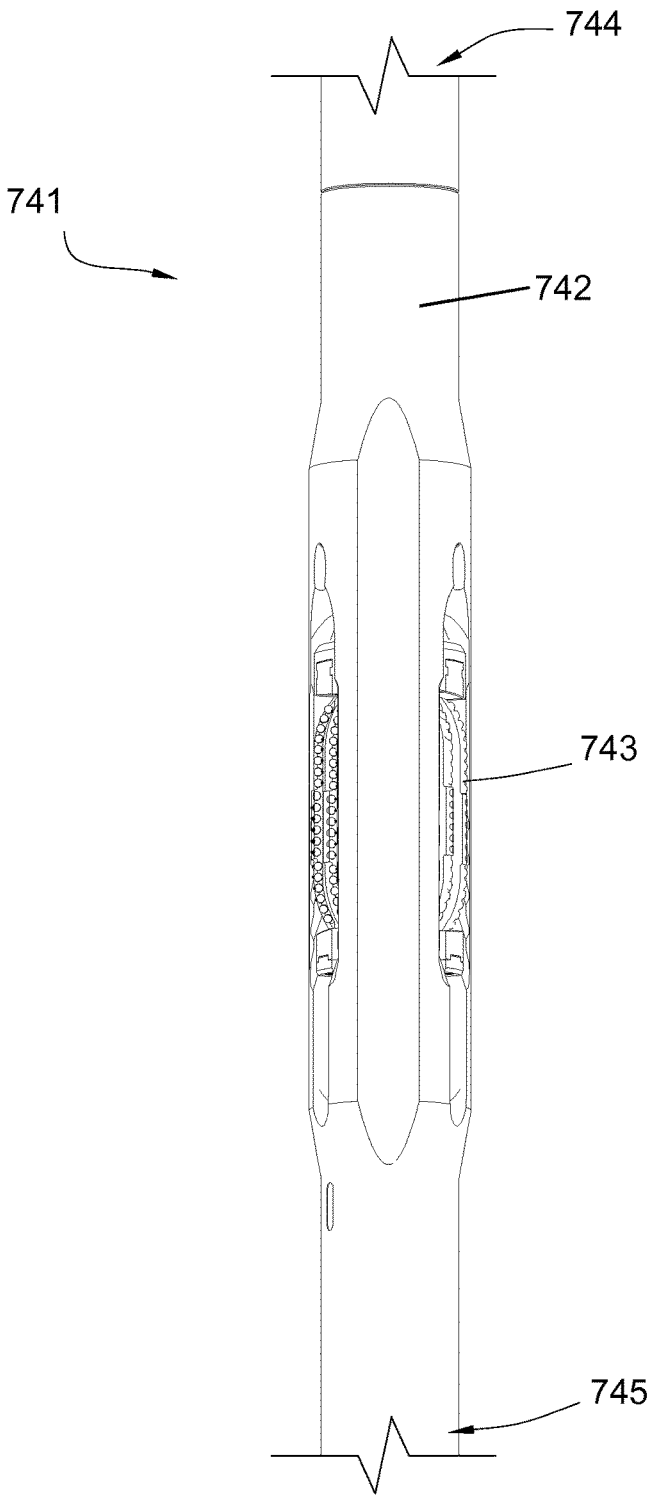
FIG. 74 shows a side view of an expandable reamer according to embodiments of the present disclosure.

Further, while only a drill bit has been illustrated, the cutting elements of the present disclosure may be used on other types of cutting tools such as reamers, mills, etc., as shown in FIG. 67. For example, FIG. 67 shows a general configuration of a hole opener 830 that includes one or more cutting elements of the present disclosure. The hole opener 830 has a tool body 832 and a plurality of blades 838 disposed at selected azimuthal locations about a circumference thereof. The hole opener 830 generally has connections 834, 836 (e.g., threaded connections) so that the hole opener 830 may be coupled to adjacent drilling tools that comprise, for example, a drillstring and/or bottom hole assembly (BHA). The tool body 832 generally includes a bore therethrough so that drilling fluid may flow through the hole opener 830 as it is pumped from the surface (e.g., from surface mud pumps) to a bottom of the wellbore. Similarly, FIG. 74 shows a general configuration of an expandable reamer 741 that includes one or more cutting elements of the present disclosure. The expandable reamer 741 has a tool body 742 and a plurality of blades 743 disposed at selected azimuthal locations about a circumference thereof. The blades may be movable and may be extended radially outwardly from the body in response to differential fluid pressure between the throughbore and the wellbore annulus. The expandable reamer 741 generally has connections 744, 745 (e.g., threaded connections) so that the expandable reamer 741 may be coupled to adjacent drilling tools. The tool body 742 generally includes a bore therethrough so that drilling fluid may flow through the expandable reamer 741 as it is pumped from the surface (e.g., from surface mud pumps) to a bottom of the wellbore.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Further, it should be understood that any directions or reference frames in the preceding description are merely relative directions or movements. For example, any references to "up" and "down" or "above" or "below" are merely descriptive of the relative position or movement of the related elements. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

What is claimed is:

1. A cutting element comprising:

a substrate, an upper surface of the substrate including a crest, the crest transitioning into a depressed region, and an ultrahard layer on the upper surface, thereby forming a non-planar interface between the ultrahard layer and the substrate, a top surface of the ultrahard layer comprising:

a cutting crest extending along at least a portion of a diameter of the cutting element, the top surface having a portion extending laterally away from the cutting crest having a lesser height than a peak of the cutting crest, wherein the cutting crest extends along a major dimension of the cutting crest to a peripheral edge of the top surface and wherein the portion of the top surface extending laterally away from the cutting crest to the peripheral edge of the top surface is, adjacent to the peripheral edge, non-perpendicular to a longitudinal axis of the cutting element, and wherein, in a plane orthogonal to the major dimension of the cutting crest and extending through both the major dimension of the cutting crest and the peripheral edge, the top surface defines a shape consisting of at least one linear shape, at least one convex shape, or at least one linear shape and at least one convex shape, from the peripheral edge to the cutting crest.

2. The cutting element of claim 1, wherein the top surface has a peripheral edge extending around the cutting element and a cutting edge portion of the peripheral edge is adjacent the cutting crest, and wherein the peripheral edge decreases in height in a direction away from the cutting crest and the cutting edge portion to another portion of the peripheral edge adjacent to a recessed region of the ultrahard layer.

3. The cutting element of claim 1, wherein the top surface comprises a plurality of cutting crests extending from a peripheral edge radially inwards to intersect at a central region.

4. The cutting element of claim 1, wherein the cutting crest varies in height to form a continuous curve along its length.

5. The cutting element of claim 1, wherein a profile of the cutting crest along its length includes at least one concave region.

6. The cutting element of claim 1, wherein the cutting crest is aligned with the crest of the substrate.

7. The cutting element of claim 1, wherein at least a portion of the cutting crest has a radius of curvature ranging from 0.06 to 0.18 inches.

8. The cutting element of claim 1, wherein a tapered transition is adjacent to each radial end of the crest of the substrate.

9. A cutting element, comprising:

a substrate having a non-planar upper surface, the non-planar upper surface being non-axisymmetric about a longitudinal axis formed through the center of the substrate, and having a first convex curvature extending along a first direction in a first plane and a second convex curvature having a smaller radius of curvature than the first convex curvature extending in a second direction in a second plane perpendicular to the first plane, wherein the longitudinal axis lies on each of the first plane and second plane; and an ultrahard layer with a non-planar top surface on the non-planar upper surface of the substrate.

10. The cutting element of claim 9, further comprising a plurality of surface alterations on the non-planar upper surface of the substrate.

11. The cutting element of claim 10, wherein the surface alterations are a plurality of elongate protrusions substantially aligned with the first direction.

12. The cutting element of claim 9, wherein the non-planar top surface of the ultrahard layer includes a cutting crest extending along at least a portion of a diameter of the cutting element, the non-planar top surface having a portion extending laterally away from the cutting crest having a lesser height than a peak of the cutting crest.

13. The cutting element of claim 12, wherein the cutting crest is substantially aligned with the first convex curvature.

14. The cutting element of claim 9, wherein the first convex curvature and the second convex curvature extend to a peripheral edge of the upper surface.

15. A cutting tool, comprising:

a tool body;

at least one blade extending from the tool body; and a first row of cutting elements attached to the at least one blade, the first row of cutting elements comprising at least one cutting element of claim 1.

16. The cutting tool of claim 15, further comprising a second row of cutting elements attached to the at least one blade rearward from the first row, wherein the second row of cutting elements comprises at least one cutting element having a substantially pointed cutting tip.

17. The cutting tool of claim 15, wherein the cutting crest of the at least one cutting element is oriented at an angle ranging from 0 to 40 degrees relative to a line parallel to a central axis of the cutting tool.

18. The cutting tool of claim 15, wherein a central axis of the at least one cutting element is oriented at an angle ranging from 0 to 25 degrees relative to a line parallel to a central axis of the cutting tool.

19. A cutting tool, comprising:

a tool body;

at least one blade extending from the tool body; and at least one cutting element of claim 9 attached to at least one blade.

20. A cutting tool, comprising:

a tool body;

at least one blade extending from the tool body; and at least one cutting element attached to the at least one blade, the at least one cutting element having a non-planar top surface that includes a cutting crest extending along at least a portion of a diameter of the cutting element, the non-planar top surface having a portion extending laterally away from the cutting crest having a lesser height than a peak of the cutting crest, a central axis of the at least one cutting element being oriented at an angle ranging from 0 to 25 degrees relative to a line parallel to a central axis of the cutting tool, wherein the cutting crest extends along a major dimension of the cutting crest to a peripheral edge of the top surface and wherein the portion of the top surface extending laterally away from the cutting crest to the peripheral edge of the top surface is, adjacent to the peripheral edge, non-perpendicular to a longitudinal axis of the cutting element, and wherein, in a plane orthogonal to the major dimension of the cutting crest and extending through both the major dimension of the cutting crest and the peripheral edge, the top surface defines a shape consisting of at least one linear shape, at least one convex shape, or at least one linear shape and at least one convex shape, from the peripheral edge to the cutting crest.

21. The cutting tool of claim 20, wherein the at least one cutting element is a primary cutting element.

22. The cutting tool of claim 20, wherein the at least one cutting element is a secondary cutting element trailing a shear cutter.

* * * * *